US007597630B2

(12) United States Patent
Henry

(10) Patent No.: US 7,597,630 B2
(45) **Date of Patent: *Oct. 6, 2009**

(54) WATER AMUSEMENT PARK CONVEYORS

(75) Inventor: Jeffery Wayne Henry, New Braunfels, TX (US)

(73) Assignee: Water Ride Concepts, Inc., New Braunfels, TX (US)

( * ) Notice: Subject to any disclaimer, the term of this patent is extended or adjusted under 35 U.S.C. 154(b) by 318 days.

This patent is subject to a terminal disclaimer.

(21) Appl. No.: 10/997,790

(22) Filed: Nov. 24, 2004

(65) Prior Publication Data

US 2006/0111195 A1 May 25, 2006

(51) Int. Cl.
*A63H 31/00* (2006.01)

(52) U.S. Cl. ..... 472/128; 472/117; 472/129; 472/13; 104/69

(58) Field of Classification Search ..... 472/116, 472/117, 128, 129, 13; 104/53, 69, 70
See application file for complete search history.

(56) References Cited

U.S. PATENT DOCUMENTS

| | | | |
|---|---|---|---|
| 193,516 | A | 7/1877 | Johns |
| 419,860 | A | 1/1890 | Libbey |
| 435,227 | A | 8/1890 | Inglis |

(Continued)

FOREIGN PATENT DOCUMENTS

| | | |
|---|---|---|
| BE | 543055 | 12/1955 |
| DE | 129145 | 3/1902 |
| DE | 893778 | 10/1953 |
| DE | 4243812 A1 | 6/1994 |

(Continued)

OTHER PUBLICATIONS

International Search Report for PCT/US01/28535 mailed Mar. 27, 2002.

(Continued)

*Primary Examiner*—Kien Nguyen
(74) *Attorney, Agent, or Firm*—Meyertons, Hood, Kivlin, Kowert & Goetzel, P.C.; Eric B. Meyertons

(57) ABSTRACT

An amusement ride system and method are described. In some embodiments, an amusement ride system may be generally related to water amusement attractions and rides. Further, the disclosure generally relates to water-powered rides and to a system and method in which participants may be more involved in a water attraction. An amusement ride system may include system for conveying a participant from a first source of water to a second source of water. The system may include one or more fluid jets. The fluid jets may function to produce a fluid stream having a predetermined velocity which is selectively greater, less than, or the same as a velocity of a participant at each of the fluid jet locations and are oriented tangentially with respect to the surface of the source of water so as to contact a participant and/or participant vehicle. An amusement ride system may include a system for controlling a participant flow rate through a multi path water amusement ride system. The system may include at least one gate mechanism which functions, upon activation, to inhibit a participant from entering one or more path choices. An amusement ride system may include a system for facilitating entry of a participant on a floatation device. The system may include one or more portions of water including a depth of water which allows a participant to more easily enter a floatation device.

34 Claims, 28 Drawing Sheets

U.S. PATENT DOCUMENTS

| | | | |
|---|---|---|---|
| 485,624 | A | 11/1892 | Gardner |
| 536,441 | A | 3/1895 | Morris |
| 540,715 | A | 6/1895 | Butler |
| 548,256 | A | 10/1895 | Idler |
| 552,713 | A | 1/1896 | Lenox |
| 555,049 | A | 2/1896 | Ogilbe |
| 566,182 | A | 8/1896 | Jackman |
| 570,016 | A | 10/1896 | Harman |
| 572,426 | A | 12/1896 | Idler |
| 576,704 | A | 2/1897 | Urch |
| 583,121 | A | 5/1897 | Pattee |
| 604,164 | A | 5/1898 | Wilde et al. |
| 610,548 | A | 9/1898 | Manny |
| 640,439 | A | 1/1900 | Boyton |
| 654,980 | A | 7/1900 | Howard |
| 664,179 | A | 12/1900 | Schofield |
| 665,765 | A | 1/1901 | Thompson |
| 689,114 | A | 12/1901 | Pape |
| 691,353 | A | 1/1902 | Carpenter et al. |
| 697,202 | A | 4/1902 | Donne |
| 697,891 | A | 4/1902 | Schrader |
| 714,717 | A | 12/1902 | LaPorte |
| 720,014 | A | 2/1903 | Folks |
| 724,040 | A | 3/1903 | Pusterla |
| 724,757 | A | 4/1903 | Symonds |
| 728,303 | A | 5/1903 | Roltair |
| 728,894 | A | 5/1903 | Folks |
| 741,964 | A | 10/1903 | Harlan |
| 743,968 | A | 11/1903 | Wilson |
| 744,880 | A | 11/1903 | Smith |
| 753,311 | A | 3/1904 | Pusterla |
| 753,449 | A | 3/1904 | Thompson |
| 754,698 | A | 3/1904 | Reed |
| 757,286 | A | 4/1904 | Du Clos |
| 760,503 | A | 5/1904 | Welsh |
| 762,566 | A | 6/1904 | Webster et al. |
| 764,675 | A | 7/1904 | Pfeiffer |
| 774,209 | A | 11/1904 | Stubbs |
| 774,274 | A | 11/1904 | Pusterla |
| 774,917 | A | 11/1904 | Maguire |
| 776,936 | A | 12/1904 | Pusterla |
| 779,464 | A | 1/1905 | Bruce |
| 783,425 | A | 2/1905 | Folks |
| 792,422 | A | 6/1905 | Kelly |
| 801,945 | A | 10/1905 | Welsh |
| 808,487 | A | 12/1905 | Stahl |
| 824,436 | A | 6/1906 | Pester |
| 828,689 | A | 8/1906 | Thompson |
| 831,149 | A | 9/1906 | Faller |
| 849,970 | A | 4/1907 | Boyton |
| 868,736 | A | 10/1907 | Washington |
| 879,283 | A | 2/1908 | Mayberry et al. |
| 883,441 | A | 3/1908 | Andrews |
| 891,388 | A | 6/1908 | Visser et al. |
| 896,940 | A | 8/1908 | Rosen |
| 904,848 | A | 11/1908 | DeVore |
| 929,972 | A | 8/1909 | M'Giehan |
| 931,863 | A | 8/1909 | Haight |
| 952,673 | A | 3/1910 | Karr |
| 1,004,174 | A | 9/1911 | Kavakos |
| 1,056,929 | A | 3/1913 | Navarro |
| 1,062,838 | A | 5/1913 | Miller |
| 1,063,949 | A | 6/1913 | Bedient |
| 1,095,965 | A | 5/1914 | Glazier |
| 1,124,950 | A | 1/1915 | Reagen et al. |
| 1,158,295 | A | 10/1915 | Rodriguez |
| 1,159,519 | A | 11/1915 | Menier |
| 1,167,993 | A | 1/1916 | Guzendorfer |
| 1,195,707 | A | 8/1916 | Miller |
| 1,198,749 | A | 9/1916 | Myers |
| 1,230,559 | A | 6/1917 | Burke |
| 1,249,455 | A | 12/1917 | Myers |
| 1,320,124 | A | 10/1919 | Chrul |
| 1,378,635 | A | 5/1921 | Unger |
| 1,399,469 | A | 12/1921 | Cucullu |
| 1,417,570 | A | 5/1922 | Ridgway |
| 1,440,661 | A | 1/1923 | Dickinson |
| 1,441,126 | A | 1/1923 | Sherman et al. |
| 1,448,306 | A | 3/1923 | Lezert |
| 1,497,754 | A | 6/1924 | Howard |
| 1,520,217 | A | 12/1924 | Auperl |
| 1,540,635 | A | 6/1925 | Kohl |
| 1,551,249 | A | 8/1925 | Held |
| 1,563,855 | A | 12/1925 | Held |
| 1,591,566 | A | 7/1926 | Schmidt et al. |
| 1,601,483 | A | 9/1926 | Vaszin |
| 1,606,024 | A | 11/1926 | Gorhum et al. |
| 1,606,854 | A | 11/1926 | Vaszin |
| 1,607,771 | A | 11/1926 | Miller |
| 1,609,922 | A | 12/1926 | Wiig |
| 1,648,196 | A | 11/1927 | Rohmer |
| 1,763,976 | A | 6/1930 | Lippincott |
| 1,783,268 | A | 12/1930 | Traver |
| 1,849,226 | A | 3/1932 | Erban |
| 1,859,267 | A | 5/1932 | Kurz |
| 1,893,167 | A | 1/1933 | Glagolin |
| 1,926,780 | A | 9/1933 | Lppincott |
| 2,064,035 | A | 12/1936 | Rynearson |
| 2,146,631 | A | 2/1939 | Kish |
| 2,484,466 | A | 10/1949 | Rumler |
| 2,705,144 | A | 3/1955 | Ridgway |
| 2,738,885 | A | 3/1956 | Demaline |
| 2,888,205 | A | 5/1959 | Trucco |
| D190,127 | S | 4/1961 | Fowler |
| 2,991,726 | A | 7/1961 | Miller |
| 3,000,017 | A | 9/1961 | Skovira |
| 3,003,430 | A | 10/1961 | Hamel |
| 3,030,895 | A | 4/1962 | Hamel |
| 3,113,528 | A | 12/1963 | Morgan et al. |
| 3,114,333 | A | 12/1963 | Fowler et al. |
| 3,116,925 | A | 1/1964 | Welch |
| D204,282 | S | 4/1966 | Morgan |
| 3,302,413 | A | 2/1967 | Burnett |
| 3,390,640 | A | 7/1968 | Couttet et al. |
| 3,404,635 | A | 10/1968 | Bacon et al. |
| 3,456,943 | A | 7/1969 | Brown |
| 3,473,334 | A | 10/1969 | Dexter |
| 3,508,405 | A | 4/1970 | Koch |
| 3,534,413 | A | 10/1970 | Plasseraud |
| 3,598,402 | A | 8/1971 | Frenzl |
| 3,690,265 | A | 9/1972 | Horibata |
| D229,354 | S | 11/1973 | Morgan |
| 3,827,387 | A | 8/1974 | Morgan |
| 3,830,161 | A | 8/1974 | Bacon |
| 3,853,067 | A | 12/1974 | Bacon |
| 3,861,514 | A | 1/1975 | Ling |
| 3,865,041 | A | 2/1975 | Bacon |
| 3,890,655 | A | 6/1975 | Mathis |
| 3,913,332 | A | 10/1975 | Forsman |
| 3,923,301 | A | 12/1975 | Myers |
| 3,930,450 | A | 1/1976 | Symons |
| 3,956,779 | A | 5/1976 | Jewett |
| 4,001,899 | A | 1/1977 | Mathis |
| 4,063,517 | A | 12/1977 | Nardozzi, Jr. |
| 4,073,722 | A | 2/1978 | Grutsch |
| 4,149,469 | A | 4/1979 | Bigler |
| 4,149,710 | A | 4/1979 | Rouchard |
| 4,175,361 | A | 11/1979 | Kumode |
| 4,194,733 | A | 3/1980 | Whitehouse, Jr. |
| 4,196,900 | A | 4/1980 | Becker et al. |
| 4,198,043 | A | 4/1980 | Timbes et al. |
| 4,205,785 | A | 6/1980 | Stanley |
| 4,221,170 | A | 9/1980 | Koudelka |
| 4,225,953 | A | 9/1980 | Simon et al. |

4,278,247 A 7/1981 Joppe et al.
4,299,171 A 11/1981 Larson
4,305,117 A 12/1981 Evans
4,337,704 A 7/1982 Becker et al.
4,376,404 A 3/1983 Haddad
D269,082 S 5/1983 Spieldiener
4,391,201 A 7/1983 Bailey
4,392,434 A 7/1983 Dürwald et al.
4,429,867 A 2/1984 Barber
4,484,739 A 11/1984 Kreinbihl et al.
4,484,836 A 11/1984 Bailard
4,501,434 A 2/1985 Dupuis
4,516,943 A 5/1985 Spieldiener et al.
4,543,886 A 10/1985 Spieldiener et al.
4,545,574 A 10/1985 Sassak
4,545,583 A 10/1985 Pearman et al.
4,564,190 A 1/1986 Frenzl
4,576,512 A 3/1986 Combes et al.
4,683,686 A 8/1987 Ozdemir
4,695,058 A 9/1987 Carter, III et al.
4,696,251 A 9/1987 Spieldiener et al.
4,741,388 A 5/1988 Kuriowa
4,759,545 A 7/1988 Grable
4,778,430 A 10/1988 Goldfarb et al.
4,783,861 A 11/1988 Leurent
4,792,260 A 12/1988 Sauerbier
4,797,027 A 1/1989 Combes et al.
4,797,605 A 1/1989 Palanisamy
4,805,896 A 2/1989 Moody
4,805,897 A 2/1989 Dubeta
4,817,312 A 4/1989 Fuller et al.
4,836,521 A 6/1989 Barber
4,850,896 A 7/1989 Smith et al.
4,854,256 A 8/1989 Hayashi
4,905,987 A 3/1990 Frenzi
4,939,358 A 7/1990 Herman et al.
4,954,014 A 9/1990 Sauerbier et al.
4,960,275 A 10/1990 Magon
4,963,057 A 10/1990 Fournier
4,979,679 A 12/1990 Downs
4,984,783 A 1/1991 Fujimaki
4,986,784 A 1/1991 French
5,011,134 A 4/1991 Langford
5,011,161 A 4/1991 Galphin
5,020,465 A 6/1991 Langford
5,022,588 A 6/1991 Haase
5,033,392 A 7/1991 Schemitsch
5,069,387 A 12/1991 Alba
5,069,443 A 12/1991 Shiratori
5,073,082 A 12/1991 Radlik
5,115,908 A 5/1992 Williams
5,137,497 A 8/1992 Dubeta
5,143,107 A 9/1992 Kelley
D330,579 S 10/1992 Briggs
5,152,210 A 10/1992 Chen
5,167,321 A 12/1992 Brodrick, Sr.
5,171,101 A 12/1992 Sauerbier et al.
5,183,437 A 2/1993 Millay et al.
5,194,048 A 3/1993 Briggs
5,213,547 A 5/1993 Lochtefeld
5,219,315 A 6/1993 Fuller et al.
5,224,652 A 7/1993 Kessler
5,230,662 A 7/1993 Langford
5,236,280 A 8/1993 Lochtefeld
RE34,407 E 10/1993 Frenzl
5,253,864 A 10/1993 Heege et al.
5,265,373 A 11/1993 Vollebregt
5,265,802 A 11/1993 Hobbs et al.
5,271,692 A 12/1993 Lochtefeld
5,299,964 A 4/1994 Hopkins
5,320,362 A 6/1994 Bear et al.
5,323,307 A 6/1994 Wolf et al.
5,378,197 A 1/1995 Briggs
5,387,158 A 2/1995 Bertrand
5,393,170 A 2/1995 Lochtefeld
5,401,117 A 3/1995 Lochtefeld
5,403,238 A 4/1995 Baxter et al.
5,405,294 A 4/1995 Briggs
5,421,451 A 6/1995 Easton
5,421,782 A 6/1995 Lochtefeld
5,426,899 A 6/1995 Jones
5,427,574 A 6/1995 Donnelly-Weide
5,433,671 A 7/1995 Davis
5,437,463 A 8/1995 Fromm
5,439,170 A 8/1995 Dach
5,452,678 A 9/1995 Simpkins
5,453,054 A 9/1995 Langford
5,461,876 A 10/1995 Dressler
5,478,281 A 12/1995 Forton
5,482,510 A 1/1996 Ishii et al.
5,494,729 A 2/1996 Henry et al.
5,499,821 A 3/1996 Rycroft
5,503,597 A 4/1996 Lochtefeld et al.
5,513,470 A 5/1996 Vollebregt
5,536,210 A 7/1996 Barber
5,540,622 A 7/1996 Gold et al.
5,564,859 A 10/1996 Lochtefeld
5,564,984 A 10/1996 Mirabella et al.
5,581,954 A 12/1996 Vollebregt
5,613,443 A 3/1997 Ariga et al.
5,623,986 A 4/1997 Wiggs
5,628,584 A 5/1997 Lochtefeld
5,649,867 A 7/1997 Briggs
5,662,525 A 9/1997 Briggs
5,664,910 A 9/1997 Lochtefeld et al.
5,667,445 A 9/1997 Lochtefeld
5,678,956 A 10/1997 Freelain
5,685,778 A 11/1997 Sheldon et al.
5,704,294 A 1/1998 Van Winkle et al.
5,716,282 A 2/1998 Ring et al.
5,732,635 A 3/1998 McKoy
5,735,748 A 4/1998 Meyers et al.
5,738,590 A 4/1998 Lochtefeld
5,741,189 A 4/1998 Briggs
5,761,776 A 6/1998 Vollebregt
5,766,082 A 6/1998 Lochtefeld et al.
5,779,553 A 7/1998 Langford
5,785,592 A 7/1998 Jacobsen
5,791,254 A 8/1998 Mares et al.
5,809,701 A 9/1998 Vollebregt
5,816,314 A 10/1998 Wiggs et al.
5,820,471 A 10/1998 Briggs
5,820,472 A 10/1998 Briggs
D403,392 S 12/1998 Briggs et al.
5,853,332 A 12/1998 Briggs
5,860,364 A 1/1999 McKoy
5,860,766 A 1/1999 Lochtefeld et al.
5,865,680 A 2/1999 Briggs
D406,871 S 3/1999 Briggs
D407,133 S 3/1999 Briggs
5,899,633 A 5/1999 Lochtefeld
5,899,634 A 5/1999 Lochtefeld
5,911,190 A 6/1999 Lochtefeld et al.
5,927,478 A 7/1999 Archer
D413,957 S 9/1999 Briggs
5,950,253 A 9/1999 Last
5,967,901 A 10/1999 Briggs
D416,066 S 11/1999 Briggs
5,978,593 A 11/1999 Sexton
5,989,126 A 11/1999 Kilbert et al.
6,006,672 A 12/1999 Newfarmer et al.
D421,283 S 2/2000 Briggs et al.
6,036,603 A 3/2000 Mason et al.
6,045,449 A 4/2000 Aragona et al.
6,075,442 A 6/2000 Welch
6,089,987 A 7/2000 Briggs

| | | | | |
|---|---|---|---|---|
| 6,105,527 | A | 8/2000 | Lochtefeld et al. | |
| 6,113,506 | A | 9/2000 | Nielsen | |
| 6,115,974 | A | 9/2000 | Milanian | |
| 6,132,317 | A | 10/2000 | Lochtefeld | |
| 6,132,318 | A | 10/2000 | Briggs | |
| 6,139,382 | A | 10/2000 | Eschbacher et al. | |
| 6,146,282 | A | 11/2000 | McCready et al. | |
| 6,161,771 | A | 12/2000 | Henry | |
| 6,162,127 | A | 12/2000 | Ochi | |
| 6,174,242 | B1 | 1/2001 | Briggs et al. | |
| 6,186,902 | B1 | 2/2001 | Briggs | |
| 6,195,851 | B1 | 3/2001 | Vollebregt et al. | |
| 6,210,287 | B1 | 4/2001 | Briggs | |
| 6,231,451 | B1 | 5/2001 | Briggs | |
| 6,237,499 | B1 | 5/2001 | McKoy | |
| 6,261,186 | B1 | 7/2001 | Henry | |
| 6,264,202 | B1 | 7/2001 | Briggs | |
| 6,265,977 | B1 | 7/2001 | Vega et al. | |
| 6,272,695 | B1 | 8/2001 | Brandner | |
| 6,276,353 | B1 | 8/2001 | Briggs et al. | |
| 6,280,342 | B1 | 8/2001 | Tod | |
| 6,283,871 | B1 | 9/2001 | Briggs | |
| 6,319,137 | B1 | 11/2001 | Lochtefeld | |
| 6,320,495 | B1 | 11/2001 | Sporgis | |
| 6,336,771 | B1 | 1/2002 | Hill | |
| 6,354,955 | B1 | 3/2002 | Stuart et al. | |
| 6,362,778 | B2 | 3/2002 | Neher | |
| 6,375,578 | B1 | 4/2002 | Briggs | |
| 6,443,849 | B1 | 9/2002 | Byrd | |
| 6,460,201 | B1 | 10/2002 | Lochtefeld | |
| 6,475,095 | B1 | 11/2002 | Henry | |
| 6,488,590 | B2 | 12/2002 | Katayama | |
| 6,491,589 | B1 | 12/2002 | Lochtefeld | |
| 6,520,853 | B2 | 2/2003 | Suzuki | |
| 6,526,158 | B1 | 2/2003 | Goldberg | |
| 6,527,646 | B1 | 3/2003 | Briggs | |
| 6,533,191 | B1 | 3/2003 | Berger et al. | |
| 6,553,336 | B1 | 4/2003 | Johnson et al. | |
| 6,561,914 | B2 | 5/2003 | Henry | |
| 6,569,023 | B1 | 5/2003 | Briggs | |
| 6,579,175 | B2 | 6/2003 | Suzuki | |
| 6,604,327 | B1 | 8/2003 | Reville | |
| 6,608,563 | B2 | 8/2003 | Weston et al. | |
| 6,634,949 | B1 | 10/2003 | Briggs et al. | |
| 6,651,268 | B1 | 11/2003 | Briggs | |
| 6,676,530 | B2 | 1/2004 | Lochtefeld | |
| 6,702,687 | B1 | 3/2004 | Henry | |
| 6,708,706 | B1 | 3/2004 | Robinson | |
| 6,716,107 | B2 | 4/2004 | Lochtefeld | |
| 6,738,992 | B2 | 5/2004 | Lochtefeld | |
| 6,758,231 | B1 * | 7/2004 | Lochtefeld et al. | 137/1 |
| 6,773,355 | B1 | 8/2004 | Lekhtman | |
| 6,786,830 | B2 | 9/2004 | Briggs et al. | |
| 6,789,608 | B1 | 9/2004 | Wiggs | |
| 6,796,908 | B2 | 9/2004 | Weston | |
| 6,830,146 | B1 | 12/2004 | Scully et al. | |
| 6,928,670 | B2 | 8/2005 | Lochtefeld et al. | |
| 6,957,662 | B2 | 10/2005 | Lochtefeld et al. | |
| 6,976,434 | B2 | 12/2005 | Roig et al. | |
| 7,004,847 | B2 | 2/2006 | Henry | |
| 7,029,400 | B2 | 4/2006 | Briggs | |
| 7,040,994 | B2 | 5/2006 | Lochtefeld et al. | |
| RE39,171 | E | 7/2006 | Lochtefeld | |
| 7,179,173 | B2 | 2/2007 | Henry et al. | |
| 7,229,359 | B2 | 6/2007 | Henry et al. | |
| 7,263,805 | B2 | 9/2007 | Chapus | |
| 7,285,053 | B2 | 10/2007 | Henry et al. | |
| 7,371,182 | B2 | 5/2008 | Henry et al. | |
| 7,371,183 | B2 | 5/2008 | Henry et al. | |
| 7,401,786 | B2 | 7/2008 | Lochtefeld | |
| 2002/0072317 | A1 | 6/2002 | Livingston et al. | |
| 2002/0082097 | A1 | 6/2002 | Henry et al. | |
| 2002/0180155 | A1 | 12/2002 | Lochtefeld | |
| 2003/0190967 | A1 | 10/2003 | Henry | |
| 2003/0203760 | A1 | 10/2003 | Henry et al. | |
| 2004/0077423 | A1 | 4/2004 | Weston et al. | |
| 2005/0034768 | A1 | 2/2005 | Henry et al. | |
| 2005/0047869 | A1 | 3/2005 | Lochtefeld | |
| 2005/0085306 | A1 | 4/2005 | Henry et al. | |
| 2005/0090319 | A1 | 4/2005 | Henry et al. | |
| 2005/0090320 | A1 | 4/2005 | Henry et al. | |
| 2005/0090321 | A1 | 4/2005 | Henry et al. | |
| 2005/0090322 | A1 | 4/2005 | Henry et al. | |
| 2005/0148398 | A1 | 7/2005 | Lochtefeld et al. | |
| 2005/0286976 | A1 | 12/2005 | Lochtefeld et al. | |
| 2005/0288111 | A1 | 12/2005 | Cowan et al. | |
| 2006/0154726 | A1 | 7/2006 | Weston et al. | |
| 2006/0214805 | A1 | 9/2006 | Boujon | |
| 2006/0229134 | A1 | 10/2006 | Briggs et al. | |
| 2006/0258471 | A1 | 11/2006 | Briggs et al. | |
| 2006/0260697 | A1 | 11/2006 | Lochtefeld et al. | |
| 2006/0287030 | A1 | 12/2006 | Briggs et al. | |
| 2007/0066396 | A1 | 3/2007 | Weston et al. | |
| 2007/0249425 | A1 | 10/2007 | Weston et al. | |
| 2008/0014835 | A1 | 1/2008 | Weston et al. | |
| 2008/0021776 | A1 | 1/2008 | Lochtefeld | |
| 2008/0216427 | A1 | 9/2008 | Lochtefeld | |

FOREIGN PATENT DOCUMENTS

| | | |
|---|---|---|
| EP | 1318864 | 6/2003 |
| EP | 1318864 | 11/2005 |
| EP | 1604712 | 2/2007 |
| WO | 92/03201 | 3/1992 |
| WO | 92/04087 | 3/1992 |
| WO | 97/33668 | 9/1997 |
| WO | 98/45006 | 10/1998 |
| WO | 01/10184 | 2/2001 |
| WO | 02/22226 | 3/2002 |
| WO | 02/22227 | 3/2002 |
| WO | 2005/042124 | 5/2005 |
| WO | 2006057970 | 6/2006 |
| WO | 2006/113936 | 10/2006 |
| WO | 2007/019278 | 2/2007 |
| WO | 2007/027841 | 3/2007 |
| WO | 2007/028040 | 3/2007 |
| WO | 2007/028042 | 3/2007 |
| WO | 2007/028043 | 3/2007 |
| WO | 2007/035524 | 3/2007 |
| WO | 2007/106717 | 9/2007 |

OTHER PUBLICATIONS

Written Opinion for PCT/US01/28535 mailed May 2, 2002.
Written Opinion for PCT/US01/28535 mailed Aug. 6, 2002.
International Preliminary Examination Report for PCT/US01/28535 issued Jan. 13, 2003.
Rorres, C. "The Turn of the Screw: Optimal Design of an Archimedes Screw" J. of Hydraulic Engineering, Jan. 2000, vol. 126, No. 1, pp. 72-80.
Office Action for U.S. Appl. No. 10/693,654 mailed on Dec. 7, 2004.
Office Action for U.S. Appl. No. 10/693,654 mailed on Jun. 10, 2005.
International Search Report for PCT/US01/28542 mailed Mar. 27, 2002.
Written Opinion for PCT/US01/28542 mailed May 2, 2002.
Written Opinion for PCT/US01/28542 issued Aug. 5, 2002.
International Preliminary Examination Report for PCT/US01/28542 issued Dec. 2, 2002.
Written Opinion for 01 970 881.7—2307 mailed Apr. 13, 2004.
Written Opinion for 01 970 881.7—2307 mailed Oct. 21, 2004.
Engineering drawing (as well as photographs of the finished product) for the Silver Dollar City water slide in Branson, Missouri, the date is unknown, however there is a 1986 copyright on the engineering drawing.
European Search Report for EP 05019093.3 mailed Oct. 28, 2005.
Office Action for U.S. Appl. No. 09/952,036 mailed on Feb. 9, 2006.

Co-Pending U.S. Appl. No. 10/997,791 entitled, "Rollable Carrier Ride" to Henry filed Nov. 24, 2004; available in private Pair.
Co-Pending U.S. Appl. No. 11/244,866 entitled, "Water Amusement Park Multiple Path Conveyors" to Henry filed Oct. 6, 2005; available in private Pair.
Co-Pending U.S. Appl. No. 11/244,869 entitled, "Water Amusement Park Conveyor Roller Belts" to Henry filed Oct. 6, 2005; available in private Pair.
Co-Pending U.S. Appl. No. 11/215,357 entitled, "Methods and Systems for Amusement Park Conveyors" to Henry et al. filed Aug. 30, 2005; available in private Pair.
Co-Pending U.S. Appl. No. 11/215,736 entitled, "Water Amusement Park Conveyor Barriers" to Henry et al. filed Aug. 30, 2005; available in private Pair.
Co-Pending U.S. Appl. No. 11/215,747 entitled, "Adjusting Participant Flow Rate in Water Amusement Parks" to Henry et al. filed Aug. 30, 2005; available in private Pair.
Co-Pending U.S. Appl. No. 11/215,795 entitled, "Modular Water Amusement Park Conveyors" to Henry et al. filed Aug. 30, 2005; available in private Pair.
Co-Pending U.S. Appl. No. 11/215,351 entitled, "Water Amusement Park Conveyor Support Elements" to Henry et al. filed Aug. 30, 2005; available in private Pair.
Co-Pending U.S. Appl. No. 11/244,864 entitled, "Water Amusement Park Water Channel Flow System" to Henry et al. filed Oct. 6, 2005; available in private Pair.
Co-Pending U.S. Appl. No. 11/244,872 entitled, "Water Amusement Park Water Channel and Adjustable Flow Controller" to Henry et al. filed Oct. 6, 2005; available in private Pair.
Co-Pending U.S. Appl. No. 11/218,330 entitled, "Methods and Systems for Amusement Park Conveyor Belt Systems" to Henry et al. filed Sep. 1, 2005; available in private Pair.
Co-Pending U.S. Appl. No. 11/283,503 entitled, "Methods and Systems for Water Amusement Park Conveyor" to Henry et al. filed Nov. 18, 2005; available in private Pair.
Co-Pending U.S. Appl. No. 11/407,862 entitled, "Composite Tree" to Henry et al. filed Apr. 20, 2006; available in private Pair.
Co-Pending U.S. Appl. No. 11/407,861 entitled, "Tree With Elevated Structure" to Henry et al. filed Apr. 20, 2006; available in private Pair.
Co-Pending U.S. Appl. No. 11/407,875 entitled, "Water Amusement System With Elevated Structure" to Henry et al. filed Apr. 20, 2006; available in private Pair.
Co-Pending U.S. Appl. No. 11/407,874 entitled, "Thematic Tree System" to Henry et al. filed Apr. 20, 2006; available in private Pair.
Co-Pending U.S. Appl. No. 11/407,886 entitled, "Water Amusement System With Trees" to Henry et al. filed Apr. 20, 2006; available in private Pair.
Co-Pending U.S. Appl. No. 11/407,845 entitled, "Lift Apparatus for Base-Mounted Plant" to Henry et al. filed Apr. 20, 2006; available in private Pair.
Co-Pending U.S. Appl. No. 11/407,885 entitled, "Tree With Covering Apparatus" to Henry et al. filed Apr. 20, 2006; available in private Pair.
Co-Pending U.S. Appl. No. 11/512,709 entitled, "Methods and Systems for Self-Contained Floating Marine Parks" to Henry et al. filed Aug. 30, 2006; available in private Pair.
Co-Pending U.S. Appl. No. 11/513,314 entitled, "Methods and Systems for Active Filtration of Portions of Self-Contained Floating Marine Parks" to Henry et al. filed Aug. 30, 2006; available in private Pair.
Co-Pending U.S. Appl. No. 11/512,708 entitled, "Water Amusement System and Method Including a Self-Contained Floating Marine Park" to Henry et al. filed Aug. 30, 2006; available in private Pair.
Co-Pending U.S. Appl. No. 11/513,315 entitled, "Methods and Systems for Positionable Screen for Self-Contained Floating Marine Parks" to Henry et al. filed Aug. 30, 2006; available in private Pair.
Co-Pending U.S. Appl. No. 11/513,338 entitled, "Methods and Systems for Thermal Control Systems for Self-Contained Floating Marine Parks" to Henry et al. filed Aug. 30, 2006; available in private Pair.
Co-Pending U.S. Appl. No. 11/512,737 entitled, "Methods and Systems for Modular Self-Contained Floating Marine Parks" to Henry et al. filed Aug. 30, 2006; available in private Pair.
Co-Pending U.S. Appl. No. 11/512,713 entitled, "Water Circuit Interactive Games, Exercise, and Gambling" to Henry et al. filed Aug. 30, 2006; available in private Pair.
Co-Pending U.S. Appl. No. 11/512,710 entitled, "Amusement Water Rides Involving Exercise Circuit" to Henry et al. filed Aug. 30, 2006; available in private Pair.
Co-Pending U.S. Appl. No. 11/522,056 entitled, "Amusement Water Rides Involving Games of Chance" to Henry et al. filed Sep. 15, 2006; available in private Pair.
Co-Pending U.S. Appl. No. 11/375,361 entitled, "Method and System of Positionable Covers for Water Amusement Parks" to Henry et al. filed Mar. 14, 2006; available in private Pair.
Co-Pending U.S. Patent Application No. Unknown entitled, "Continuous Water Ride Method and System for Water Amusement Parks" to Henry et al. filed Dec. 8, 2006; available in private Pair.
AA38—Exhibits related to the "Gravity Groove" slide (Sep. 1995).
AA41—Exhibits related to the "Mountain Slidewinder" ride.
AA51—International Search Report and Written Opinion for PCT/US06/15503 mailed Jul. 6, 2007.
AA52—International Search Report and Written Opinion for PCT/US06/34264 mailed Jul. 24, 2007.
AA76 - International Search Report and Written Opinion for PCT/US06/34267 mailed Jul. 7, 2008.
AA77 - International Search Report and Written Opinion for PCT/US06/33955 mailed Apr. 4, 2008.
Co-Pending U.S. Appl. No. 12/338,535 entitled, "Themed Amusement River Ride System" to Henry filed Dec. 18, 2008; available in private PAIR.
Office Action for U.S. Appl. No. 11/244,869 mailed on Nov. 13, 2008, available in PAIR.
Office Action for U.S. Appl. No. 11/513,338 mailed on Dec. 10, 2008, available in PAIR.
Office Action for U.S. Appl. No. 11/215,747 mailed on Oct. 24, 2008, available in PAIR.
Office Action for U.S. Appl. No. 11/244,866 mailed on Mar. 26, 2008, available in PAIR.
Office Action for U.S. Appl. No. 11/215,747 mailed on Mar. 18, 2008, available in PAIR.
Office Action for U.S. Appl. No. 11/215,795 mailed on Mar. 17, 2008, available in PAIR.
Office Action for U.S. Appl. No. 11/218,330 mailed on Mar. 25, 2008, available in PAIR.
Office Action for U.S. Appl. No. 11/283,503 mailed on Mar. 28, 2008, available in PAIR.
Office Action for U.S. Appl. No. 11/244,869 mailed on Apr. 8, 2008, available in PAIR.
AA75 - International Search Report and Written Opinion for PCT/US04/35089 mailed Jul. 31, 2008.
AA74 - Examiner's Report for Australian Patent Application No. 2004285488 mailed Sep. 19, 2008.
Office Action for U.S. Appl. No. 11/244,866 mailed on Sep. 23, 2008, available in PAIR.
Office Action for U.S. Appl. No. 11/407,862 mailed on Aug. 27, 2008, available in PAIR.
Office Action for U.S. Appl. No. 11/407,874 mailed on Sep. 8, 2008, available in PAIR.
Office Action for U.S. Appl. No. 11/407,886 mailed on Sep. 9, 2008, available in PAIR.
Office Action for U.S. Appl. No. 11/407,845 mailed on Oct. 17, 2008, available in PAIR.
Office Action for U.S. Appl. No. 11/407,885 mailed on Sep. 5, 2008, available in PAIR.
Office Action for U.S. Appl. No. 11/513,338 mailed on Jun. 12, 2008, available in PAIR.
Office Action for U.S. Appl. No. 11/215,795 mailed on Oct. 9, 2008, available in PAIR.
Office Action for U.S. Appl. No. 11/218,330 mailed on Sep. 23, 2008, available in PAIR.
Office Action for U.S. Appl. No. 11/283,503 mailed on Sep. 26, 2008, available in PAIR.

* cited by examiner

WATER AMUSEMENT PARK CONVEYORS

BACKGROUND OF THE INVENTION

1. Field of the Invention

The present disclosure generally relates to amusement attractions and rides. More particularly, the disclosure generally relates to a system and method for an amusement ride. Further, the disclosure generally relates to amusement rides featuring systems and methods for conveying participants between different areas of an amusement park in a safe and efficient manner. The amusement ride may include water features and/or elements.

2. Description of the Relevant Art

The 80's decade has witnessed phenomenal growth in the participatory family water recreation facility, i.e., the waterpark, and in water oriented ride attractions in the traditional themed amusement parks. The main current genre of water ride attractions, e.g., waterslides, river rapid rides, and log flumes, and others, require participants to walk or be mechanically lifted to a high point, wherein, gravity enables water, participant(s), and riding vehicle (if appropriate) to slide down a chute or incline to a lower elevation splash pool, whereafter the cycle repeats.

Generally speaking, the traditional downhill water rides are short in duration (normally measured in seconds of ride time) and have limited throughput capacity. The combination of these two factors quickly leads to a situation in which patrons of the parks typically have long queue line waits of up to two or three hours for a ride that, although exciting, lasts only a few seconds. Additional problems like hot and sunny weather, wet patrons, and other difficulties combine to create a very poor overall customer feeling of satisfaction or perceived entertainment value in the waterpark experience. Poor entertainment value in waterparks as well as other amusement parks is rated as the biggest problem of the waterpark industry and is substantially contributing to the failure of many waterparks and threatens the entire industry.

Water parks also suffer intermittent closures due to inclement weather. Depending on the geographic location of a water park, the water park may be open less than half of the year. Water parks may be closed due to uncomfortably low temperatures associated with winter. Water parks may be closed due to inclement weather such as rain, wind storms, and/or any other type of weather conditions which might limit participant enjoyment and/or participant safety. Severely limiting the number of days a water park may be open naturally limits the profitability of that water park.

The phenomenal growth of water parks in the past few decades has witnessed an evolution in water-based attractions. In the '70s and early '80s, these water attractions took the form of slides from which a participant started at an upper pool and slid by way of gravity passage down a serpentine slide upon recycled water to a lower landing pool. U.S. Pat. No. 3,923,301 to Meyers discloses such a slide dug into the side of a hill. U.S. Pat. No. 4,198,043 to Timbes and U.S. Pat. No. 4,196,900 to Becker et al. disclose such slides supported on a structure. Each of these slides only allowed essentially one-dimensional movement from the upper pool, down the slide to the lower pool. Consequently, the path taken down the slide always remained the same thus limiting the sense of novelty and the unexpected for the participant after multiple uses.

Cognizant of this limitation in traditional water slides, new water attractions were developed which inserted a little more of the element of chance during the ride. One such attraction has up to twelve people seated within a circular floating ring being propelled down a flume comprising a series of man-made rapids, water falls and timed water spouts. As the floating ring moves down the path of the water attraction, contact with the sides of the flume cause the ring to rotate thus moving certain people in closer proximity to the "down-river" side of the rapids, the water falls and the spouts. Those people who were closest to such features of the water ride tended to get the most wet. Since such movement was determined mostly by chance, each participant had an equal chance of getting drenched throughout the ride by any one of the many water ride features.

This later type of ride, though an improvement over the traditional water slide, was still essentially a one-dimensional travel from an upper start area down to a lower start area where all features came into play. Furthermore, each of these features were either continuously active (such as the water fall) or automatically activated by the proximity of the floating ring to the feature.

The popularity of these types of rides has resulted in very long lines at such water parks. Observers, such as those waiting in line for the water ride, could not interact (except verbally) with those participants on the ride. Consequently, the lasting memory at such parks may not be about the rides at the park, but the long lines and waiting required to use the rides.

Traditional floatation devices used in amusement/water parks include such vehicles as inner tubes, floating boards, and/or other floatation devices upon which one or more riders may float. Unfortunately the traditional floatation devices do not translate well to rides or portions of rides, which do not incorporate water as a means for propelling a vehicle and/or at least decreasing the coefficient of friction between the vehicle and the track. It would be advantageous to incorporate a vehicle into amusement rides which moved equally as well along tracks/courses incorporating water as well as tracks/courses which do not incorporate water. This might reduce costs associated with using water in amusement park rides as well as add additional dimensions to the enjoyment of the ride.

Vehicles typically used for amusements rides and especially water-based amusement rides are typically mere modes of transportation. The track (e.g., channel) typically provides the preponderance of enjoyment or amusement associated with a ride. The shape and/or design of the vehicle itself do not typically add any aspect of enjoyment to the ride. Vehicles which allowed, and even encouraged, participants within the vehicle to interact with the amusement ride environment would add another dimension to amusement rides in general and water amusement ride specifically.

SUMMARY

For the reasons stated above and more, it is desirable to create a natural and exciting amusement ride system to transport participants between rides as well as between parks that will interconnect many of the presently diverse and stand-alone water park rides. An amusement ride system and method are described. In some embodiments, an amusement ride system may be generally related to water amusement attractions and rides. Further, the disclosure generally relates to water-powered rides and to a system and method in which participants may be more involved in a water attraction.

In some embodiments, an amusement ride system may include a rollable carrier. The rollable carrier may include an exterior rollable surface and an inner area. The inner area may include a participant container. In some embodiments, an amusement ride system may include a path system. The path system may function to substantially contain the rollable carrier such that the rollable carrier will remain in the path system while rolling. In some embodiments, a rollable carrier may function to roll in a path system while containing a participant in the participant container.

In some embodiments, a rollable carrier may be inflatable. The rollable carrier may include an inflatable area positioned between a participant container and an exterior rollable surface. The inflatable area may at least partially protect a participant. The rollable carrier may be freely rollable. The rollable carrier may allow water from a water path system to contact a participant. The rollable carrier may roll over while in a water path system, thereby causing the participant container to also roll over. The rollable carrier may be substantially transparent.

The rollable carrier may include at least one restraint positioned in the participant container and coupled to the rollable carrier. The restraint may inhibit movement of the participant relative to the participant container. Generally restraints are used herein to describe any system or mechanism which inhibits movement of one body relative to another body.

The rollable carrier may include an opening allowing the participant to access the inside of the participant container. The rollable carrier may include a positionable stop configured to close the opening. The rollable carrier may be formed at least in part from a flexible material.

In some embodiments, a path system may include a first elevation and a second elevation, wherein the first elevation and the second elevation are different. The path system may include a continuous loop. At least one portion of the path system may include a loop that allows the rollable carrier to traverse a full vertical circle. The path system may include a waterfall configured to allow the rollable carrier to drop from a first higher elevation to a second lower elevation. The difference between the elevations may be between about 2 ft. to about 12 ft.

In some embodiments, a portion of a path system may include special effects. The special effects may include visual effects (e.g., lighting displays). Path systems may include a conduit through which a rollable carrier may be conveyed. A portion of the conduit may be enclosed and pressurized fluids may assist conveying the rollable carrier the enclosed conduit. The path system may inhibit the rollable carrier from exiting a portion of the path system.

An amusement ride system may include an elevation system to convey a rollable carrier from a first elevation to a second elevation. The elevation system may include, for example, a fluid jet, a conveyor belt system, an uphill water slide, a wind tunnel or a vertical jet to elevate the rollable carrier to a predetermined height. A horizontal fluid jet may be coupled to a vertical jet to move the rollable carrier off of the vertical jet. Wind tunnels and fluid jets may fall under a broad category of elevation systems referred to as fluid assisted elevation systems. Wind tunnels may use reduced air pressure within a conduit to pull a rollable carrier through the conduit. Wind tunnels may use increased air pressure within a conduit to push a rollable carrier through the conduit.

In some embodiments, an amusement ride system may include a floating queue line. The floating queue line may be coupled to a portion of a path system. The floating queue line may include a channel. The channel may hold water at a depth sufficient to allow a rollable carrier and/or a participant to float within the channel. The floating queue line may be coupled to a water ride such that a participant remains in the water while being transferred from the channel along the floating queue line to the water ride.

A portion of a water path system may include a substantially horizontal channel segment including a first portion and a second portion. The portion may include a water inlet positioned at the first portion and a water outlet positioned at the second portion. Water may be transferred into the channel at the first portion and transferred out of the channel at the second portion in sufficient quantities to create a hydraulic gradient between the first portion and the second portion.

A portion of a path system may include a substantially angled channel segment including a high elevation end and a low elevation end. The angled channel segment may function such that a participant moves in a direction from the upper elevation end toward the lower elevation end. The path system may include a water inlet at the high elevation end. A predetermined amount of water may be transferred into the angled channel segment at the high elevation end such that friction between a rollable carrier and the angled channel segment is reduced. A flowing body of water may have a depth sufficient to allow a participant and/or a rollable carrier to float within the channel during use In some embodiments, a path system may include a plurality of fluid jets spaced apart. The fluid jets may be positioned along the path system at predetermined locations. The fluid jets may be oriented tangentially with respect to the path system surface so as to contact a participant and/or rollable carrier as a participant and/or rollable carrier passes by each of the locations. Each of the fluid jets may produce a fluid stream having a predetermined velocity that is selectively greater, less than, or the same as the velocity of the participant and/or rollable carrier at each of the fluid jet locations.

A portion of a path system may be coupled to a walkway. A segment of the portion of the path system is at substantially the same height as a portion of the walkway such that a participant walks from the walkway into the water within the path system.

A portion of a path system may be coupled to a stairway. The stairway may function such that a participant walks along the stairway into the water within the path system.

A path system may include a docking station coupled to at least a portion of the path system. The docking station may receive and inhibit movement of rollable carriers to allow participants to exit or enter the rollable carriers.

An amusement ride system may include at least one overflow pool coupled to a path system. The overflow pool may collect water overflowing from the path system.

In some embodiments, an amusement ride may form a portion of a transportation system. The transportation system would itself be a main attraction with water and situational effects while incorporating into itself other specialized or traditional water rides and events. The system, though referred to herein as a transportation system, would be an entertaining and enjoyable part of the waterpark experience.

In certain embodiments, an amusement ride system may include a continuous water ride. Amusement ride systems may include a system of individual water rides connected together. The system may include two or more water rides connected together. Water rides may include downhill water slides, uphill water slides, single tube slides, multiple participant tube slides, space bowls, sidewinders, interactive water slides, water rides with falling water, themed water slides, dark water rides, and accelerator sections in water slides. Connecting water rides may reduce long queue lines normally associated with individual water rides. Connecting water rides may allow participants to remain in the water and/or a vehicle (e.g., a floatation device) during transportation from a first portion of the continuous water ride to a second portion of the continuous water ride.

In some embodiments, an amusement ride system may include an elevation system to transport a participant and/or rollable carrier from a first elevation to a second elevation. The first elevation may be at a different elevational level than a second elevation. The first elevation may include an exit point of a first water amusement ride. The second elevation may include an entry point of a second water amusement ride. In some embodiments, a first and second elevation may include an exit and entry points of a single water amusement ride. Elevation systems may include any number of water and non-water based systems capable of safely increasing the elevation of a participant and/or vehicle. Elevation systems may include, but are not limited to, spiral transports, water wheels, ferris locks, conveyor belt systems, water lock systems, uphill water slides, and/or tube transports.

In some embodiments, an elevation system may include a system based on an Archimedes screw. However, while the Archimedes screw lifts fluids trapped within cavities formed by its inclined blades, the screw conveyor propels dry bulk materials (powders, pellets, flakes, crystals, granules, grains, etc.) through the pushing action of its rotating blades. A screw conveyor system may be used to convey one or more rollable carriers from a first elevation to a second elevation.

In some embodiments, a water amusement ride may include an angled field area. The angled field area may include a high elevation end and a low elevation end. A water amusement ride may include at least one rollable carrier comprising an exterior rollable surface and an inner area. The inner area may include a participant container. The angled field area may be configured to substantially contain the rollable carrier such that the rollable carrier will remain in the angled field area while rolling. The rollable carrier may function to roll in the angled field area from the high elevation end of the angled field area to the low elevation end of the field area while containing a participant in the participant container.

In some embodiments, a water amusement ride may include a plurality of amusement elements associated with the angled field area. The amusement elements may function to affect the movement of the rollable carrier. A water amusement ride may include an elevation system which functions to convey at least one of the rollable carriers from the low elevation end of the angled field to the high elevation end of the angled field.

In some embodiments, an amusement ride conveyor may include a path system. A portion of the path system may include a conduit. A pressure adjustment mechanism coupled to the conduit may function to adjust the pressure in at least a portion of the conduit. The pressure adjustment mechanism may adjust the pressure such that at least one rollable carrier is conveyed through at least a portion of the conduit in response to the change in pressure. The rollable carrier may include an exterior rollable surface and an inner area. The inner area may include a participant container which functions to contain a participant.

In some embodiments, an amusement ride conveyor may include an elevation system. The elevation system may function to elevate at least one participant from a lower first elevation to a higher second elevation. The elevation system may include a vertical fluid jet which functions to elevate the participant to the higher second elevation. The elevation system may include a horizontal fluid jet which functions to move the participant off of the vertical fluid jet when the participant has reached the higher second elevation. An amusement ride conveyor may include a water path system coupled to the elevation system. The water path system may function to receive the participant from the elevation system. The water path system may function such that water flows in the water path system.

In some embodiments, a system for conveying a participant from a first source of water to a second source of water may include a belt; wherein the belt is coupled to the first source of water and to the second source of water. The system may include a belt movement system which functions to move the belt in a loop during use. The system may include one or more fluid jets functioning to produce a fluid stream having a predetermined velocity which is selectively greater, less than, or the same as a velocity of a participant at each of the fluid jet locations. At least some of the fluid jets may be positioned along a portion of the first source of water and/or a portion of the second source of water substantially adjacent to a portion of the belt. The fluid jets may be oriented tangentially with respect to the surface of the source of water so as to contact a participant and/or participant vehicle as a participant and/or participant vehicle passes by each of the locations.

In some embodiments, a system for controlling a participant flow rate through a multi path water amusement ride system may include a first belt; wherein the first belt is coupled to a first source of water and to a second source of water. The system may include a second belt; wherein the second belt is coupled to the first source of water and to a third source of water. A first portion of the first and second belts may be positioned substantially adjacent to each other. The system may include a first belt movement system, which functions to move at least the first belt in a loop. The system may include a second belt movement system, which functions to move at least the second belt in a loop. The system may include at least one gate mechanism positioned substantially adjacent the first portions of the first and second belts. At least one of the gate mechanisms may function upon activation, to inhibit a participant from entering the first or second belt.

In some embodiments, a system for facilitating entry of a participant on a floatation device may include a belt; wherein the belt is coupled to a first source of water and to a second source of water. The system may include a belt movement system which functions to move the belt in a loop. The first source of water and/or the second source of water may include a portion substantially adjacent the belt, wherein the portion of the first and/or second source of water comprises a depth of water which allows a participant to more easily enter a floatation device.

Depending on a water amusement parks geographic location, the waterpark may only be open for less than half of the year due to inclement weather (e.g., cold weather, rain, etc.). What is needed is a way to enclose portions or substantially all of the waterpark when weather threatens to shut down the park. However, it would be beneficial to have some type of enclosure that may be at least partially removed or retracted to open up at least a portion of the waterpark to the environment during good weather.

Positionable screens may be used to substantially enclose a portion of a waterpark during inclement weather. A multitude of positionable screens may be retractable/extendable within one another. The screens may also serve other functions in addition to protecting participants from uncomfortable weather conditions. The screens may be used to trap and recirculate heat lost from, for example, the water enclosed within the screens. The positioning of the screens may be automated, manual, or a combination of both. The screens may be formed from materials that allow most of the visible light spectrum through while inhibiting transmission of potentially harmful radiation.

Other components which may be incorporated into the system are disclosed in the following U.S. Patents, herein incorporated by reference: an appliance for practicing aquatic sports as disclosed in U.S. Pat. No. 4,564,190; a tunnel-wave generator as disclosed in U.S. Pat. No. 4,792,260; a low rise water ride as disclosed in U.S. Pat. No. 4,805,896; a water sports apparatus as disclosed in U.S. Pat. No. 4,905,987; a surfing-wave generator as disclosed in U.S. Pat. No. 4,954,014; a waterslide with uphill run and floatation device therefore as disclosed in U.S. Pat. No. 5,011,134; a coupleable floatation apparatus forming lines and arrays as disclosed in U.S. Pat. No. 5,020,465; a surfing-wave generator as disclosed in U.S. Pat. No. 5,171,101; a method and apparatus for improved water rides by water injection and flume design as disclosed in U.S. Pat. No. 5,213,547; an endoskeletal or exoskeletal participatory water play structure whereupon participants can manipulate valves to cause controllable changes in water effects that issue from various water forming devices as disclosed in U.S. Pat. No. 5,194,048; a waterslide with uphill run and floatation device therefore as disclosed in U.S. Pat. No. 5,230,662; a method and apparatus for improving sheet flow water rides as disclosed in U.S. Pat. No. 5,236,280; a method and apparatus for a sheet flow water ride in a single container as disclosed in U.S. Pat. No. 5,271,692; a method and apparatus for improving sheet flow water rides as disclosed in U.S. Pat. No. 5,393,170; a method and apparatus for containerless sheet flow water rides as disclosed in U.S. Pat. No. 5,401,117; an action river water attraction as disclosed in U.S. Pat. No. 5,421,782; a controllable waterslide weir as disclosed in U.S. Pat. No. 5,453,054; a non-slip, non-abrasive coated surface as disclosed in U.S. Pat. No. 5,494,729; a method and apparatus for injected water corridor attractions as disclosed in U.S. Pat. No. 5,503,597; a method and apparatus for improving sheet flow water rides as disclosed in U.S. Pat. No. 5,564,859; a method and apparatus for containerless sheet flow water rides as disclosed in U.S. Pat. No. 5,628,584; a boat activated wave generator as disclosed in U.S. Pat. No. 5,664,910; a jet river rapids water attraction as disclosed in U.S. Pat. No. 5,667,445; a method and apparatus for a sheet flow water ride in a single container as disclosed in U.S. Pat. No. 5,738,590; a wave river water attraction as disclosed in U.S. Pat. No. 5,766,082; a water amusement ride as disclosed in U.S. Pat. No. 5,433,671; and, a waterslide with uphill runs and progressive gravity feed as disclosed in U.S. Pat. No. 5,779,553. The system is not, however, limited to only these components.

All of the above devices may be equipped with controller mechanisms to be operated remotely and/or automatically. For large water transportation systems measuring miles in length, a programmable logic control system may be used to allow park owners to operate the system effectively and cope with changing conditions in the system. During normal operating conditions, the control system may coordinate various elements of the system to control water flow. A pump shutdown will have ramifications both for water handling and guest handling throughout the system and will require automated control systems to manage efficiently. The control system may have remote sensors to report problems and diagnostic programs designed to identify problems and signal various pumps, gates, or other devices to deal with the problem as needed.

BRIEF DESCRIPTION OF THE DRAWINGS

Advantages of the present invention may become apparent to those skilled in the art with the benefit of the following detailed description of the preferred embodiments and upon reference to the accompanying drawings in which.

Figure 1:
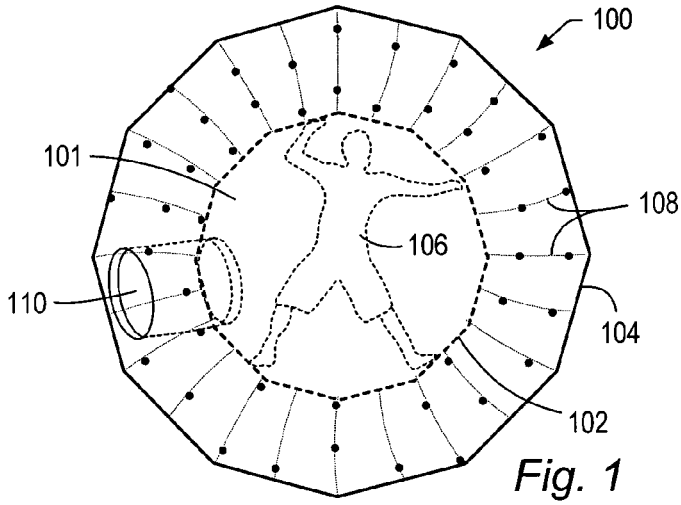
FIG. 1 depicts an embodiment of an amusement park ride vehicle.

While the invention is susceptible to various modifications and alternative forms, specific embodiments thereof are shown by way of example in the drawing and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION

Typically today's amusement ride vehicles found in amusement parks (e.g., water parks) are passive and merely follow a predetermined path (e.g., a track, channel, and/or directed flow of water). Most vehicles only require a participant to sit in a prone position and be carried along a predetermined route. Typically movements of a vehicle (and any participants associated with the vehicle) are determined solely by the course and layout of the predetermined route.

Most amusement ride vehicles are designed to either function in a wet or dry environment and not both. The few amusement rides incorporating vehicles which function in a wet and dry environment are based on vehicles which move along tracks and in which water is merely an effect of the ride and not part of any type of propulsion means.

An alternate type of amusement ride vehicle was developed to address the problems and issues stated above associated with amusement rides and vehicles in particular. In some embodiments, a vehicle may include a rollable carrier. Within the context of the embodiments described herein, a rollable carrier may be generally defined as having a substantially rounded shape and is not limited by any means to a spherical shape, and furthermore rollable merely implies at least that the object so described is capable of rolling along a surface.

FIG. 1 depicts an embodiment of amusement park ride rollable carrier 100. Rollable carrier 100 may include inner area 101 and exterior rollable surface 104. Inner area 101 may include participant container 102. Participant container 102 may function to temporarily enclose or carry one or more participants 106. Participant container 102 may be coupled to exterior rollable surface 104. Participant container 102 may be coupled to exterior rollable surface 104 using elongated members 108. FIG. 1 merely depicts a representative number of elongated members 108, there may be anywhere from tens to thousands of such elongated members coupling participant container 102 to exterior rollable surface 104. Rollable carrier 100 may include an opening 110 coupling space outside of the rollable carrier and exterior rollable surface 104 to the inside of participant container 102. Opening 110 may allow one or more participants 106 to enter and exit rollable carrier 100.

A rollable carrier may function to carry one or more participants inside of the confines of the rollable carrier. A rollable carrier may be designed so that it may float in water with or without participants inside. Such a design would allow a rollable carrier to traverse dry or wet based amusement rides. The rollable carrier may be able to float along a water channel and/or roll along a dry path system.

In some embodiments, a path system may include, for example, conduits, channels, portions of natural rivers, portions of natural bodies of water, rails, and/or tracks. Path systems may include paths that split into two or more paths. Paths, which have split, may subsequently rejoin at a later point in the path system.

In some embodiments, a "dry" path system may include any path system through which a rollable carrier does not float, but may include path systems upon which water flows (e.g., for effect and/or for reducing friction).

In some embodiments, a rollable carrier may not float. It may not be necessary for the rollable carrier to float if water is not incorporated as part of the ride or if water is not present in any portion of the ride to a depth requiring the rollable carrier to float.

In some embodiments, a rollable carrier may include a participant container encased in an exterior rollable surface. The participant container and/or exterior rollable surface may be substantially hollow. The participant container may be coupled to the exterior rollable surface. The participant container may be coupled to the exterior rollable surface such that the participant container is inhibited from contacting the exterior rollable surface. The participant container may be designed to temporarily contain one or more participants.

The participant container may be coupled to the exterior rollable surface using elongated members. A first end of the elongated member may be coupled to the participant container and a second end of the elongated member may be coupled to the exterior rollable surface. Multiple elongated members may be used to couple the participant container to the exterior rollable surface. In some embodiments, elongated members may be substantially equally distributed about the outer surface of the participant container and the interior surface of the exterior rollable surface. Equally distributing elongated members about the surface of the two spheres may inhibit the participant container from contacting the exterior rollable surface (e.g., even when an unrestrained participant enclosed within the participant container is being thrown around while the rollable carrier is moving). The elongated members may be composed of a flexible material (e.g., cords).

In some embodiments, a rollable carrier may be inflatable. A rollable carrier may include a participant container encased in an exterior rollable surface. The participant container may be coupled to the exterior rollable surface such that the participant container is inhibited from contacting the exterior rollable surface. Portions of the rollable carrier may be at least partially formed from pliable materials. At least a portion of the area between the participant container and the exterior rollable surface may form a sealed compartment. The sealed compartment may include a resealable opening. The sealed compartment may be inflated with a fluid. Fluids may include liquids (e.g., water) and/or gases (e.g., air). Inflating the sealed compartment with fluids may provide shape to a rollable carrier composed primarily of pliable materials (e.g., PVC). An inflated sealed compartment may provide a means of cushioning a participant enclosed in the participant container. The inflated sealed compartment may inhibit an enclosed participant from injury. The inflated sealed compartment may provide buoyancy to the rollable carrier. The inflated sealed compartment may allow the rollable carrier and any participants enclosed therein to float substantially above the surface of a body of water.

In some embodiments, a rollable carrier may be formed from a material which is substantially transparent. In an embodiment, at least a portion of a rollable carrier may be formed from a material which is substantially transparent. Transparency of a rollable carrier may allow a participant enclosed within the rollable carrier to see outside of the rollable carrier, potentially improving the enjoyment of the participant's use of the rollable carrier/amusement ride.

In some embodiments, a rollable carrier may include an opening allowing participants to more easily access the interior of the rollable carrier (e.g., the exterior rollable surface). The opening may be a fixed size. The opening may allow an average sized adult to easily enter and exit the rollable carrier. Openings may be adjustable. For example an opening may be adjusted so it is smaller so that a child may enter easily but not prematurely exit accidentally during an amusement ride.

The rollable carrier may include some means for temporarily closing the opening during the amusement ride. The closing mechanism may include a flexible netting which allows air to easily flow through the rollable carrier. The closing mechanism may include a mechanism which is substantially water tight so that any water injected into the rollable carrier with participants will remain in the rollable carrier during the ride.

In some embodiment, a rollable carrier may include more than one opening. More than one opening in the rollable carrier may facilitate airflow through the rollable carrier. Facilitating airflow through a rollable carrier may be advantageous for several reasons. Advantages of increasing airflow in a rollable carrier may include increasing the comfort and/or safety of participant(s) within the rollable carrier. Increasing airflow may assist in cooling down the interior of the participant container, heated from solar energy and/or participants contained therein. Increasing airflow may reduce build up of gases (e.g., $CO_2$) to potentially dangerous levels.

Rollable carriers which include multiple openings may include openings of various sizes. One or more openings may be appropriately sized to allow participants to enter/exit the rollable carrier. One or more openings may be relatively small and may primarily function to increase airflow through the rollable carrier. Rollable carriers may include multiple openings while still be capable of floating with one or more participants inside the participant container.

Examples of rollable carriers which may be adapted for the herein described purposes are illustrated in New Zealand Patent No. 270146 to Akers et al. which is incorporated by reference as if fully set forth herein.

Figure 2:
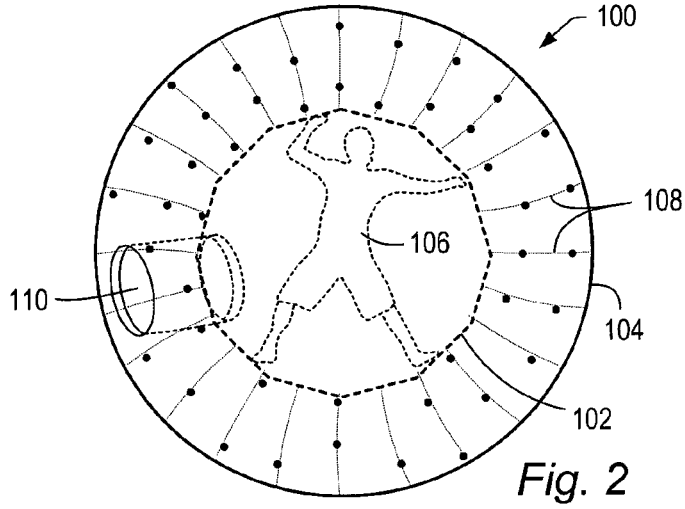
FIG. 2 depicts an embodiment of an amusement park ride vehicle.

FIG. 2 depicts an embodiment of amusement park ride rollable carrier 100. In the depicted embodiment, rollable carrier 100 is depicted with an exterior rollable surface 104 formed from a more rigid material. Participant container 102 may be formed from a more flexible material. Forming participant container 102 from a more flexible material may inhibit participant 106 from being injured during the amusement ride. Elongated members 108 may be formed from a more flexible and/or elastic material in an effort to absorb impacts produced from participant 106 thrown against the interior surface of participant container 102 and inhibit injury of the participant. In some embodiments, participant container 102 may also be formed of more rigid materials. Rollable carrier 100 may include an opening 110 facilitating entry/exit of participant 106 into the rollable carrier.

Figure 3:
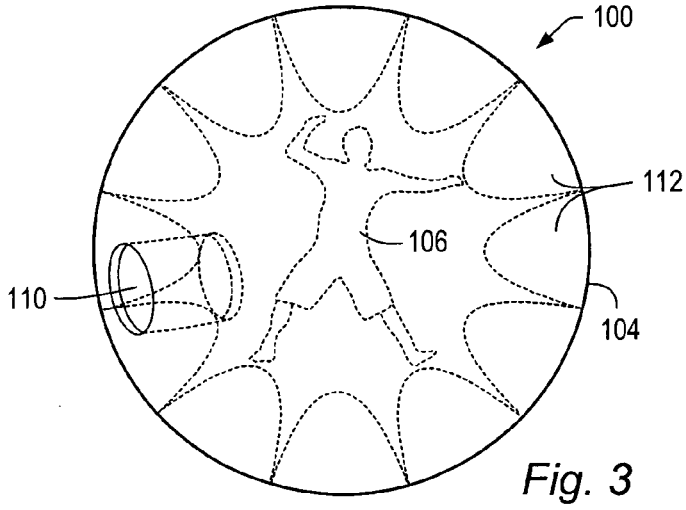
FIG. 3 depicts an embodiment of an amusement park ride vehicle.

FIG. 3 depicts an embodiment of amusement park ride rollable carrier 100. Rollable carrier 100 may include exterior rollable surface 104. Exterior rollable surface 104 may be formed from a more rigid material that does not require inflation. Instead of forming a participant container suspended within exterior rollable surface 104 to carry participant 106, a plurality of individually inflated flexible containers 112 may be coupled to the interior surface of exterior rollable surface 104. Flexible containers 112 may act to inhibit participant 106 from being injured during the course of an amusement ride.

Figure 4A:
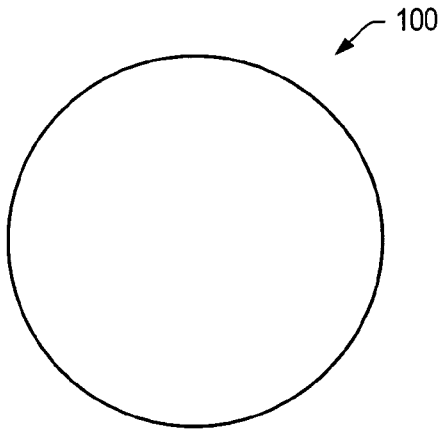
FIG. 4A-FIG. 4D depicts embodiments of an amusement park ride vehicles.
Figure 4B:
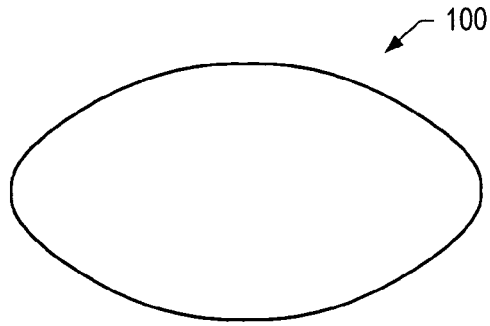
Figure 4C:
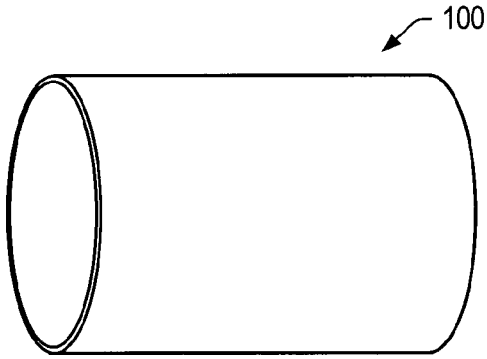
Figure 4D:
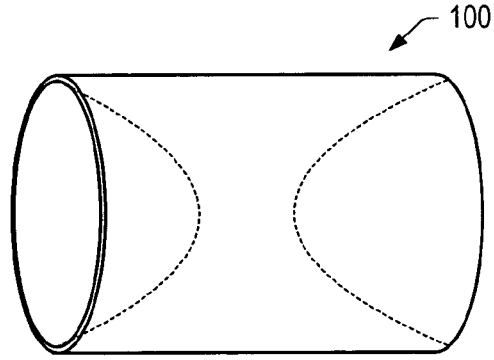

FIG. 4A-FIG. 4D depict embodiments of amusement park ride rollable carriers 100. In some embodiments, a rollable carrier may include a spherical shape as depicted in FIG. 4A. Within the context of the embodiments described herein, spherical may be generally defined as having a substantially sphere like shape and is not limited by any means to a perfectly spherical shape, and furthermore spherical merely implies at least that the object so described is capable of rolling along a surface. However, FIG. 4A should not be seen as a limiting example, and FIG. 4B-FIG. 4D should be seen as other exemplary embodiments falling within the scope of the definition of spherical as presented herein. All of the examples depicted in FIG. 4A-FIG. 4D have at least one thing in common in that they all possess an exterior rollable surface with the ability to roll along a surface. Some of the shapes depicted may facilitate movement along only one axis while some of the shapes depicted may allow movement along more than one axis.

Figure 5:
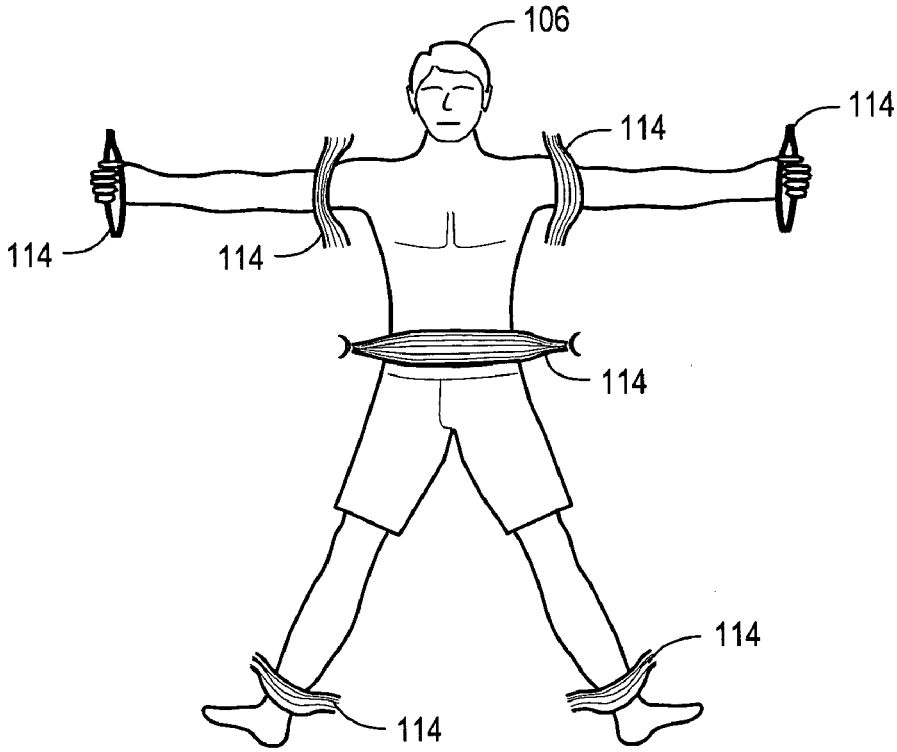
FIG. 5 depicts an embodiment of a portion of an interior of amusement park ride vehicle.

In some embodiments, a rollable carrier may comprise one or more restraints. FIG. 5 depicts an embodiment of a portion of an amusement park ride rollable carrier. Specifically, the portion(s) of interest depicted in FIG. 5 include restraints 114. Restraints 114 may function to inhibit movement of participant 106 within a rollable carrier during an amusement ride. Inhibiting movement of a participant may assist in preventing injuries to the participant. Another advantage of inhibiting movement of a participant in a rollable carrier is dependent on the experience the participant is seeking, inhibition of movement may increase the enjoyment of the participant. Inhibiting movement of a participant during an amusement ride may enhance a participants experience by allowing the participant to experience the end-over-end rolling motion of the rollable carrier as it moves through the amusement ride.

FIG. 5 depicts a number of restraints 114. Restraints 114 depicted in FIG. 5 are merely depicted as an example. One skilled in the art might assuredly devise new restraints and/or adapt existing technologies to be used to restrain a participant. All of the restraints used in FIG. 5 may be used or only a few in combination with one another. Restraints may be "passive" (i.e., once activated do not require the participant to do anything for the restraint to work) or "active" (i.e., may require the participant to actively use the restraint for the restraint to work (e.g., a hand hold)). In some embodiments, restraints may be formed from a substantially flexible material such that a participant will not be harmed by running in to them, especially if the participant decides not to use them.

In some embodiments, a rollable carrier may include more than one set of restraints. Multiple sets of restraints may be employed for when more than one participant rides within the rollable carrier. When more than one participant uses the rollable carrier during an amusement ride it may be prudent for safety reasons for all of the participants within the rollable carrier to wear restraints. When multiple participants use the same rollable carrier at once restraining their movement may help to avoid the participants bumping into each other and injuring themselves.

Figure 6:
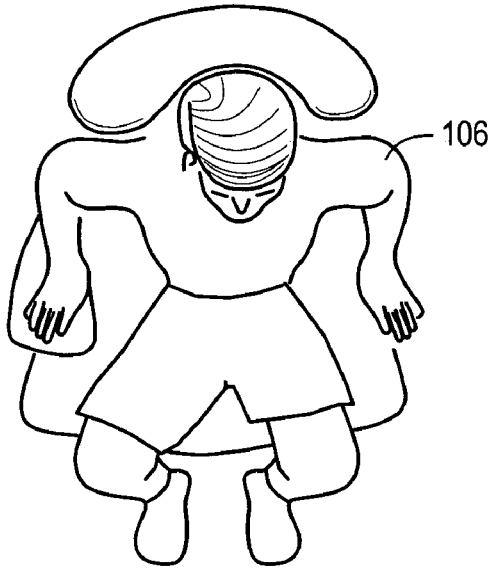
FIG. 6 depicts an embodiment of a portion of an interior of amusement park ride vehicle.

FIG. 6 depicts an embodiment of a portion of an amusement park ride rollable carrier. FIG. 6 depicts a top perspective view of participant 106 seated in a chair incorporated into a rollable carrier. The chair may include restraints as described herein to inhibit a participant from moving around. The chair may be formed as part of a participant container enclosed in an exterior rollable surface of the rollable carrier. The chair may be inflated in some embodiments. The chair may be connected to the space separating the two spheres such that when the rollable carrier is inflated (in such embodiments where the rollable carrier is an inflatable rollable carrier) the chair is inflated as well. In some embodiments, the chair may not be inflatable; the chair however may be formed from flexible/pliable materials. A chair formed from flexible/pliable materials may increase the comfort and/or enjoyment of a participant. A chair formed from flexible/pliable materials may increase the safety of a participant by, for example, providing one less inflexible object for the participant to collide with and harm himself/herself.

In some embodiments, a rollable carrier may not float. It may not be necessary for the rollable carrier to float if water is not incorporated as part of the ride, or if water is not present in any portion of the ride to a depth requiring the rollable carrier to float. An example of such an embodiment may include a rollable carrier. The rollable carrier may be formed from a rigid or semi-rigid cage like material. The rollable carrier may be formed from a substantially transparent material. In some embodiments, the rollable carrier may be formed from a material which is substantially not transparent; however, a participant riding within the rollable carrier may still have good visibility of his surrounding outside of the rollable carrier due to the openings in the cage like material. The rollable carrier may include some type of padding surrounding the material forming the cage to protect the participant. The inside of the cage may include padding material (e.g., at least for the safety of the participant). The outside of the cage may include padding material (e.g., at least for the safety of the participant, at least in as much as to protect the participants extremities from becoming pinched or injured or from being run over by the rollable carrier during use).

A rollable carrier including perforations (e.g., as in a cage structure) may allow water to enter the rollable carrier. Water may be present during at least a portion of an amusement ride, but only used in minimal amounts when the rollable carrier used for the ride is not sufficiently buoyant. However, minimal amounts of water used in such a situation may be helpful. Water used in minimal amounts may add to the enjoyment of the amusement ride for the participant. A perforated rollable carrier may allow water to enter the rollable carrier adding to the enjoyment and fun of the amusement ride. Minimal amounts of water may reduce friction along the surface of the amusement ride.

In some embodiments, an amusement ride may include a rollable carrier. The rollable carrier may include a participant container and an exterior rollable surface. The participant container may be positioned in the rollable carrier. The participant container may move independently of the exterior rollable surface. For example when the exterior rollable surface is rolling/revolving as the rollable carrier moves along a path system of an amusement ride the participant container may not revolve with the exterior rollable surface.

Examples of rollable carriers which may be adapted for the herein described purposes are illustrated in U.S. Pat. No. 4,501,434 to Dupois; U.S. Pat. No. 5,791,254 to Mares et al.; U.S. Pat. No. 3,066,951 to Gray; and U.S. Pat. No. 4,545,574 to Sassak all of which are incorporated by reference as if fully set forth herein.

Rollable carriers described herein may be used in amusement rides. The amusement ride may include so called "water" amusement rides. Water amusement rides typically include water as an effect at least in some portion of the amusement ride. The amusement ride may include multiple different elevation points coupled to one another with some type of path system. A path system may include, for example, a conduit or channel. Channels typically include a water element and may include water deep enough for a buoyant rollable carrier to float along the channel. The channel may include sides that are high enough to inhibit water within the channels from inadvertently spilling over the sides. The channel may include sides that are high enough to inhibit a rollable carrier from exiting over the sides prematurely and/or in an uncontrolled manner.

In some embodiments, a path system may include a conduit (e.g., a tube). The conduit may not include water or any type of water element. The conduit as the term implies is a fully enclosed path system which may inhibit a rollable carrier from exiting over the sides prematurely and/or in an uncontrolled manner. "Fully enclosed" is not necessarily limited to a seamless and/or continuous sheet forming the conduit. The conduit may be formed out of a rigid material in a cage or net like formation. A perforated conduit may allow participants in rollable carriers greater visibility and/or enjoyment during an amusement ride. The conduit may be formed from substantially transparent materials. In some embodiments, portions of the conduit may be formed from substantially transparent materials. Forming portions of a conduit from transparent materials may allow a participant greater visibility (and consequently greater enjoyment) during an amusement ride.

In some embodiments, substantially parallel bars coupled together may form a conduit. In some embodiments, mixtures of different materials and methods for forming conduits may be employed.

Figure 7:
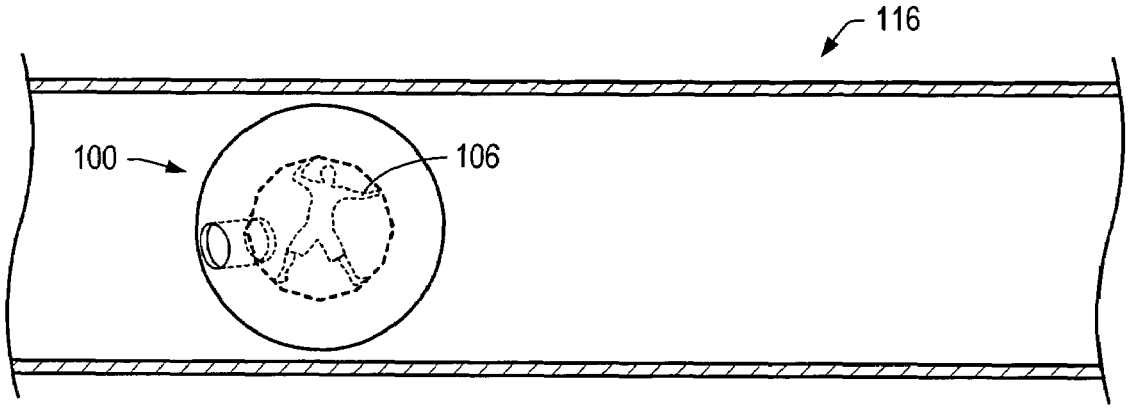
FIG. 7 depicts an embodiment of a portion of a conduit of an amusement park ride.

FIG. 7 depicts an embodiment of a portion of a path system of an amusement park ride. The embodiment of path system 116 (e.g., a conduit) depicted in FIG. 7 is formed from a substantially transparent material. If participant 106 is positioned in a transparent rollable carrier 100, then the participant may experience an additional aspect of the amusement ride.

Figure 8:
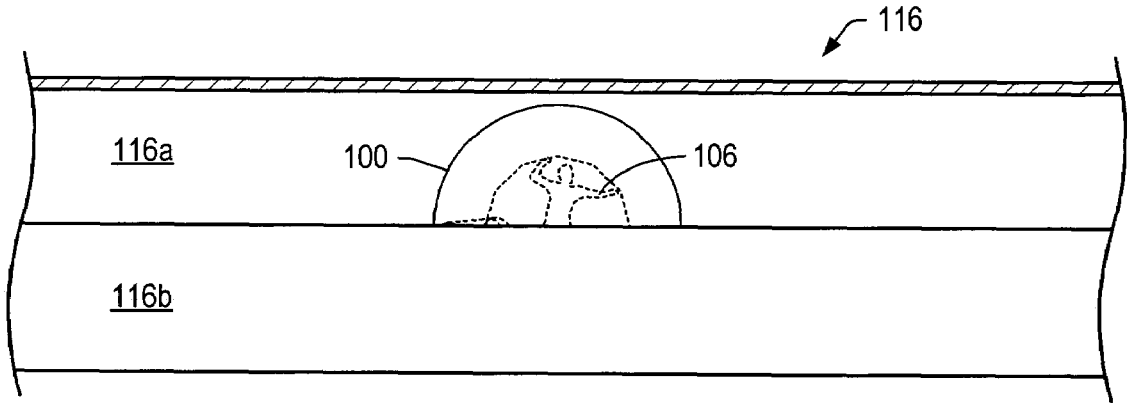
FIG. 8 depicts an embodiment of a portion of a conduit of an amusement park ride.
Figure 9:
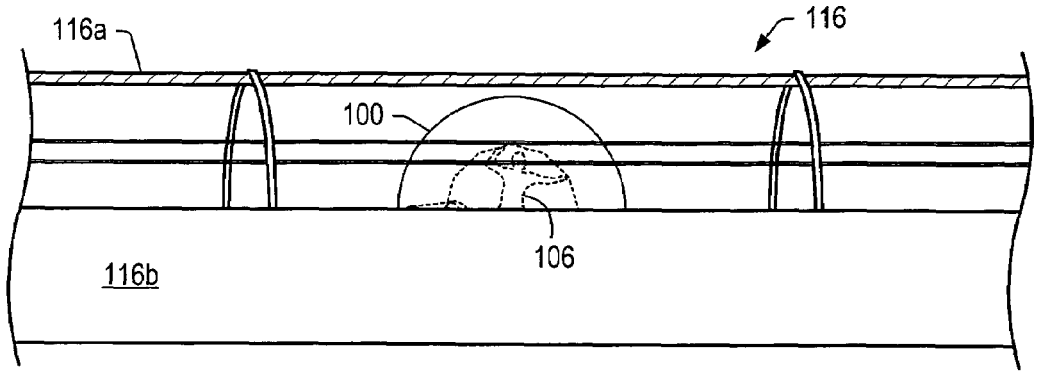
FIG. 9 depicts an embodiment of a portion of a conduit of an amusement park ride.
Figure 10:
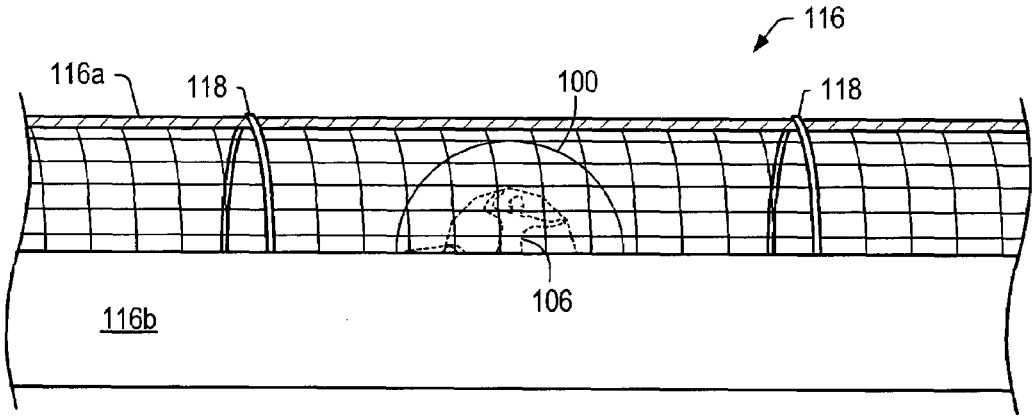
FIG. 10 depicts an embodiment of a portion of a conduit of an amusement park ride.
Figure 11:
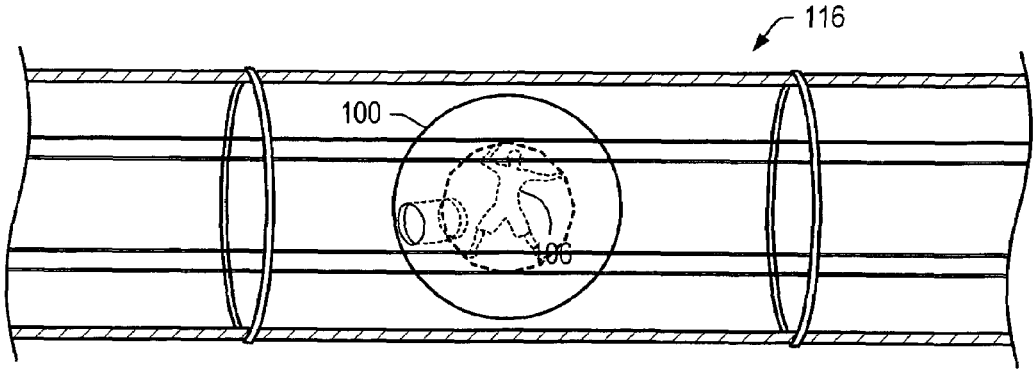
FIG. 11 depicts an embodiment of a portion of a conduit of an amusement park ride.

FIG. 8 depicts an embodiment of a portion of a path system of an amusement park ride. The embodiment of path system 116 (e.g., a conduit) depicted in FIG. 8 is formed from at least two materials of different transparencies. The upper portion 116*a* of path system 116 may be formed from a substantially transparent material. The lower portion 116*b* of path system 116 may be formed of a substantially opaque material. Advantages of such a path system may include reducing construction costs. For example various opaque construction materials may be less expensive than comparable translucent materials. The translucent portion of the path system may be less expensive to produce in part due to the fact that it is not necessary to produce the top portion to the same weight bearing capacities of the lower portion of the path system. If participant 106 is positioned in a transparent rollable carrier 100, then the participant may experience an additional aspect of the amusement ride FIG. 9 depicts an embodiment of a portion of a path system of an amusement park ride. The embodiment of path system 116 (e.g., a conduit) depicted in FIG. 9 is formed from at least two materials. The upper portion 116*a* of path system 116 may be formed from a network of restraining elongated members (e.g., metal bars). These restraining members may act to inhibit rollable carrier 100 from prematurely exiting the path system, while allowing participant 106 to view his/her surroundings outside of the rollable carrier/path system as well as possibly obtain a better sense of motion. The lower portion 116*b* of path system 116 may be formed of a solid continuous material which is either substantially opaque or translucent. Advantages of such a path system may include reducing construction costs. The upper portion 116*a* of the path system may be less expensive to produce in part due to the fact that it is not necessary to produce the top half to the same weight bearing capacities of the lower portion of the path system. If participant 106 is positioned in a transparent rollable carrier 100, then the participant may experience an additional aspect of the amusement ride FIG. 10 depicts an embodiment of a portion of a path system of an amusement park ride. The embodiment of path system 116 (e.g., a conduit) depicted in FIG. 10 is formed from at least two materials. Upper portion 116*a* of path system 116 may be formed from a network of restraining elongated members (e.g., flexible nets/netting). These restraining members may act to inhibit rollable carrier 100 from prematurely exiting the path system, while allowing participant 106 to view his/her surroundings outside of the rollable carrier/path system as well as possibly obtain a better sense of motion of the rollable carrier. The restraining members may be supported using various systems known to one skilled in the art. The embodiment depicted in FIG. 10 illustrates a flexible netting forming upper portion 116*a* supported by support members 118. The lower portion 116*b* of path system 116 may be formed of a solid continuous material which is either substantially opaque or translucent. Advantages of such a path system may include reducing construction costs. The upper portion 116*a* of the path system may be less expensive to produce in part due to the fact that it is not necessary to produce the top half to the same weight bearing capacities of the lower portion of the path system. If participant 106 is positioned in a transparent rollable carrier 100, then the participant may experience an additional aspect of the amusement ride FIG. 11 depicts an embodiment of a portion of a path system of an amusement park ride. The embodiment of path system 116 (e.g., a conduit) depicted in FIG. 11 is formed from a network of restraining elongated members (e.g., metal bars or tubes). These restraining members may act to inhibit rollable carrier 100 from prematurely exiting the path system, while allowing participant 106 to view his/her surroundings outside of the rollable carrier/path system as well as possibly obtain a better sense of motion of the rollable carrier. The restraining members may be supported using various systems known to one skilled in the art. If participant 106 is positioned in a transparent rollable carrier 100, then the participant may experience an additional aspect of the amusement ride.

Figure 12:
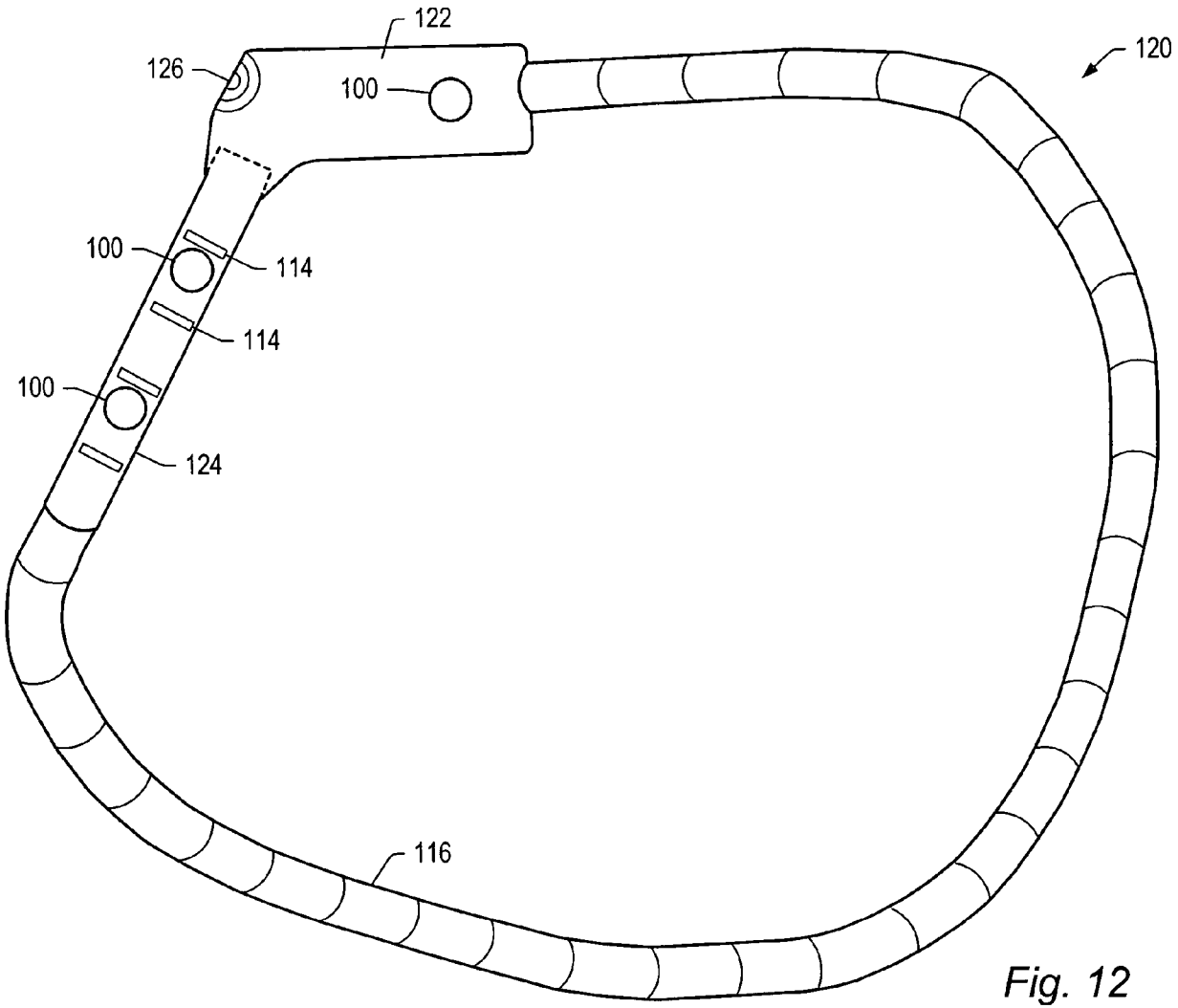
FIG. 12 depicts an embodiment of an amusement park ride.

FIG. 12 depicts an embodiment of amusement park ride 120. The embodiment of amusement park ride 120 depicted in FIG. 12 illustrates a basic version of the amusement ride. The amusement ride may include path system 116, body of water 122, and elevation system 124. Path system 116 may include any path system described herein as well as any path system capable of safely accommodating rollable carriers described herein. In some embodiments, a path system may include a water element. The water element may include, for example, a relatively thin sheet of water. A thin sheet of water may reduce friction. The water element may include a relatively thick sheet of water. A thick sheet of water may be deep enough so that a rollable carrier and any participants therein may float on top of the water. A thick sheet of water may, however, be shallow enough to inhibit accidental drowning (e.g., between about 2 feet and about 3 feet). The path system embodiment, depicted in FIG. 12, forms a continuous loop, so that a participant may ride continuously if so desired. The path system depicted in FIG. 12 may use gravity to convey a rollable carrier and/or participant from a first higher elevation to a second lower elevation. In some embodiments, a path system may not form a continuous loop. In such embodiments, the end and the beginning of the ride are not connected. In some embodiments, a path system may not in itself form a continuous loop, however, the path system may form a portion of a much larger amusement ride and/or system of amusement rides which are coupled to each other.

Elevation system 124 may include any elevation system capable of safely transporting rollable carriers to a higher elevation. The elevation system depicted in FIG. 12 is a conveyor belt system. Other examples of appropriate elevation systems are described herein.

Body of water 122 (e.g., a pool) is merely one example of a receiving area for incoming rollable carriers. The receiving area does not necessarily have to include a water element. A body of water, such as the one depicted in FIG. 12 may, however, facilitate movement of the rollable carriers from the lower elevation end point of the path system to the lower elevation beginning of the elevation system. A body of water may add another aspect for a participant to enjoy, providing an exciting "splash down" landing for the participant.

Participants may enter/exit the rollable carrier/ride at various access points 126 along the amusement ride depicted in FIG. 12. In some embodiments, an amusement ride may include one access point 126. In some embodiments, an amusement ride may be designed to accommodate multiple access points 126. The amusement ride depicted in FIG. 12 may employ body of water 122 as an access point. Body of water 122 may be situated at the lowest point of elevation along the amusement ride facilitating its use as an entry/exit point. The beginning of the path system at the top of the elevation system may be employed as an entry/exit point. The amusement ride depicted in FIG. 12 has as its highest point of elevation the beginning of the path system at the top of the elevation system; hence, if this area is employed as an access point, a means for participants to ascend to the area (e.g., a stairway or lift) is included in the amusement ride.

Figure 13:
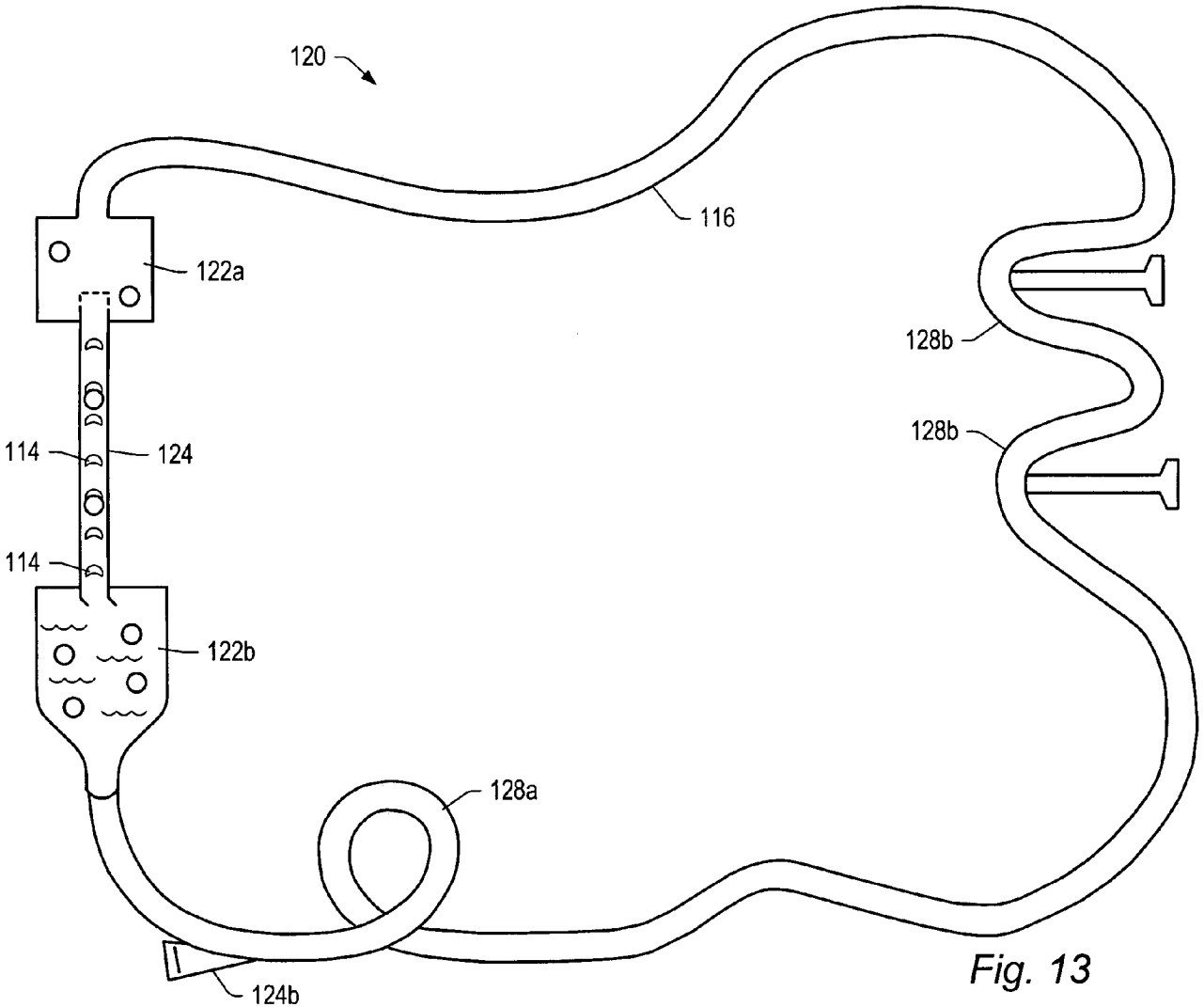
FIG. 13 depicts an embodiment of an amusement park ride.

FIG. 13 depicts an embodiment of amusement park ride 120. The embodiment of amusement park ride 120 depicted in FIG. 13 illustrates a more complex version of an amusement ride relative to FIG. 12. The amusement ride may include path system 116, body of water 122*a* and 122*b*, elevation system 124, and amusement elements 128. Path system 116 may include any path system described herein as well as any path system capable of safely accommodating rollable carriers described herein. In some embodiments, a path system may include a water element. The path system embodiment, depicted in FIG. 13, forms a continuous loop, so that a participant may ride continuously if so desired. The path system depicted in FIG. 13 may use gravity to convey a rollable carrier and/or participant from a first higher elevation to a second lower elevation. Portions of the path system may at least in part make use of the momentum of a rollable carrier gained during a decent from a high to a low elevation to assist the rollable carrier to move from the low elevation to a second high elevation.

The amusement park ride depicted in FIG. 13 includes a number of amusement elements 128. "Amusement elements" may be generally defined as elements incorporated into an amusement ride for the purpose of providing pleasurable excitement and/or diversion to one or more participants. At least two of the amusement elements depicted in FIG. 13 include amusement elements 128*a* and 128*b*.

Amusement element 128*a* includes a "360° loop." The general concept of a 360° loop is well known to one skilled in the art of amusement rides, and is especially associated with roller coasters. However water based amusement rides, heretofore, are not known to have ever incorporated a 360° loop. A 360° loop may include a fully enclosed conduit, unlike most roller coasters. A fully enclosed conduit may be necessary because, unlike traditional roller coasters, rollable carriers as described herein are typically not coupled to a track.

Amusement element 128*b* includes two successive hills. A fully enclosed conduit may not be necessary. It may however be desirable to employ enclosed conduits for at least portions of amusement element 128*b* (e.g., portions including at least the highest points of elevation, 360° loop) for reasons discussed herein.

In some embodiments, amusement elements may include a "waterfall." The waterfall may be configured to allow the rollable carrier to drop from a first higher elevation to a second lower elevation. In certain embodiments, the difference between the elevations is between about 2 ft. to about 12 ft. A waterfall may allow a rollable carrier to experience free fall over a predetermined distance to add enjoyment to the amusement ride.

Almost all water park rides require substantial waiting periods in a queue line due to the large number of participants at the park. This waiting period is typically incorporated into the walk from the bottom of the ride back to the top, and can measure hours in length, while the ride itself lasts a few short minutes, if not less than a minute. A series of corrals are typically used to form a meandering line of participants that extends from the starting point of the ride toward the exit point of the ride. Besides the negative and time-consuming experience of waiting in line, the guests are usually wet, exposed to varying amounts of sun and shade, and are not able to stay physically active, all of which contribute to physical discomfort for the guest and lowered guest satisfaction. Additionally, these queue lines are difficult if not impossible for disabled guests to negotiate.

The concept of a continuous water ride was developed to address the problems and issues stated above associated with water amusement parks. Continuous water rides may assist in eliminating and/or reducing many long queue lines. Continuous water rides may eliminate and/or reduce participants having to walk back up to an entry point of a water ride. Continuous water rides may also allow the physically handicapped or physically challenged to take advantage of water amusement parks. Where before that may have been difficult if not impossible due to many flights of stairs typically associated with water amusement parks. Amusement rides employing the rollable carriers described herein may be incorporated into a continuous water ride.

In some embodiments, continuous water rides may include a system of individual water rides connected together. The system may include two or more water rides connected together. Amusement rides employing the rollable carriers described herein may include downhill water slides, uphill water slides, single tube slides, multiple participant tube slides, space bowls, sidewinders, interactive water slides, water rides with falling water, themed water slides, dark water rides, and/or accelerator sections in water slides. Connections may reduce long queue lines normally associated with individual water rides. Connections may allow participants to remain in the water and/or a rollable carrier (e.g., a floatation device) during transportation from a first portion of the continuous water ride to a second portion of the continuous water ride.

In some embodiments, an exit point of a first water ride may be connected to an entry point of a second water ride forming at least a portion of a continuous water ride. The exit point of the first water ride and the entry point of the second water ride may be at different elevation levels. An elevation system may be used to connect the exit point of the first water ride and the entry point of the second water ride. In some embodiments, an entry point of a second water ride may have a higher elevation than an exit point of a first water ride coupled to the entry point of the second water ride.

In some embodiments, elevation systems may include any system capable of transporting one or more participants and/or one or more rollable carriers from a first point at one elevation level to a second point at a different elevation level. Elevation systems may include a conveyor belt system. Elevation systems may include a water lock system. Elevation systems may include an uphill water slide, a spiral transport system, and/or a water wheel.

Figure 14:
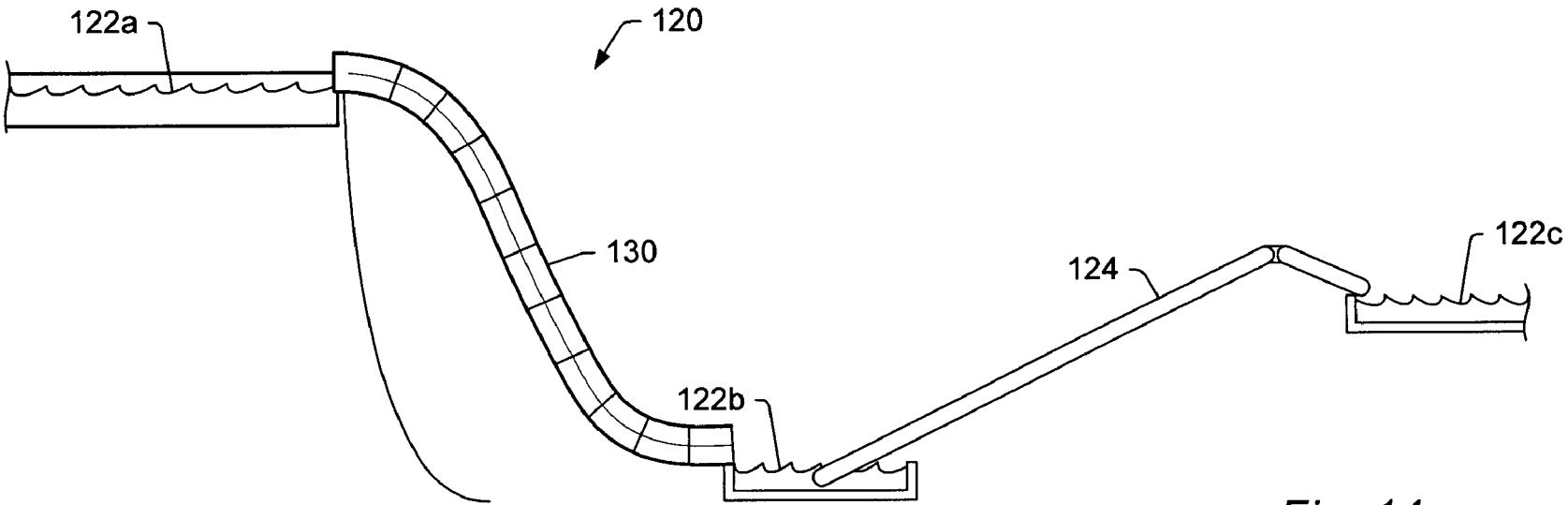
FIG. 14 depicts an embodiment of a portion of an amusement park ride.

FIG. 14 depicts an embodiment of amusement ride 120 forming at least a portion of a continuous water ride. Amusement ride 120 may include body of water 122*a*. Body of water 122*a* may include pools, lakes, and/or wells. Body of water 122*a* may be natural, artificial, or an artificially modified natural body of water. A non-limiting example of an artificially modified natural body of water might include a natural lake which has been artificially enlarged and adapted for water amusement park purposes (e.g., entry ladders and/or entry steps). Amusement ride 120 may include downhill water slide 130. Downhill water slide 130 may convey participants from body of water 122*a* at a first elevation to a lower second elevation into typically some type of water container (e.g., body of water, channel, floating queue line, and/or pool). The water container at the lower second elevation may include, for illustrative purposes only, second body of water 122*b* (e.g., a pool). Amusement ride 120 may include elevation system 124. Elevation system 124 may include any system capable of safely moving participants and/or rollable carriers from a lower elevation to a higher elevation. Elevation system 124 is depicted as a conveyor belt system in FIG. 14. Elevation system 124 may convey participants to body of water 122*c*. FIG. 14 depicts merely a portion of one embodiment of amusement ride 120.

Figure 15:
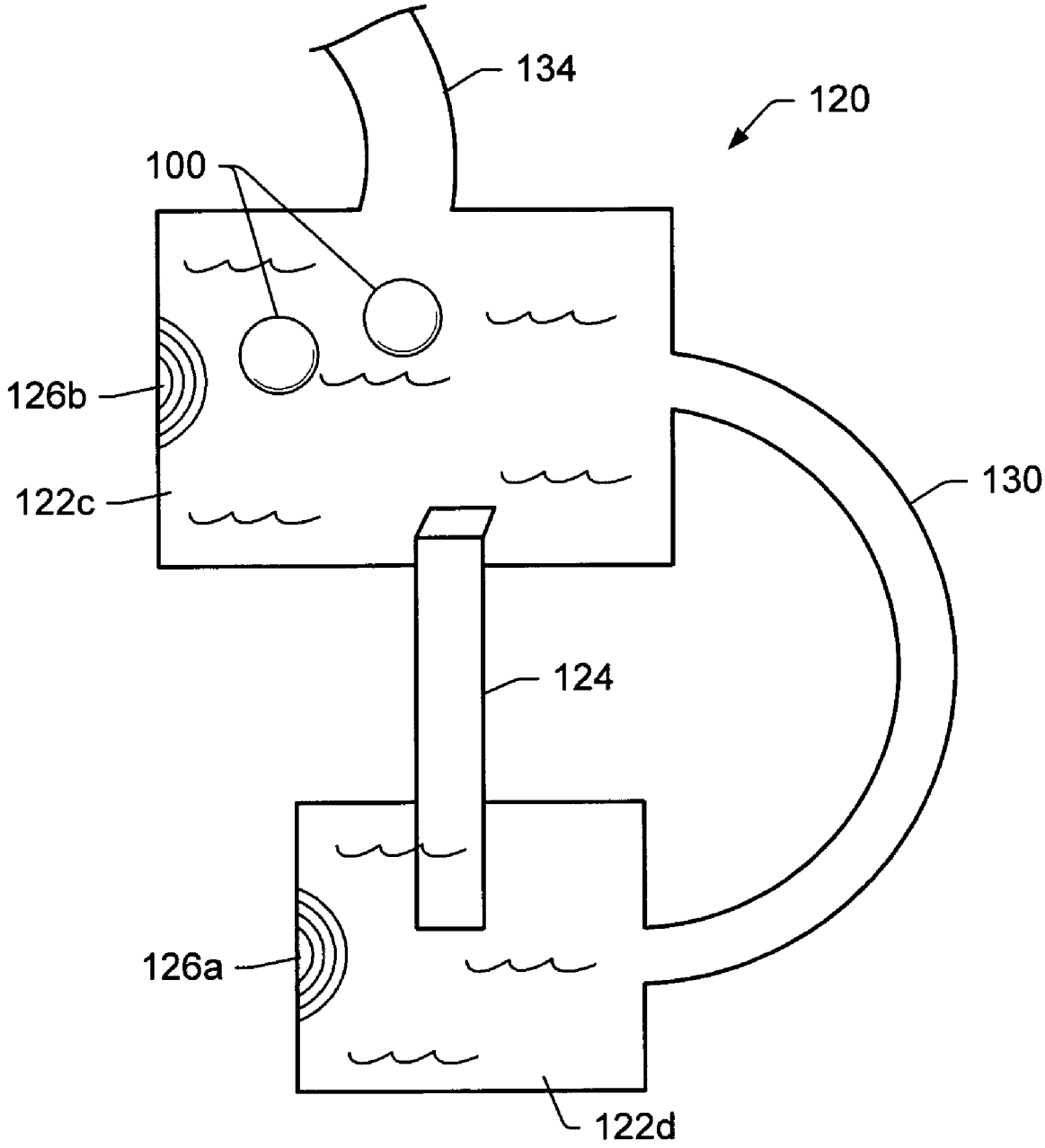
FIG. 15 depicts an embodiment of a portion of an amusement park ride.

FIG. 15 depicts an embodiment of a portion of amusement ride 120. Amusement ride 120 may include body of water 122*c*. Body of water 122*c* may be coupled to downhill water slide 130. Downhill water slide 130 may couple body of water 122*c* to body of water 122*d*. Body of water 122*d* may be positioned at a lower elevation than body of water 122*c*. Body of water 122*d* may include access point 126*a*. Access point 126*a* may allow participants to safely enter and/or exit body of water 122*d*. As depicted in FIG. 15 access points 126 may be stairs. Access points 126 may also include ladders and/or a gradually sloping walkway. Body of water 122*d* may be coupled to body of water 122*c* with elevation system 124. Elevation system 124 as depicted in FIG. 15 is a conveyor belt system. Elevation system 124 may be at least any system of elevation described herein. Body of water 122*c* may be coupled to a second water ride. The second water ride may be, for example, torrent river 134.

FIG. 15 depicts one small example of amusement ride 120. Amusement ride 120 may allow participants and/or their rollable carriers 100 to ride continually without having to leave their rollable carrier. For example a participant may enter body of water 122*c* through access point 126*b*. The participant may ride rollable carrier 100 down downhill water slide 130 to body of water 122*d*. At this point the participant has the choice to exit body of water 122*d* at access point 126*a* or to ride their rollable carrier 100 up elevation system 124 to body of water 122*c*. For safety reasons one or both ends of elevation system 124 may extend below the surface of bodies of water 122. Extending the ends of elevation system 124 below the surface of the water may allow participants to float up on elevation system 124 more safely. Participants who choose to ride elevation system 124 to body of water 122*c* may then choose to either exit access point 126*b*, ride downhill water slide 130 again, or ride torrent river 134.

In some embodiments, bodies of water 122 may include multiple elevation systems 124 and multiple water rides connecting each other. In some embodiments, floating queue lines and/or channels may couple water rides and elevation systems. Floating queue lines may help control the flow of participants more efficiently than without using floating queue lines.

In some embodiments, elevation systems may include a conveyor belt system. Conveyor belt systems may be more fully described in U.S. patent application Ser. No. 09/952,036 (Publication No. US-2002-0082097-A1), herein incorporated by reference. This system may include a conveyor belt system positioned to allow participants to naturally float up or swim up onto the conveyor and be carried up and deposited at a higher level. Such a system may also be modified to convey rollable carriers.

The conveyor belt system may also be used to take participants and rollable carriers out of the water flow at stations requiring entry and/or exit from the amusement ride. Participants and rollable carriers float to and are carried up on a moving conveyor on which participants may exit the rollable carriers. New participants may enter the rollable carriers and be transported into the amusement ride at a desired location and velocity. The conveyor may extend below the surface of the water so as to more easily allow participants to naturally float or swim up onto the conveyor. Extending the conveyor below the surface of the water may allow for a smoother entry into the water when exiting the conveyor belt. Typically the conveyor belt takes participants and rollable carriers from a lower elevation to a higher elevation, however it may be important to first transport the participants to an elevation higher than the elevation of their final destination. Upon reaching this apex the participants then may be transported down to the elevation of their final destination on a water slide, rollers, or on a continuation of the original conveyor that transported them to the apex. This serves the purpose of using gravity to push the participant off and away from the belt, slide, or rollers into a second water ride of the continuous water ride and/or a floating queue. The endpoint of a conveyor may be near a first end of a horizontal hydraulic head channel wherein input water is introduced through a first conduit. This current of flowing may move the participants away from the conveyor endpoint in a quick and orderly fashion so as not to cause increase in participant density at the conveyor endpoint. Further, moving the participants quickly away from the conveyor endpoint may act as a safety feature reducing the risk of participants becoming entangled in any part of the conveyor belt or its mechanisms. A deflector plate may also extend from one or more ends of the conveyor and may extend to the bottom of the channel. When the deflector plate extends at an angle away from the conveyor it may help to guide the participants up onto the conveyor belt as well as inhibit access to the rotating rollers underneath the conveyor. These conveyors may be designed to lift participants from one level to a higher one, or may be designed to lift participants and rollable carriers out of the water, onto a horizontal moving platform and then return the rollable carrier with a new participant to the water.

The conveyor belt speed may also be adjusted in accordance with several variables. The belt speed may be adjusted depending on the participant density; for example, the speed may be increased when participant density is high to reduce participant waiting time. The speed of the belt may be varied to match the velocity of the water, reducing changes in velocity experienced by the participant moving from one medium to another (for example from a current of water to a conveyor belt). Conveyor belt speed may be adjusted so participants are discharged at predetermined intervals, which may be important where participants are launched from a conveyor to a water ride that requires safety intervals between the participants.

Several safety concerns should be addressed in connection with the conveyor system. The actual belt of the system should be made of a material and designed to provide good traction to participants and rollable carriers without proving uncomfortable to the participants touch. Detection devices or sensors for safety purposes may also be installed at various points along the conveyor belt system. These detection devices may be variously designed to determine if any participant on the conveyor violating safety parameters. Gates may also be installed at the top or bottom of a conveyor, arranged mechanically or with sensors wherein the conveyor stops when the participant collides with the gate so there is no danger of the participant being caught in and pulled under the conveyor. Runners may cover the outside edges of the conveyor belt covering the space between the conveyor and the outside wall of the conveyor so that no part of a participant may be caught in this space. All hardware (electrical, mechanical, and otherwise) should be able to withstand exposure to water, sunlight, and various chemicals associated with water treatment (including chlorine or fluorine) as well as common chemicals associated with the participants themselves (such as the various components making up sunscreen or cosmetics).

In some embodiments, a conveyor belt system may include restraining devices and/or gripping devices. Restraining devices may be used to inhibit rollable carriers and/or participants from moving while on the conveyor belt (other than the movement associated with the movement of the conveyor belt itself when activated). Many of the rollable carriers described herein may have a tendency to move on their own in a direction opposite that of the conveyor belt if the conveyor belt is moving from a first lower elevation to a second higher elevation. Restraining devices may be used to inhibit movement of a rollable carrier and/or participants relative to a conveyor belt.

Restraining members may include paddle type embodiments coupled to a conveyor belt. Paddles may include solid members. Paddles may include supported netting. Some type of netting (e.g., any materials which may allow fluids to pass through) may be used to form restraining members. Materials which allow fluids (e.g., water and/or air) to pass through may decrease resistance as the restraining members travel around the conveyor belt system, especially when unoccupied by a rollable carrier. Decreasing resistance may be advantageous in that the elevation system may require less energy to operate.

Figure 16:
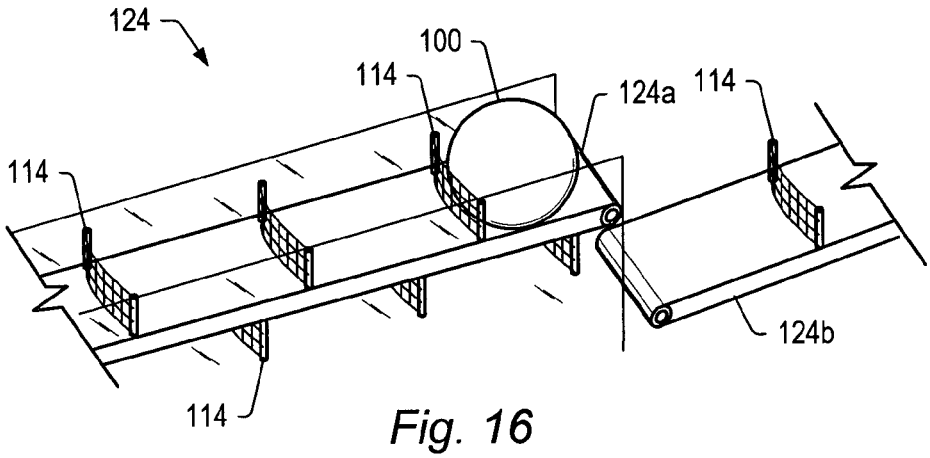
FIG. 16 depicts an embodiment of a portion of a conveyor belt system.

FIG. 16 depicts an embodiment of a portion of elevation system 124 (e.g., conveyor belt system). The conveyor belt system pictured in FIG. 16 may include restraining members 114. Restraining members 114 may function to support rollable carriers 100 as the rollable carriers are conveyed along elevation system 124. The restraining members may include a shape which is designed to be compatible with a particular rollable carrier. For example, in some embodiments, restraining members 114 may include a curvature to better accommodate a rollable carrier with a rollable surface as depicted in FIG. 16.

In some embodiments, end 124*a* of elevation system 124 may be positioned above beginning 124*b* of a second portion of the elevation system at a sufficient height to allow restraining members 114 to more easily pass around end restraining members 114*a* without interference from beginning restraining members 114*b*. As depicted in FIG. 16 the second portion of the elevation system may include a conveyor belt system, set at a decline instead of an incline to control the rate of decent. In some embodiments, an elevation system may end allow a rollable carrier to enter the beginning of a downhill slide or any other water amusement ride known to one skilled in the art. In some embodiments, restraining members, such as the ones depicted in FIG. 16 may include a means for collapsing or lying relatively flat against the conveyor belt when approaching end 124*a* of elevation system 124 such that end 124*a* may not require a significant drop off to allow the restraining system to rotate around the end.

Various sensors may also be installed along the conveyor belt system to monitor the number of people using the system in addition to their density at various points along the system. Sensors may also monitor the actual conveyor belt system itself for breakdowns or other problems. Problems include, but are not limited to, the conveyor belt not moving when it should be or sections broken or in need of repair in the belt itself. All of this information may be transferred to various central or local control stations where it may be monitored so adjustments may be made to improve efficiency of transportation of the participants. Some or all of these adjustments may be automated and controlled by a programmable logic control system.

Various embodiments of the conveyor lift station include widths allowing only one or several participants side by side to ride on the conveyor according to ride and capacity requirements. The conveyor may also include entry and exit lanes in the incoming and outgoing stream so as to better position participants onto the conveyor belt and into the outgoing stream.

Figure 17:
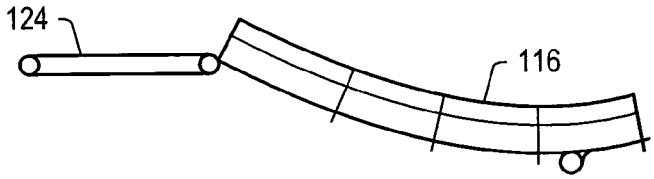
FIG. 17 depicts a side view of an embodiment of a conveyor lift station coupled to a water ride.
Figure 18:
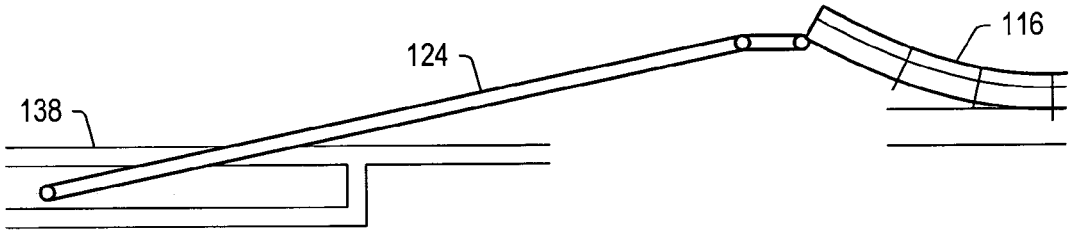
FIG. 18 depicts a side view of an embodiment of a conveyor lift station with an entry conveyor coupled to a water slide.
Figure 19:
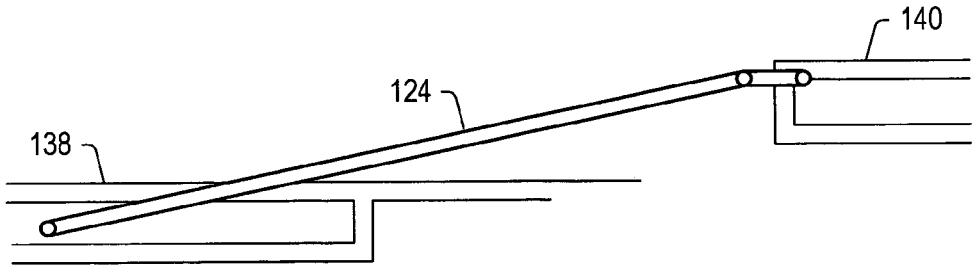
FIG. 19 depicts a side view of an embodiment of a conveyor lift station coupled to an upper channel.

More embodiments of conveyor systems are shown in FIG. 17-FIG. 19. FIG. 17 shows a dry conveyor for transporting participants entering the system into a channel. It includes a conveyor belt portion ending at the top of downhill slide 130 which participants slide down on into the water. FIG. 18 shows a wet conveyor for transporting participants from a lower channel to a higher one with downhill slide 130 substituted for the launch conveyor. FIG. 19 shows a river conveyor for transporting participants from a channel to a torrent river. This embodiment does not have a descending portion.

In some embodiments, a conveyor belt system may be oriented substantially vertically. A vertical conveyor belt system may decrease the time required to convey a participant over a particular elevational distance relative to a conveyor belt system disposed at an angle. The use of vertical conveyor belts may also reduce the amount of land required by an amusement ride.

A vertical conveyor belt may function much like an elevator, in so far as it may start and stop to load and unload participants. A vertical conveyor belt may include a restraining system. The restraining system may function to inhibit rollable carriers from moving relative to the conveyor belt. Restraining systems may include any type of restraint system known to one skilled in the art.

Restraining systems may include container systems coupled to the conveyor belt. A container may be coupled to the conveyor belt and may be open on one side such that as the container travels around with the conveyor belt a rollable carrier may enter the container at a first elevation (e.g., a lower elevation). The belt may carry the container to a second elevation (e.g., a higher elevation relative to the first elevation). A programmable control system may stop whenever a container reaches the first and second elevation allowing rollable carriers to enter and exit the container. The conveyor belt system may include a programmable control system which is partially or fully automated. The conveyor belt system may include sensors which detect whether or not a container is occupied by a rollable carrier and/or if a rollable carrier is waiting to board a container. Such a sensor system may be coupled to a programmable control system allowing the conveyor belt system to work more efficiently (e.g., containers will not stop at a particular elevation if there exists no rollable carrier to enter or exit the container.

A vertical conveyor belt may include restraining systems. Restraining systems may include a container with a roof and a gate. The gate may be opened and closed automatically in response to signals from a sensor system triggered by participants and/or rollable carriers. Gates may be opened/closed by amusement park employees. In some embodiments, Vertical conveyor belts may use a combination of programmable control systems, sensor systems, and amusement park employees to ensure the safety of participants.

Figure 20:
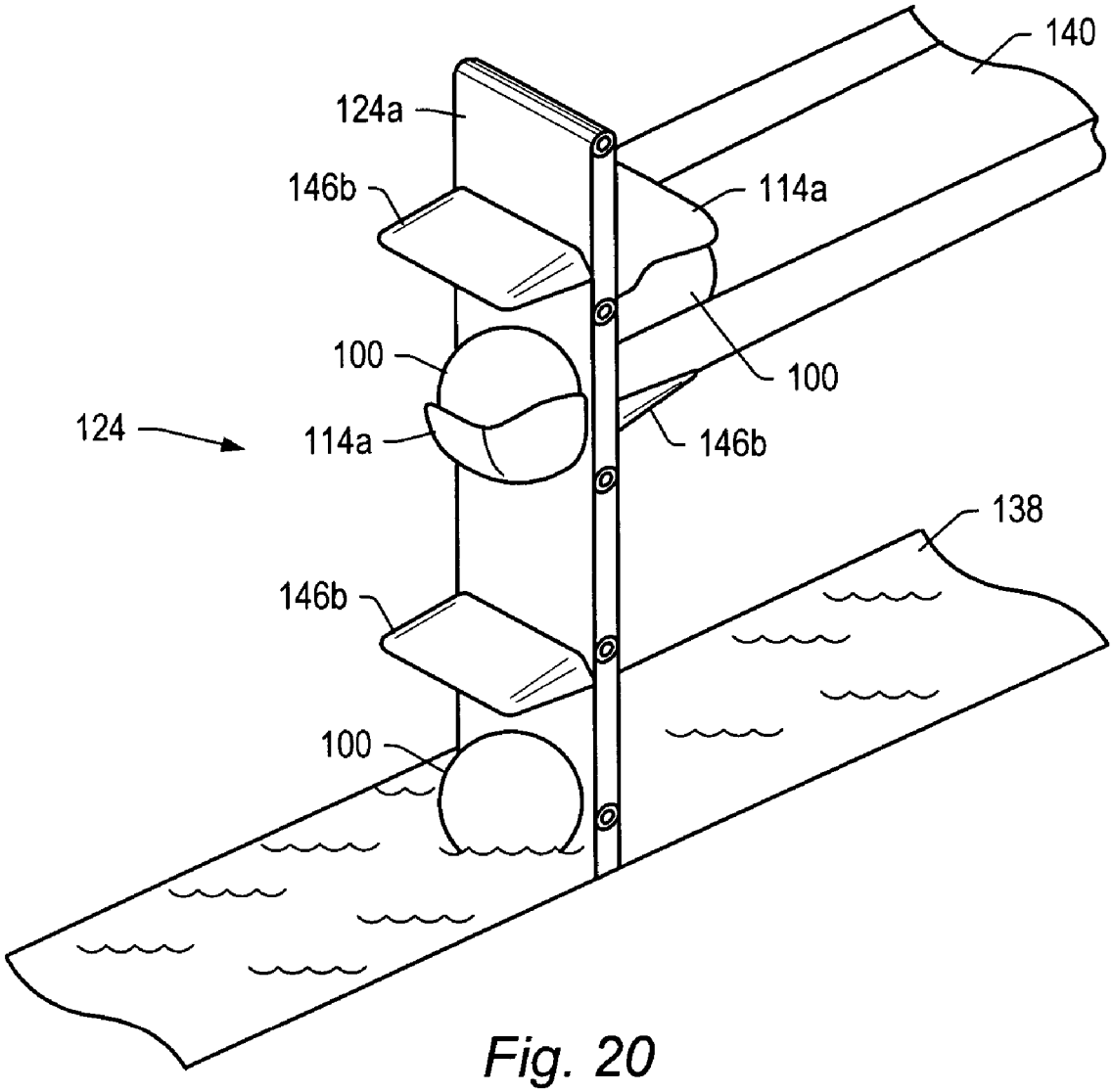
FIG. 20 depicts an embodiment of an elevation system used in combination with a water amusement ride.

FIG. 20 depicts an embodiment of elevation system 124 used in combination with amusement ride 120. Elevation system 124 includes a vertical conveyor system which conveys rollable carriers 100 from lower body of water 138 to upper channel/path system 140. Elevation system 124 may include restraints 114. Restraints 114 may function to inhibit rollable carriers 100 from moving relative to the conveyor belt 124*a*. Conveyor belt 124*a* may run in a continuous loop picking up rollable carriers 100 and conveying them from a first lower elevation to a second higher elevation. Restraints 114 may include restraints 114*a* and restraints 114*b*. Restraints 114*a* may function as a retainer for rollable carriers 100 inhibiting their movement. Restraints 114*b* may function as a retainer for rollable carriers 100 inhibiting their movement. Restraints 114*b* may function to act as a surface to transfer rollable carriers 100 from restraints 114*a* to upper channel/path system 140

In some embodiments, an elevation system may include fluid enhanced elevation system. A fluid enhanced elevation system may include a water jet which functions to increase the elevation of a participant and/or rollable carrier. The fluid enhanced elevation system may function by projecting a volume of water/air at a high pressure in order to elevate a participant and/or rollable carrier. In some embodiments, an elevation system using pressurized fluids may be used to elevate a participant/rollable carrier only a few feet (e.g., the elevation system may only be used as an amusement effect for the enjoyment of the participant). In some embodiments, a horizontally directed fluid jet, or some other means, may be used to displace a participant/rollable carrier off of a fluid enhanced elevation system. The participant/rollable carrier may already be in an elevated state due to an activated vertically directed fluid jet upon displacement using the horizontally directed fluid jet.

Figure 21:
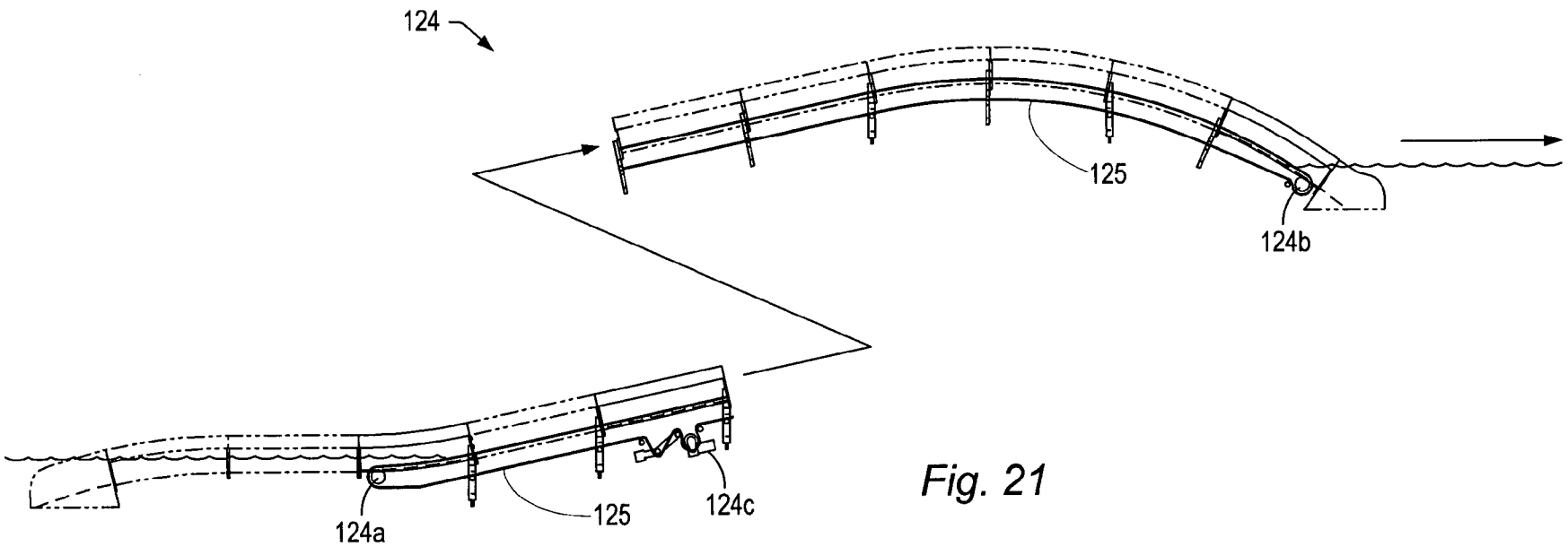
FIG. 21 depicts an embodiment of an elevation system.

FIG. 21 through FIG. 31 depict embodiments of conveyor belt elevation systems as well as embodiments of specific portions of the conveyor belt elevation systems. FIG. 21 depicts an embodiment of conveyor belt elevation system 124. Conveyor belt elevation system 124 may be used to convey participants from a lower first elevation to a higher second elevation. Although generally elevation systems described herein are used for moving participants and/or participant carriers from a lower to a higher elevation, it should be noted that with little to no modification elevation systems described herein may be used to convey participants and/or participant carriers from a higher to a lower elevation or even convey participants over a specified distance along a substantially constant elevation.

Figure 22:
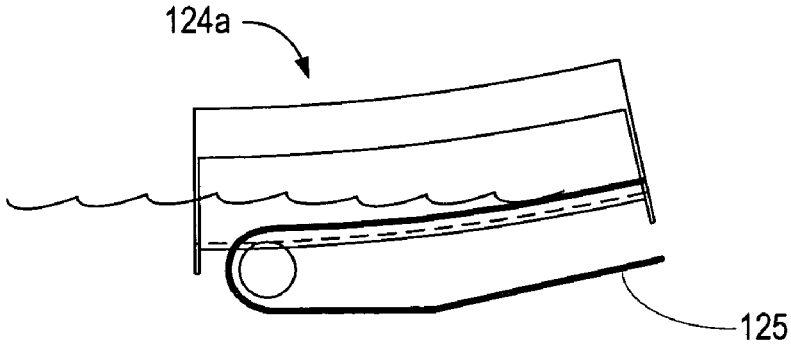
FIG. 22 depicts an embodiment of an entry portion of an elevation system.
Figure 23:
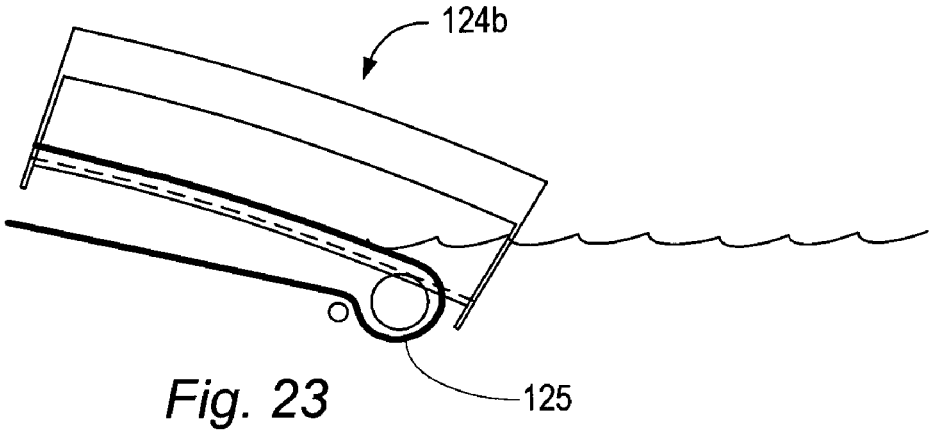
FIG. 23 depicts an embodiment of an exit portion of an elevation system.
Figure 24:
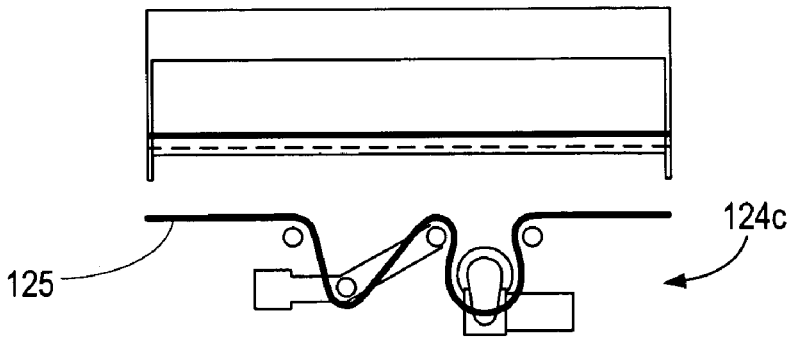
FIG. 24 depicts an embodiment of a drive mechanism of an elevation system.

FIG. 22 through FIG. 24 depict embodiments of specific portions of conveyor belt elevation system depicted in FIG. 21. Conveyor belt elevation systems may include conveyor belt 125. FIG. 22 depicts an embodiment of entry portion 124*a* of a conveyor belt elevation system. Entry portion 124*a* may be substantially submerged under water during operation of a conveyor belt elevation system. Submerging the entry portion may function to ensure a smooth transition for participants from a water filled channel onto a belt of the conveyor belt elevation system. The entry portion may include sensors which function to detect when participants have entered the conveyor belt elevation system.

FIG. 23 depicts an embodiment of exit portion 124*b* of a conveyor belt elevation system. Exit portion 124*b* may be substantially submerged under water during operation of a conveyor belt elevation system. Submerging the exit-portion may function to ensure a smooth transition for participants from a belt of the conveyor belt elevation system into a water filled channel or some other portion of an amusement ride. The exit portion may include sensors which function to detect when participants have exited the conveyor belt elevation system.

FIG. 24 depicts an embodiment of drive mechanism 124*c* of a conveyor belt elevation system. FIG. 24 depicts how a conveyor belt may thread through a drive mechanism. The drive mechanism depicted specifically is used for situations where drive mechanisms cannot be located at the upper end of the conveyor belt (e.g., river lifts).

Figure 25:
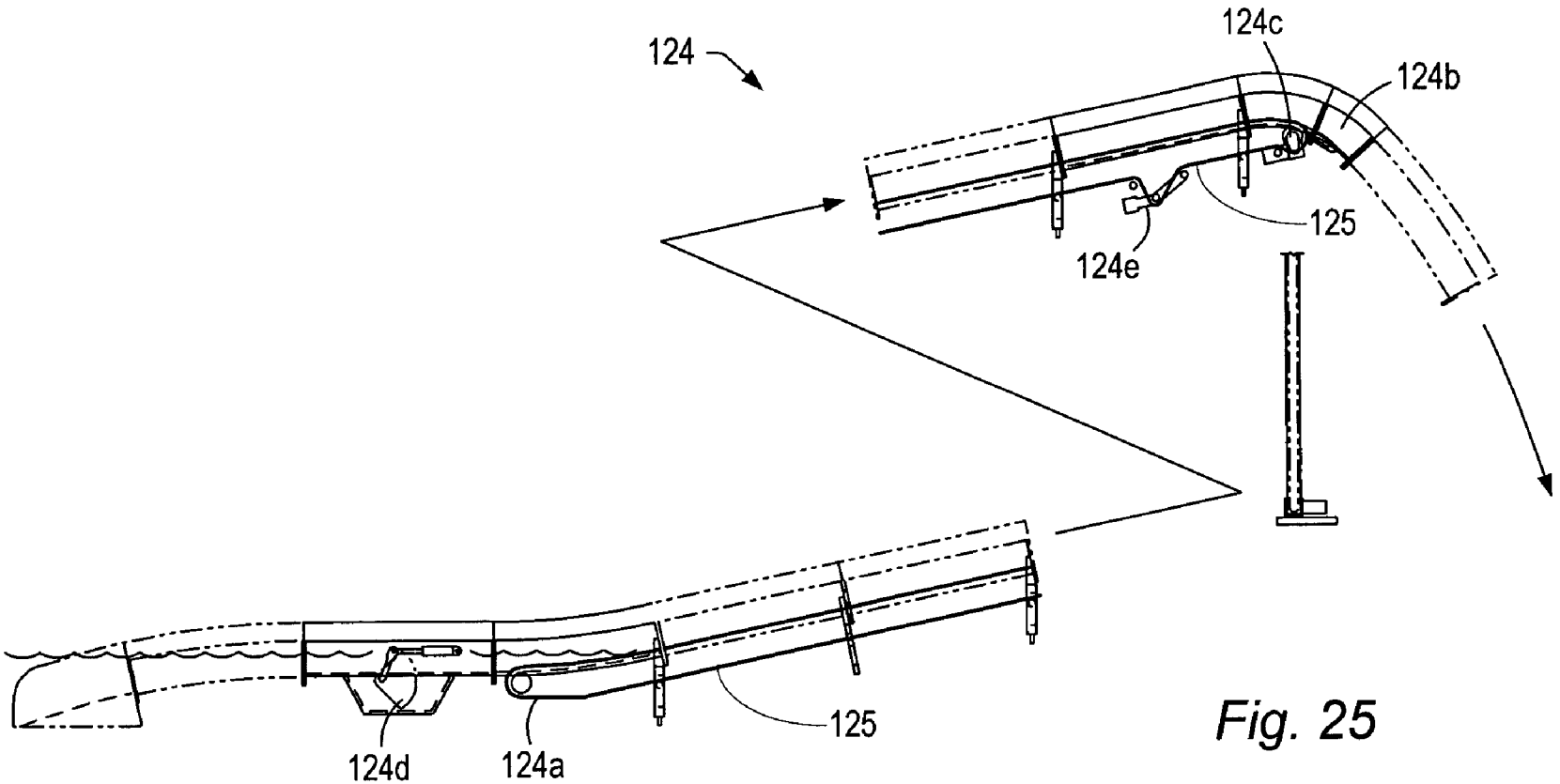
FIG. 25 depicts an embodiment of an elevation system.

FIG. 25 depicts an embodiment of conveyor belt elevation system 124. Conveyor belt elevation system 124 may include entry portion 124*a* as depicted in, for example, FIG. 22. Conveyor belt elevation system 124 may include exit portion 124*b*, drive mechanism 124*c*, gate mechanism 124*d*, and tension mechanism 124*e*.

Figure 26:
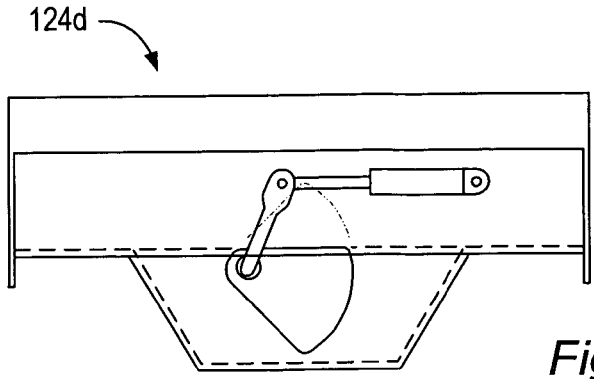
FIG. 26 depicts an embodiment of a gate mechanism of an elevation system.

FIG. 26 depicts an embodiment of gate mechanism 124*d*. Gate mechanism 124*d* may function to control the access rate of participant and/or participant carriers onto conveyor belt elevation system 124. The gate mechanism may ensure that only one participant carrier enters the conveyor belt system at a time and/or maintain optimal spacing between participant carriers along the conveyor belt system. The gate mechanism may include a positionable arm. The positionable arm may be coupled to a dam or gate. The gate may be buoyant and function to hinder the progress of participants. The positionable arm may function to position the gate in an upward hindering position as depicted in FIG. 26. The positionable arm may function to position the gate in a position to allow participants to pass unhindered (e.g., retracting the gate so it is flush with the floor of, for example, a channel).

The gate mechanism may function such that few or no pinch points are accessible to a participant. The gate mechanism may be driven by outboard actuators (e.g., hydraulic or pneumatic). The gate mechanism may include a pivot shaft, actuators, and local drive unit. The gate mechanism may include sensors. Some of the sensors may communicate the position of the gate to a programmable controller. Some of the sensors may detect when participants approach the gate. Some of the sensors may detect when participants have safely cleared the gate. Sub-framework of the gate may be mounted directly to the path system flooring (e.g., concrete).

FIG. 26 depicts only one embodiment of gate mechanism 124*d*, in other embodiments gate mechanisms may include adjustable weirs as described herein. Gate mechanisms may include any mechanism which is capable of controlling the flow of participants through a section or portion of a water amusement park.

In some embodiments, gate mechanisms may be used to direct participants toward one or more paths when there exists two or more alternative path choices built into a water amusement park ride system. The gate mechanism may be coupled to a control system. The control system and/or gate mechanism may be coupled to sensors. The control system may be at least partially automated.

In some embodiments, participants may signal which path option they prefer and a gate mechanism may comply appropriately with the participant's choice. For example, a participant may signal manually (e.g., vocally or using hand signals) which path option the participant prefers. Using motion detectors and/or voice recognition software may allow a control system to automatically position a gate mechanism such that a participant enters the desired path option. In some embodiments, a gate mechanism may be manually controlled by an operator. In some embodiments, a participant may use a personal electronic signally device to indicate which path option they prefer. For example a participant identifier may be used as described in U.S. patent application Ser. No. 10/693,654 entitled "CONTINUOUS WATER RIDE," herein incorporated by reference.

In some embodiments, a gate mechanism may function to regulate the flow of participants between a multi-path option such that participants are distributed appropriately to maintain a maximum participant flow rate reducing participant waiting times. Appropriately distributing participants between path options of a water amusement ride and/or elevation system may include substantially evenly distributing participants between path options. Appropriately distributing participants between path options of a water amusement ride and/or elevation system may include distributing participants between path options based on each paths particular participant flow capacity.

Figure 26A:
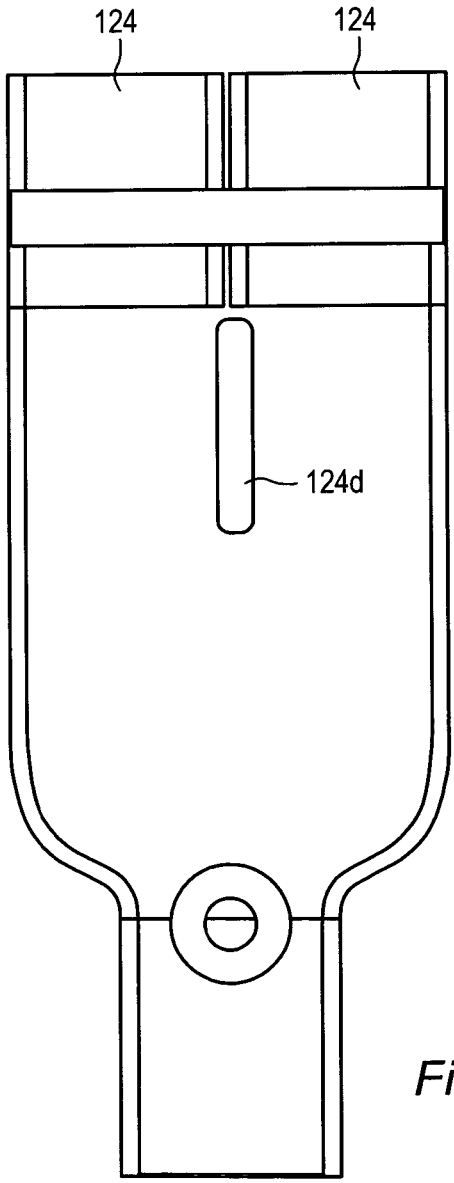
FIG. 26A depicts an embodiment of a gate mechanism.

FIG. 26A depicts an embodiment of gate mechanism 124*d*. Gate mechanism 124*d* depicted in FIG. 26A is configured to distribute participants between two conveyor belt elevation systems 124. Gate mechanism 124*d* depicted in FIG. 26A is depicted in a neutral position with both path options available. The gate mechanism may pivot from side to side selectively blocking and opening the different path options (e.g., conveyor belt elevation system). FIG. 26A depicts an embodiment including two path options (e.g., conveyor belt elevation system); however, other embodiments may include any number of path options through which the flow of participants may or may not be controlled using one or more gate mechanisms or similar devices.

One skilled in the art may use and/or modify common methods and devises to act as or accomplish similar ends of the gate mechanism (e.g., diverting participants between path options and/or controlling the flow of participants through a particular section of a water amusement ride and/or system).

Figure 27:
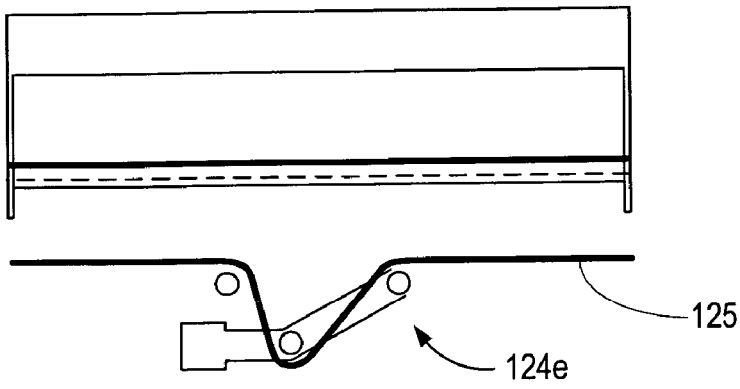
FIG. 27 depicts an embodiment of a tension mechanism of an elevation system.

FIG. 27 depicts an embodiment of tension mechanism 124*e* of a conveyor belt elevation system. Tension mechanism 124*e* may function to provide additional tension to a conveyor belt when necessary. The tension mechanism may include sensors. Some of the sensors may detect when there is not enough tension on the conveyor belt. Sensors may be coupled to a programmable controller. The tension mechanism may include a lock-out feature. The lock-out feature of the tension mechanism may function to release tension on the conveyor belt to, for example, allow maintenance.

Figure 28:
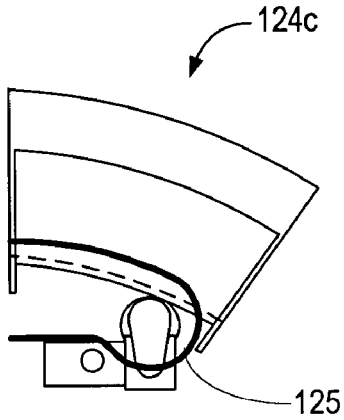
FIG. 28 depicts an embodiment of a drive mechanism of an elevation system.

FIG. 28 depicts an embodiment of drive mechanism 124*c* of a conveyor belt elevation system. FIG. 28 depicts how a conveyor belt may thread through a drive mechanism. The embodiment depicted in FIG. 28 is adapted for an upper end of a conveyor belt system to launch a participant carrier into a downhill portion of an amusement ride (e.g., a downhill slide). The embodiment depicted in FIG. 28 may require a separate tension mechanism as depicted in FIG. 25 and FIG. 27.

Figure 29:
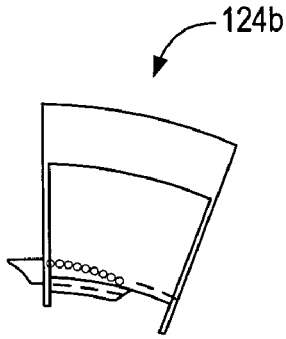
FIG. 29 depicts an embodiment of an exit portion of an elevation system.

FIG. 29 depicts an embodiment of exit portion 124*b* of a conveyor belt elevation system. Exit portion 124*b* depicted in FIG. 29 may provide a relatively safe interface between an end of a conveyor belt elevation system and another portion of an amusement ride. A conveyor belt interface with the exit portion may include a mating comb, such as provided from Intralox. The exit portion may include a section of roller belt (e.g., Intralox's Series 400 Roller Top). The section of roller belt may ease a participant off of the belt conveyor. In some embodiments, both a comb and a roller belt may be pre-assembled to a tray. The tray may be formed from stainless steel. The tray may couple directly inside a cavity of the floor of an amusement ride.

Figure 30:
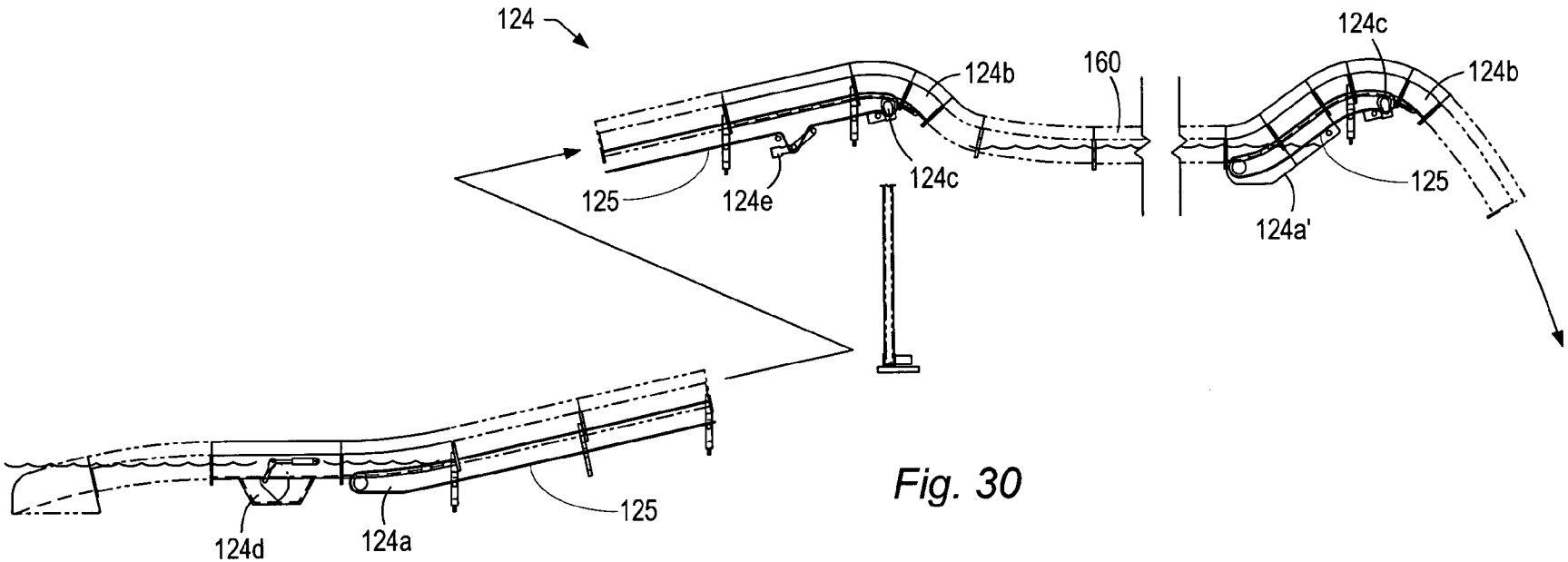
FIG. 30 depicts an embodiment of an elevation system.

FIG. 30 depicts an embodiment of conveyor belt elevation system 124. Conveyor belt elevation system 124 may include entry portions 124*a*', entry portion 124*a*, exit portion 124*b*, drive mechanism 124*c*, gate mechanism 124*d*, and tension mechanism 124*e*.

Figure 31:
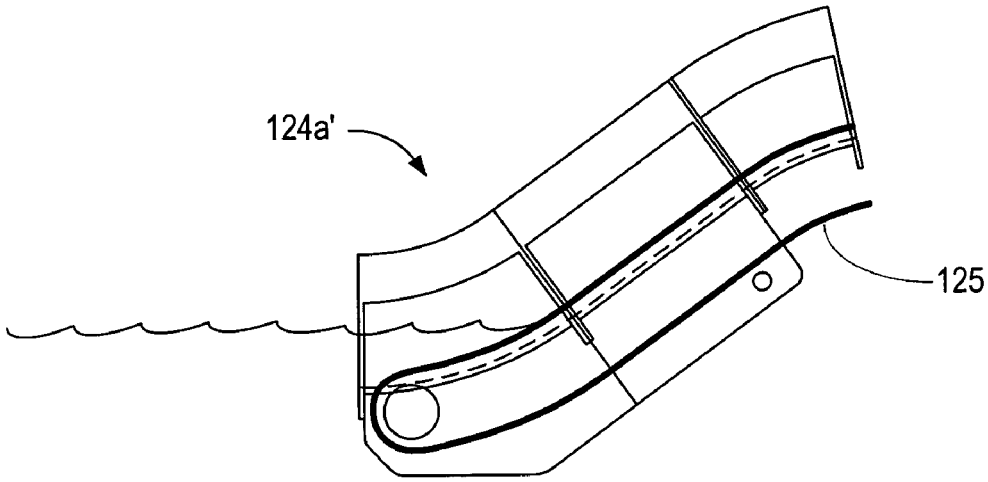
FIG. 31 depicts an embodiment of an entry portion of an elevation system.

FIG. 31 depicts an embodiment of entry portion 124*a*' of a conveyor belt elevation system. It should be noted that the embodiment depicted in FIG. 31 may be used at either an exit or entry point as may many of the embodiments described herein. The beginning of the entry portion may be set below water level during use to ease participants on the conveyor belt. The entry portion may be located at the end of floating queue system 160 as depicted in FIG. 30. Entry portion 124*a*' may bring floating participants up out of the floating queue channel and into a subsequent portion of an amusement ride. Entry portion 124*a*' may be combined with exit portion 124*b* and drive mechanism 124*c* as depicted in FIG. 30. The entry portion may include sensors to detect when participants actually enter the portion.

Figure 39:
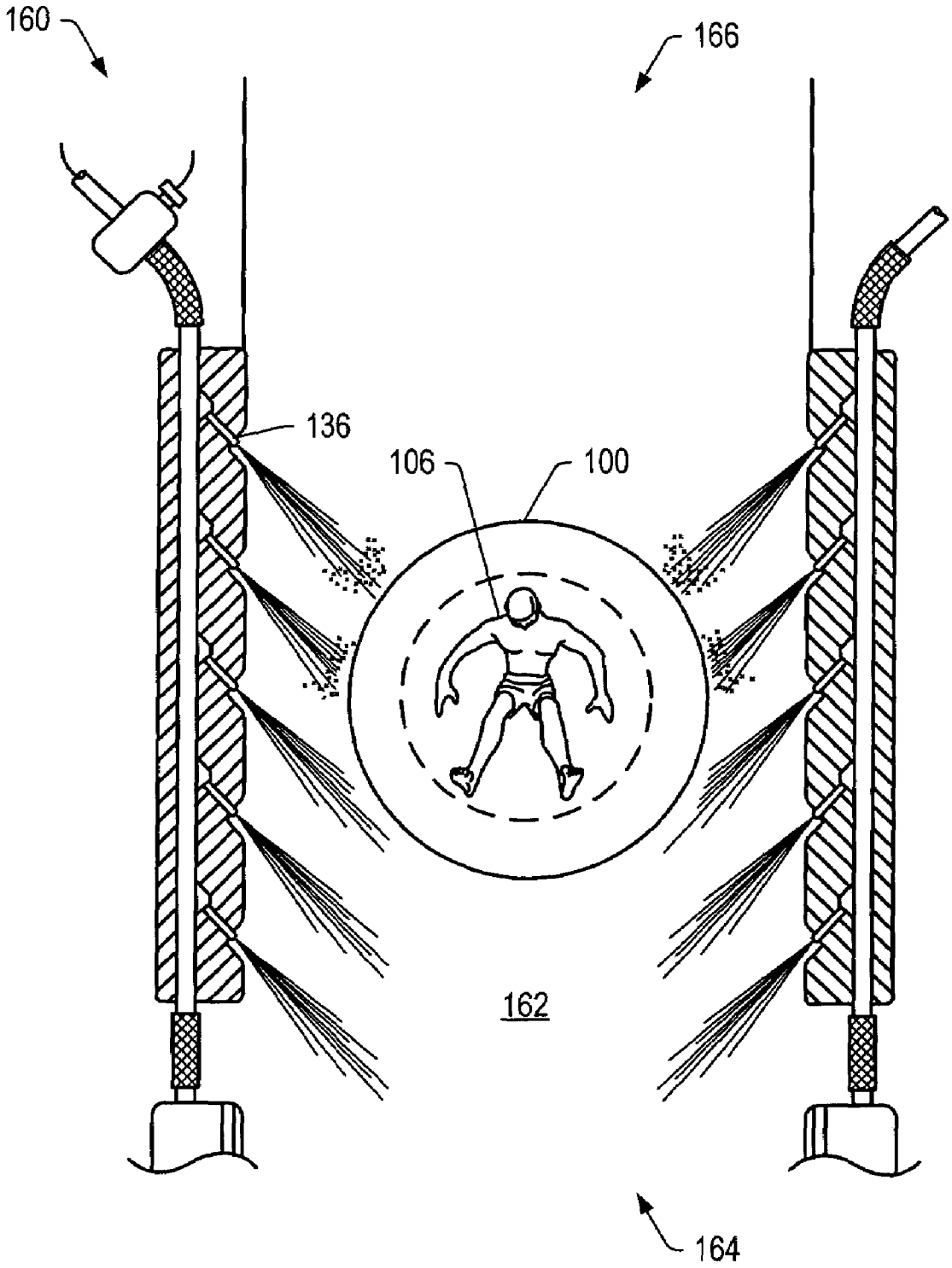
FIG. 39 depicts an embodiment of a floating queue line with jets.

In some embodiments, floating queue system 160 may include fluid jets. Floating queue system 160 may be designed as depicted in FIG. 39. A floating queue system may be coupled/positioned at a beginning point and/or ending point of an elevation system (e.g., conveyor belt elevation system 124) and/or amusement park ride. Fluid jets of a floating queue line may be used to assist in pushing participants and/or vehicles onto conveyor belts. In doing this, fluid jets will decrease the effort expended by a participant and increase a participant's amusement factor.

Fluid jets within a floating queue system may assist in controlling the flow of participants onto a conveyor system and/or amusement park ride. Control systems may be coupled to the fluid jets to control the velocity of fluids exiting the jets to control the flow of participants onto a conveyor system and/or amusement park ride. In some embodiments, control systems may be at least partially automated. For example, control systems may include sensors coupled to the control system. Sensors may assist the control system in keeping track of participant flow rate through a floating queue system such that a control system may adjust the participant flow rate accordingly. In some embodiments, a floating queue system may assist in controlling the flow of participants off a conveyor system and/or amusement park ride.

In some embodiments, an amusement park system may include portions of a body of water (e.g., channels, pools, etc.) wherein the portions are shallower than the rest of the body of water. Shallower portions of a body of water may allow participants to more easily enter the amusement park system at this point. Shallower portions may allow a participant to more easily enter a water amusement ride and/or more easily mount/access a vehicle (e.g., an inflatable vehicle such as an inner tube). Shallower portions of a body of water may also be referred to as participant/vehicle access or entrance points. These shallower portions may be shallow enough to facilitate participants entrance into a ride/vehicle while still allowing the participant/vehicle to float. In some embodiments, shallower portions of a body of water may range from 1 to 4 feet in depth. In some embodiments, shallower portions of a body of water may range from 1 to 3 feet in depth. In some embodiments, shallower portions of a body of water may range from 1 to 2 feet in depth. In some embodiments, shallower portions of a body of water may range from 2 to 3 feet in depth.

In some embodiments, shallower portions of a body of water may be positioned adjacent a beginning point and/or end point of an elevation system (e.g., a conveyor belt elevation system). Shallower portions may be positioned in conjunction with or instead of floating queue system 160 as depicted in FIG. 30 allowing participants to join the water amusement system at this point. As depicted in FIG. 30 multiple conveyor belt elevation systems may be joined together. Multiply branched elevation/channel systems as depicted in FIG. 26A may be introduced as part of a water amusement ride system and in specific embodiments may be positioned after floating queue system 160 as depicted in FIG. 30.

In some embodiments, shallower portions of a body of water may be positioned before/adjacent a beginning point of a conveyor belt elevation system. The shallower portion may be used in combination with means for conveying water from a beginning of a conveyor belt elevation system to the end of the conveyor belt elevation system, described more fully in U.S. patent application Ser. No. 09/952,036 (Publication No. US-2002-0082097-A1). Water conveyed from a beginning point of a conveyor belt elevation system to an end point of a conveyor belt elevation system may be used to create a hydraulic gradient to assist in pushing a participant onto the conveyor belt and/or assist in pulling a participant off of the conveyor belt. The hydraulic gradient used in such a manner may assist in regulating the flow of participants through a conveyor belt elevation system as well as any water amusement park system to which the conveyor belt elevation system is a part of.

Figure 32:
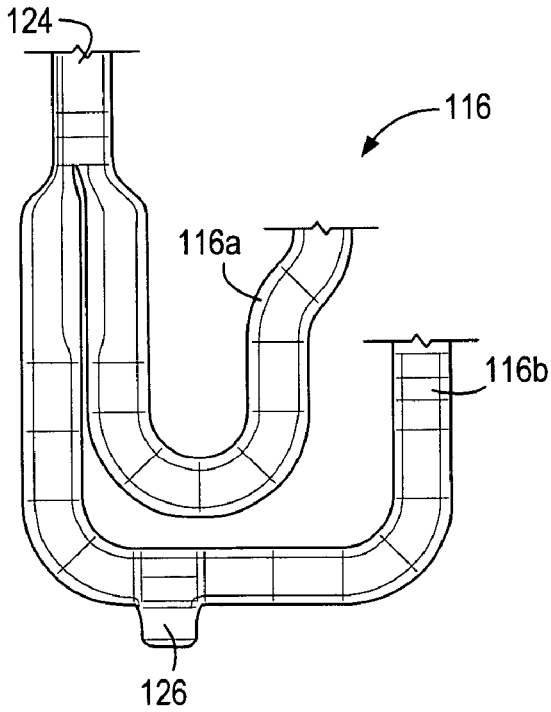
FIG. 32 depicts an embodiment of a portion of a path system of an amusement ride.

FIG. 32 depicts an embodiment of a portion of path system 116 of an amusement ride. Path system 116 may include several access points. An access point may include an entry/exit point of conveyor belt elevation system 124. Path system 116 may include access point 126. Access point 126 may include a point accessible by walking (e.g., stairs). Path system 116 may include path 116*a* and path 116*b*. FIG. 32 depicts how a path system may diverge and split allowing participants to choose different paths. Access points may include a mechanism to stabilize participant carriers In some embodiments, path 116*a* and/or path 116*b* may include a queue line which funnel participants in a controlled manner to conveyor belt elevation system 124. Using two or more queue lines to funnel participants to an elevation system (especially an elevation system which may handle several participants at a time (e.g., wide enough to handle two participants next to each other)) may increase the loading efficiency of an amusement ride.

Figure 33:
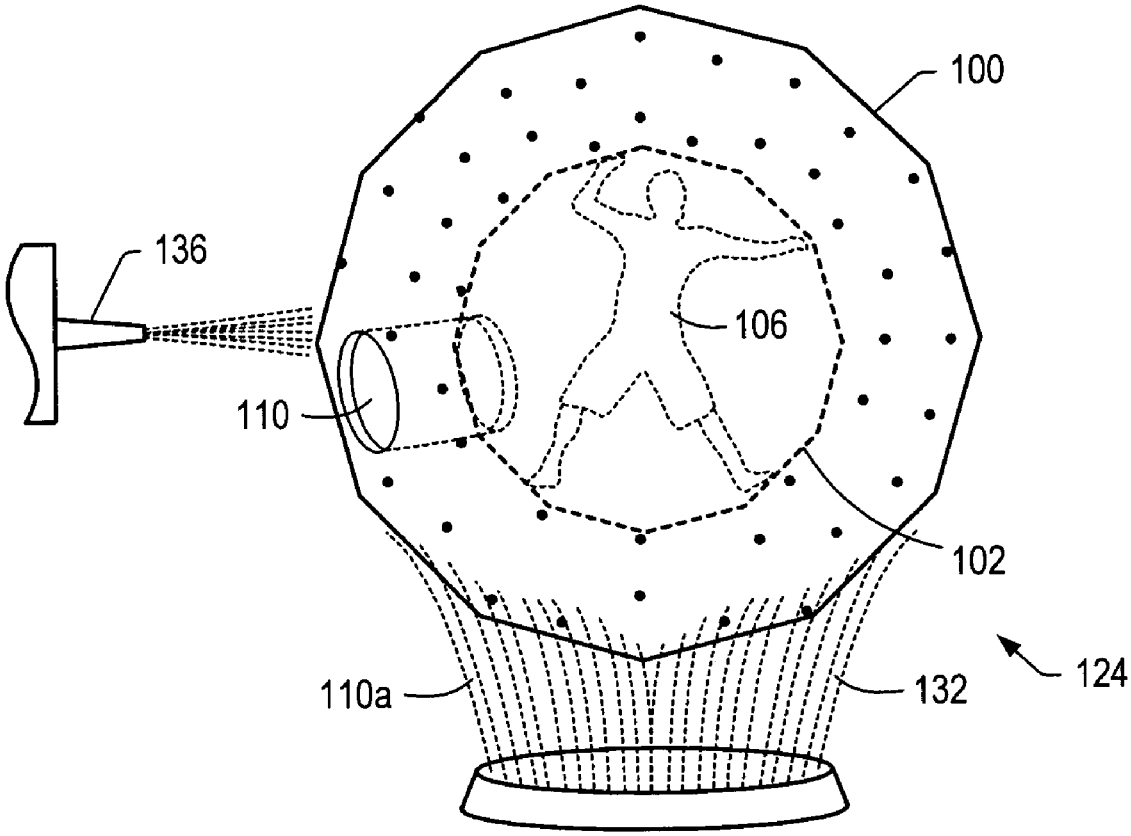
FIG. 33 depicts an embodiment of a fluid enhanced elevation system.

FIG. 33 depicts an embodiment of fluid enhanced elevation system 124. Fluid enhanced elevation system 124 may include opening 110*a*. Fluid 132 may pass through the opening at an increased pressure. Fluids may include liquids (e.g., water) and/or gases (e.g., air). Pressure of the fluid exiting the opening may be sufficient to elevate participant 106/rollable carrier 100 to a predetermined height (dependent upon the pressure of the fluid used as well as the weight of the rollable carrier and any participants).

In some embodiments, a high velocity low volume jet 136 as depicted in FIG. 33 may be used to push participant 106/rollable carrier 100 off of activated fluid enhanced horizontally to better push the rollable carrier participant off of the fluid enhanced elevation system.

Examples of systems which may be modified for use to elevate and/or move a participant and/or rollable carrier with fluids (e.g., air) are illustrated in U.S. Pat. No. 6,083,110 to Kitchen et al., which is incorporated by reference as if fully set forth herein.

Fluid enhanced elevation systems, in some embodiments, may include "wind tunnels." FIG. 13 depicts an embodiment of an amusement park ride including fluid enhanced elevation system 124*b*. The specific embodiment depicted in FIG. 13 includes a wind tunnel 124*b*. Large fans, for example, may be used to generate blasts of high velocity winds. These high velocity winds may be directed into portions of an amusement ride. Blasts of high velocity winds may assist in propelling a rollable carrier along a portion of the amusement ride. The portion of the amusement ride may include an enclosed conduit through which the rollable carrier travels. An enclosed conduit may assist in funneling generated high velocity winds such that the energy generated is used to a maximum effect.

Figure 34:
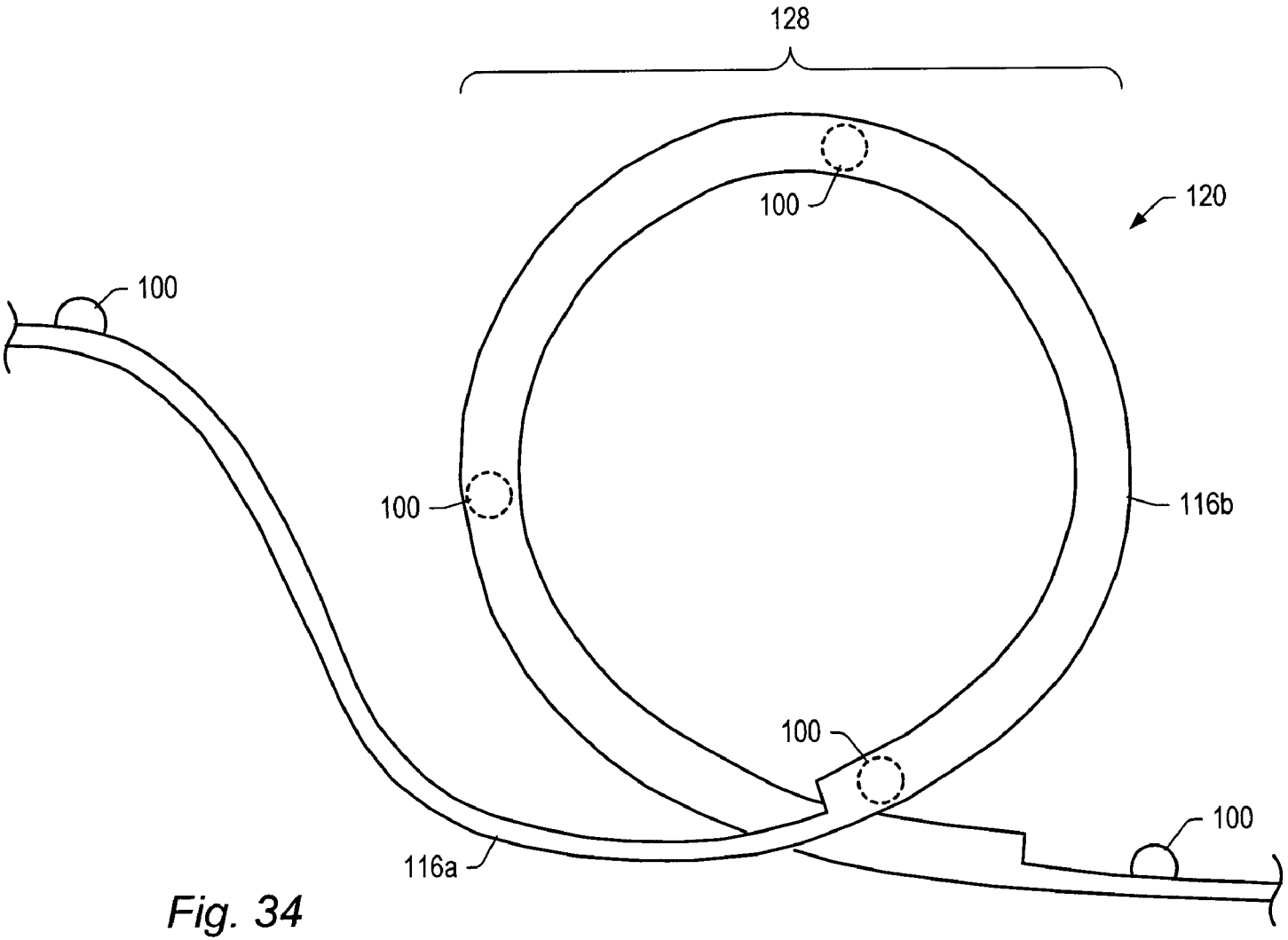
FIG. 34 depicts an embodiment of a portion of an amusement ride including an amusement affect.

FIG. 34 depicts an embodiment of a portion of amusement ride 120 including an amusement element 128. Amusement element 128 depicted in FIG. 34 includes a 360° loop to further enhance the enjoyment of participants. FIG. 34 also depicts path system 116 along which rollable carriers 100 are conveyed. Path system 116 may include open portions of the path system designated 116*a* in FIG. 34. Path system 116 may include enclosed portions of the path system designated 116*b* in FIG. 34. Enclosed portions 116*b* may function to ensure the rollable carriers stay within the path system. Enclosed portions 116*b* may also work in combination with elevation systems which benefit from an enclosed path system (e.g., pressure based elevation systems).

Figure 35:
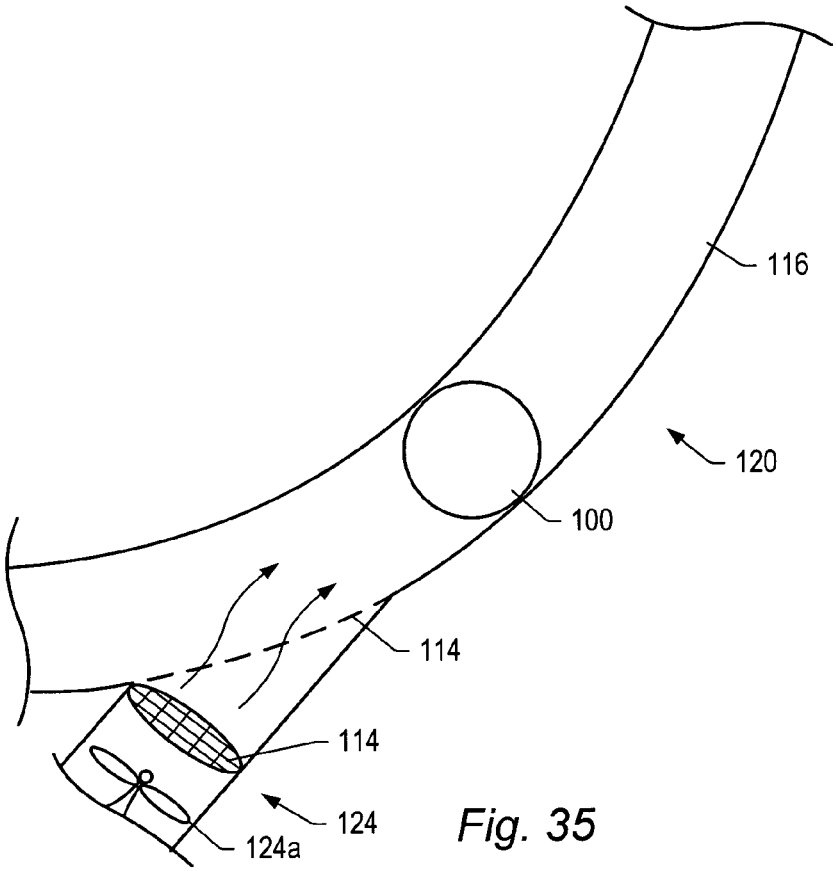
FIG. 35 depicts an embodiment of a portion of an amusement ride including an elevation system.

FIG. 35 depicts an embodiment of a portion of amusement ride 120 including an elevation system 124. Amusement ride 120 may include enclosed path system 116 through which rollable carriers 100 are conveyed. Elevation system 124 may include a large fan 124*a* which may provide high velocity winds functioning to propel the rollable carriers through the path system (e.g., from a first lower elevation to a second higher elevation). Elevation system 124 may include restraints 114. Restraints 114 may function to inhibit rollable carriers and/or participants from contacting/interfering with fan 124*a*.

Rollable carrier may be blown through a portion of a path system in some embodiments. In some embodiments, a rollable carrier may pulled through a portion of a path system using a reduced pressure system. Reducing the air pressure in one end of an enclosed conduit may pull a rollable carrier through the conduit towards the end of the enclosed conduit. A reduced pressure system may function as an elevation system. The reduced pressure system may pull one or more rollable carriers through a portion of a path system which includes going from a lower elevation to a relatively higher elevation.

A wind tunnel and a reduced pressure system may be designed based on similar mechanical systems and principals. One or more motorized fans may be used to generate winds up to 200 mph to push and/or pull a rollable carrier through a path system. Either embodiment may function more efficiently if a portion of the path system through which a rollable carrier is conveyed using air pressure includes a substantially enclosed conduit. An enclosed conduit (one or more ends of the conduit may be open) may assist in more efficiently channeling the energy produced from a pressure controlling system (e.g., motorized fans).

Figure 36:
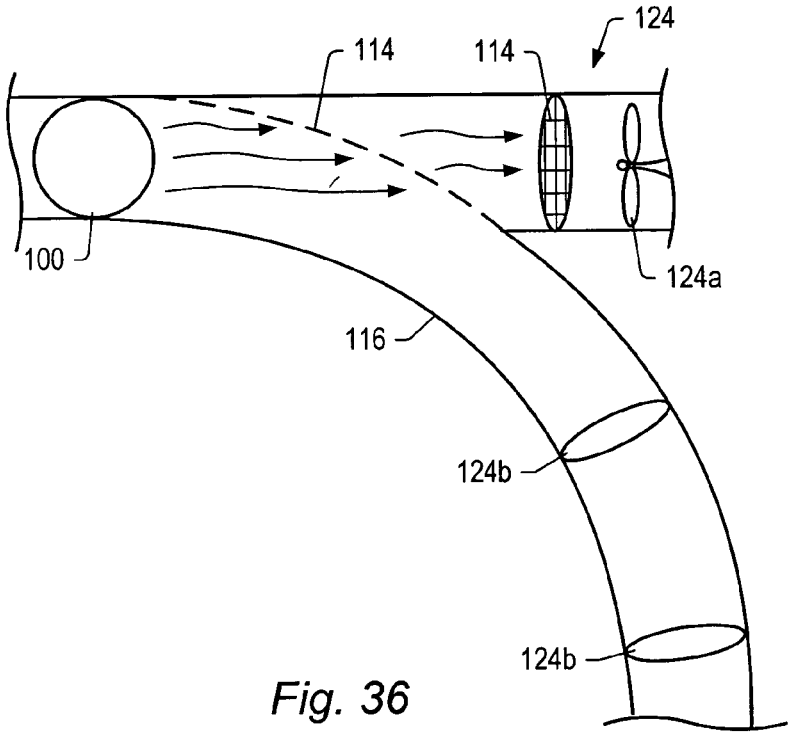
FIG. 36 depicts an embodiment of a portion of an amusement ride including an elevation system.

FIG. 36 depicts an embodiment of a portion of amusement ride 120 including an elevation system 124. Amusement ride 120 may include enclosed path system 116 through which rollable carriers 100 convey. Elevation system 124 may include a large fan 124*a* which may reduce pressure within a portion of the enclosed path system functioning to "pull" the rollable carriers through the path system (e.g., from a first lower elevation to a second higher elevation). Elevation system 124 may include restraints 114. Restraints 114 may function to inhibit rollable carriers and/or participants from contacting/interfering with fan 124*a*. Elevation system 124 may include one or more gates 124*b*. Gates 124*b* along with a rollable carrier may function to create a fully enclosed space from which it is easier for fan 124*a* to evacuate air from. As air is evacuated from the fully enclosed space, pressure within the space will be reduced drawing the rollable carrier through the space. Fan 124*a* may draw the rollable carrier past the highest elevation of the portion of the amusement ride, after which gravity may take over as the conveying force for the rollable carrier. Gates 124*b* may be hinged. The hinges may allow the gates to only move one way, allowing rollable carriers to though the gates in only one direction.

In some embodiments, a cross section of a conduit forming a portion of a path system may substantially correspond to a cross section of a portion of a rollable carrier. A shape and/or size of the cross section of a portion of the rollable carrier may correspond to a cross section of a conduit forming a portion of a path system. Cross sections of a rollable carrier and a portion of a path system may correspond such that when the rollable carrier enters the portion of the path system (e.g., a conduit) the rollable carrier substantially forms a seal between the rollable carrier and the portion of the path system. Advantages of corresponding cross sections of a rollable carrier and a portion of a path system sealing off at least one end of the portion of the path system such that airflow between the outer surface of the rollable carrier and the inner surface of the portion of the path system is reduced. It is not necessary for airflow between the rollable carrier and the portion of the path system to be eliminated. Reducing the airflow may increase the efficiency of a pressure based elevation system.

It may be counterproductive to manufacture the portion of the path system with an inner cross section which so closely matches the outer cross section of the rollable carrier such that airflow between the two is substantially eliminated. Such an embodiment may lead to increased friction between the surfaces of the rollable carrier and the path system. Friction may increase to a point such that the disadvantages of the increasing friction over the advantages of restricting airflow between the surfaces of the rollable carrier and the path system.

Airflow between the inner surface of a portion of the path system and the outer surface of a rollable carrier may decrease the efficiency of a pressure based elevation system. Airflow may be inhibited between the inner surface of a portion of the path system and the outer surface of a rollable carrier while still allowing a rollable carrier sufficient room to roll through the path system.

It should be noted that although amusement ride embodiments described herein are designed with a rollable carrier in mind, the rollable carrier may in some instances not roll along portions of the path system. For example, the rollable carrier may not roll while being conveyed from a lower elevation to a relatively higher elevation using an elevation system. In one example, a pressure based elevation system may effectively pull/push a rollable carrier through a portion of a path system in such a manner so that the rollable carrier may actually slide along a surface of the path system at least for portions of the amusement ride. This phenomenon may not be attributed so much to the particular design of the rollable carrier but to particular conveying force applied to the rollable carrier used to propel the rollable carrier. For example, a rollable carrier may be pulled or pushed through a portion of the path system using a pressure based elevation system with enough force such that at times the rollable carrier does not actually roll end over end.

In some embodiments, a motorized fan may be coupled to a path system. The motorized fan may be oriented with respect to the path system such that the fan blows air through at least a portion of the path system. One or more fans may combine to blow gusts of wind which may reach up to 200 mph through a portion of the path system. The speed of the fan blades and consequently the winds generated may be controlled by remote systems. Systems used to control motorized fans may be at least partially or fully automated.

In some embodiments, only one rollable carrier may be allowed to travel through a portion of a path system using a pressure based elevation system. Allowing more than one rollable carrier to enter the portion of the path system may inhibit winds generated from a fan from applying pressure to a first rollable carrier already traveling through the portion. In a system where a fan generates winds to push rollable carriers through the portion of the path system, more than one rollable carrier may be pushed through at a time, however attempting to push more than one rollable carrier through the portion of the path system may greatly increase the load requirements of the fans powering the system.

In some embodiments, a pressure based elevation system may "pull" a rollable carrier through a portion of a path system. In such an embodiment pressure ahead of the rollable carrier may be reduced along the path system in order to pull the rollable carrier through the path system. The portion of the path which incorporates the pressure based elevation system may be substantially enclosed to increase the efficiency of the pressure based elevation system.

In some embodiments, a motorized fan may be coupled to at least one end of a portion of a path system. The fan may remove air from the portion of the path system in order to reduce pressure within the portion of the path system. As a rollable carrier enters a beginning of the portion of the path system the rollable carrier may substantially seal the beginning of the portion of the path system increasing the vacuum created by the fan.

A "gate" may temporarily seal an end of the portion of the path system. Sealing the end of the portion of the path system may increase the force of the vacuum created by the fan within the portion of the path system. When a rollable carrier enters the beginning of the portion of the path system it creates a substantially sealed chamber when used in combination with a gate system. The chamber is sealed except for an opening coupled to the fan which is removing air and reducing pressure within the created "chamber."

In some embodiments, an elevation system may include a system based on an Archimedes screw. The "screw conveyor" is a direct descendant of the Archimedes screw. However, while the Archimedes screw lifts fluids trapped within cavities formed by its inclined blades, the screw conveyor propels dry bulk materials (powders, pellets, flakes, crystals, granules, grains, etc.) through the pushing action of its rotating blades. Also, most screw conveyers in use today have a single blade, while modern Archimedes screws typically have two or three blades.

Greek mathematician and physicist Archimedes is acknowledged as the inventor of the screw conveyor in 235-240 B.C., and essentially his design has not changed since then.

Screw conveyors are one of the oldest and simplest methods for moving bulk materials and consist primarily of a conveyor screw rotating in a stationary trough. Material placed in the trough is moved along its length by rotation of the screw which is supported by hanger bearings. Inlets, outlets, gates, and other accessories control the material and its disposition.

Screw conveyors are compact, easily adapted to congested locations and can be mounted horizontal, vertical, and in inclined configurations. Their supports are simple and easily installed.

When an Archimedes screw is tilted, "buckets" that can trap water are formed between the blades. These buckets appear to move upward when the screw is rotated, carrying the water within them. The screw collects water from the lower reservoir, where the buckets are formed, and empties it into the upper reservoir, where the buckets are unformed. When operated manually it is rotated by a crank or by a man walking around the circumference of the outer cylinder in a treadmill manner.

In modern industrial screws, the outer cylinder is usually fixed and the blades attached to the inner cylinder are rotated within it. This allows the top half of the outer cylinder to be eliminated so that a stationary trough is formed from the bottom half of the outer cylinder. Such a construction permits easy access to the interior of the screw, in order to remove debris and for routine maintenance. In addition, the stationary outer cylinder relieves the moving blades and inner cylinder of some of the weight of the water. A disadvantage of this design is that water can leak down through the small gap between the moving blades and the stationary trough. However, this leakage can be considered an advantage in that it allows the screw to drain when it stops rotating.

The Archimedes screw has had a resurgence in recent years because of its proven trouble-free design and its ability to lift wastewater and debris-laden water effectively. It has also proved valuable in installations where damage to aquatic life must be minimized.

The amount of water lifted per unit time can also be increased by increasing the rotational velocity of the screw.

However, there is a practical limit to how fast one can rotate the screw. A handbook on the design and operation of Archimedes screws states that, based on field experience, the rotational velocity of a screw in revolutions per minute should be no larger than $50/D^{2/3}$, where D is the diameter of the outer cylinder in meters. Thus a screw with an outside diameter of 1 m should have a maximum rotational velocity of 50 rpm. If the screw is rotated much faster, turbulence and sloshing prevent the buckets from being filled and the screw simply churns the water in the lower reservoir rather than lifting it.

A discussion of ways in which to optimize the design of an Archimedes screw may be found in Rorres; "The Turn of the Screw: Optimal Design of an Archimedes Screw"; January, 2000; Journal of Hyrdraulic Engineering, pgs. 72-80, which is incorporated by reference as if fully set forth herein. Examples of hydraulic screw pumps are illustrated in U.S. Pat. No. 5,073,082 to Radlik, which is incorporated by reference as if fully set forth herein.

Within the context of amusement rides screw conveyors may be used to convey participant carriers (e.g., rollable carriers) from a first lower elevation to a second higher elevation. Within the context of water based amusement rides screw conveyors may be used to convey participant carriers (e.g., rollable carriers) and/or water from a first lower elevation to a second higher elevation.

In some embodiments, a screw conveyor may transport participant carriers and not transport water. Advantages of not transporting water along with participant carriers may at least include increased safety for a participant within the participant carrier. Water transported with a participant carrier could increase drowning risks, especially if an outer casing or enclosure is not transparent allowing amusement park workers to observe participants. Another advantage is that an inner screw of the screw conveyor would not need to provide a watertight seal if water were not being transported.

Not requiring a watertight seal within a screw conveyor elevation system may reduce construction costs of the system. "Blades" of the screw may be formed of a porous material including grids formed from rods or bands of material (e.g., much like a rigid, semi-rigid, or flexible net). This would decrease construction materials and cost, as well as decreasing the weight of inner screw of the elevations system. Decreasing the weight of the inner screw of the system would concurrently decrease energy required by the system to turn the inner screw of the elevation system. Forming the blades of the screw from porous materials may facilitate airflow through the elevation system. Increasing airflow may increase the comfort and safety of participants.

In some embodiments, a screw conveyor elevation system may convey participant carriers and water. In this way an elevation system may provide a dual function. Conveying water from a first lower elevation to a second higher elevation within a water amusement ride is a major concern with water amusement parks. An elevation system capable of conveying participants as well as water is advantageous.

In some embodiments, a screw conveyor elevation system may include blades where the outer portion of the blades is non porous and forms a substantially watertight seal with an outer cylinder of the elevation system.

Figure 37:
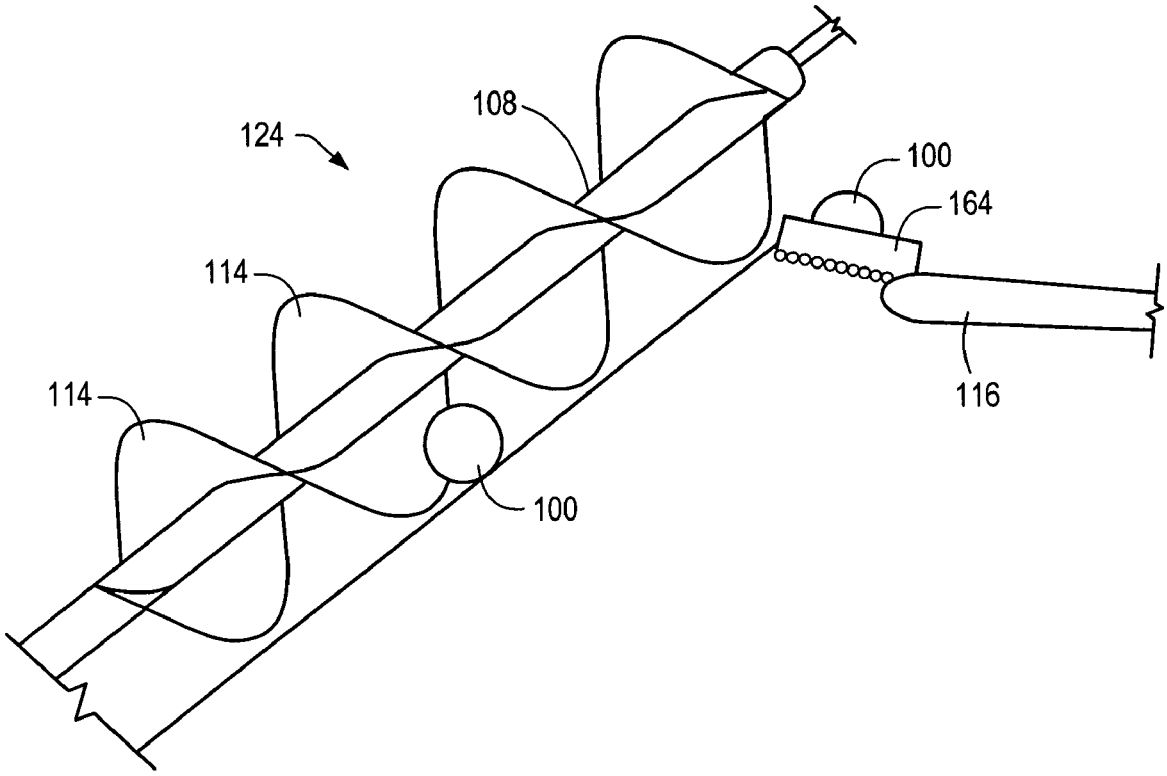
FIG. 37 depicts an embodiment of an Archimedes conveyor inspired elevation system for an amusement ride.

FIG. 37 depicts an embodiment of screw conveyor elevation system 124 for an amusement ride. Elevation system 124 may include discharge end 164 elongated member 108, and restraints 114. Elevation system 124 may convey rotatable carriers 100 from a first lower elevation to a second higher elevation. Restraints 114 may be coupled to elongated member 108. Restraints 114 may include one or more continuous sheets or "blades" which wind around the elongated member forming something akin to an Archimedes screw. Rotatable carriers 100 may be discharged from discharge end 164 into path system 116. Elongated member 108 may turn or rotate about an axis. Rotating the elongated member may rotate restraints 114. Rotating restraints 114 may convey rotatable carriers 100 to discharge end 164.

In some embodiments, an elevation system may include a water-lock system. These systems may be used to increase elevation and/or decrease elevation. In certain embodiments, an exit point of a first water ride of a continuous water ride may have an elevation below an entry point of a second water ride of the continuous water ride. In some embodiments, the water lock system includes a chamber for holding water coupled to the exit point of the first water ride and the entry point of the second water ride. A chamber is herein defined as an at least partially enclosed space. The chamber includes at least one outer wall, or a series of outer walls that together define the outer perimeter of the chamber. The chamber may also be at least partially defined by natural features such as the side of a hill or mountain. The walls may be substantially watertight. The outer wall of the chamber, in certain embodiments, extends below an upper surface of the first water ride and above the upper surface of the second water ride. The chamber may have a shape that resembles a figure selected from the group consisting of a square, a rectangle, a circle, a star, a regular polyhedron, a trapezoid, an ellipse, a U-shape, an L-shape, a Y-shape or a figure eight, when seen from an overhead view.

A first movable member may be formed in the outer wall of the chamber. The first movable member may be positioned to allow participants and water to move between the exit point of the first water ride and the chamber when the first movable member is open during use. A second movable member may be formed in the wall of the chamber. The second movable member may be positioned to allow participants and water to move between the entry point of the second water ride and the chamber when the second movable member is open during use. The second movable member may be formed in the wall at an elevation that differs from that of the first movable member.

In certain embodiments, the first and second movable members may be configured to swing away from the chamber wall when moving from a closed position to an open position during use. In certain embodiments, the first and second movable members may be configured to move vertically into a portion of the wall when moving from a closed position to an open position. In certain embodiments, the first and second movable members may be configured to move horizontally along a portion of the wall when moving from a closed position to an open position.

A bottom member may also be positioned within the chamber. The bottom member may be configured to float below the upper surface of water within the chamber during use. The bottom member may be configured to rise when the water in the chamber rises during use. In certain embodiments, the bottom member is substantially water permeable such that water in the chamber moves freely through the bottom member as the bottom member is moved within the chamber during use. The bottom member may be configured to remain at a substantially constant distance from the upper surface of the water in the chamber during use. The bottom member may include a wall extending from the bottom member to a position above the upper surface of the water. The wall may be configured to prevent participants from moving to a position below the bottom member. A floatation member may be positioned upon the wall at a location proximate the upper surface of the water. A ratcheted locking system may couple the bottom member to the inner surface of the chamber wall. The ratcheted locking system may be configured to inhibit the bottom member from sinking when water is suddenly released from the chamber. The ratcheted locking system may also include a motor to allow the bottom member to be moved vertically within the chamber. There may be one or more bottom members positioned within a single chamber. The bottom member may incorporate fluid jets to direct and/or propel participants in or out of the chamber.

The lock system may also include a substantially vertical first ladder coupled to the wall of the bottom member and a substantially vertical second ladder coupled to a wall of the chamber. The first and second ladders, in certain embodiments, are positioned such that the ladders remain substantially aligned as the bottom member moves vertically within the chamber. The second ladder may extend to the top of the outer wall of the chamber. The ladders may allow participants to exit from the chamber if the lock system is not working properly.

In certain embodiments, water may be transferred into and out of the water lock system via the movable members formed within the chamber wall. Opening of the movable members may allow water to flow into the chamber from the second water ride or out of the chamber into the first water ride.

The lock system may also include a controller for operating the system. The automatic controller may be a computer, programmable logic controller, or any other control device. The controller may be coupled to the first movable member, the second movable member, and the first water control system. The controller may allow manual, semi-automatic, or automatic control of the lock system. The automatic controller may be connected to sensors positioned to detect if people are in the lock or not, blocking the gate, or if the gate is fully opened or fully closed or the water levels within the chambers.

In certain embodiments, the participants may be floating in water during the entire transfer from the first water ride to the second water ride. The participants may be swimming in the water or floating upon a floatation device. Preferably, the participants are floating on an inner tube, a floatation board, raft, or other floatation devices used by participants on water rides.

In certain embodiments, the lock system may include multiple movable members formed within the outer wall of the chamber. These movable members may lead to multiple water rides and/or continuous water ride systems coupled to the chamber. The additional movable members may be formed at the same elevational level or at different elevations.

In some embodiments, a first and second movable members formed in the outer wall of a chamber of a lock system may be configured to move vertically into a portion of the wall when moving from a closed position to an open position. The members may be substantially hollow, and have holes in the bottom configured to allow fluid flow in and out of the member. In an open position, the hollow member may be substantially filled with water. To move the member to a closed position, compressed air from a compressed air source may be introduced into the top of the hollow member through a valve, forcing water out of the holes in the bottom of the member. As the water is forced out and air enters the member, the buoyancy of the member may increase and the member may float up until it reaches a closed position. In this closed position, the holes in the bottom of the member may remain submerged, thereby preventing the air from escaping through the holes. To move the member back to an open position, a valve in the top of the member may be opened, allowing the compressed air to escape and allowing water to enter through the holes in the bottom. As water enters and compressed air escapes, the gate may lose buoyancy and sink until it reaches the open position, when the air valve may be closed again.

An advantage to the pneumatic gate system may be that water may be easily transferred from a higher lock to a lower one over the top of the gate. This system greatly simplifies and reduces the cost of valves and pumping systems between lock levels. The water that progressively spills over the top of the gate as it is lowered is at low, near-surface pressures in contrast to water pouring forth at various pressures in a swinging gate lock system. This advantage makes it feasible to eliminate some of the valves and piping required to move water from a higher lock to a lower lock.

In certain embodiments a pneumatic or hydraulic cylinder may be used to vertically move a gate system. An advantage to this system may be that the operator has much more control over the gate than with a gate system operating on a principle of increasing and decreasing the buoyancy. More control of the gate system may allow the gates to be operated in concert with one another, as well as increasing the safety associated with the system. The gate may be essentially hollow and filled with air or other floatation material such as Styrofoam, decreasing the power needed to move the gate.

While described as having only a single chamber coupled to two water rides forming an amusement ride, it should be understood that multiple chambers may be interlocked to couple two or more water rides of a first amusement ride and/or a second amusement ride. By using multiple chambers, a series of smaller chambers may be built rather than a single large chamber. In some situations it may be easier to build a series of chambers rather than a single chamber. For example, use of a series of smaller chambers may better match the slope of an existing hill. Another example is to reduce water depths and pressures operating in each chamber so as to improve safety and reduce structural considerations resulting from increased water pressure differentials. Another example is the use of multiple chambers to increase aesthetics or ride excitement. Another is the use of multiple chambers to increase overall speed and participant throughput of the lock.

The participants may be transferred from the first water ride to the second water ride by entering the chamber and altering the level of water within the chamber. The first movable member, coupled to the first water ride is opened to allow the participants to move into the chamber. The participants may propel themselves by pulling themselves along by use of rope or other accessible handles or be pushed directly with fluid jets or be propelled by a current moving from the lower water ride toward the chamber. The current may be generated using fluid jets positioned along the inner surface of the chamber. Alternatively, a current may be generated by altering the level of water in the first water ride. For example, by raising the level of water in the first water ride a flow of water from the first water ride into the chamber may occur.

After the participants have entered the chamber, the first movable member is closed and the level of water in the chamber is altered. The level may be raised or lowered, depending on the elevation level of the second water ride with respect to the first water ride. If the second water ride is higher than the first water ride, the water level is raised. If the first water ride is at a higher elevation than the second water ride, the water level is lowered. As the water level in the chamber is altered, the participants are moved to a level commensurate with the upper surface of the second water ride. While the water level is altered within the chamber, the participants remain floating proximate the surface of the water. A bottom member preferably moves with the upper surface of the water in the chamber to maintain a relatively constant and safe depth of water beneath the participants. The water level in the chamber, in certain embodiments, is altered until the water level in the chamber is substantially equal to the water level of the second water ride. The second movable member may now be opened, allowing the participants to move from the chamber to the second water ride. In certain embodiments, a current may be generated by filling the chamber with additional water after the level of water in the chamber is substantially equal to the level of water outside the chamber. As the water is pumped in the chamber, the resulting increase in water volume within the chamber may cause a current to be formed flowing from the chamber to the water ride. When the movable member is open, the formed current may be used to propel the participants from the chamber to a water ride. Thus, the participants may be transferred from a first water ride to a second water ride without having to leave the water forming an amusement ride. The participants are thus relieved of having to walk up a hill. The participants may also be relieved from carrying any floatation devices necessary for the amusement ride.

Figure 38:
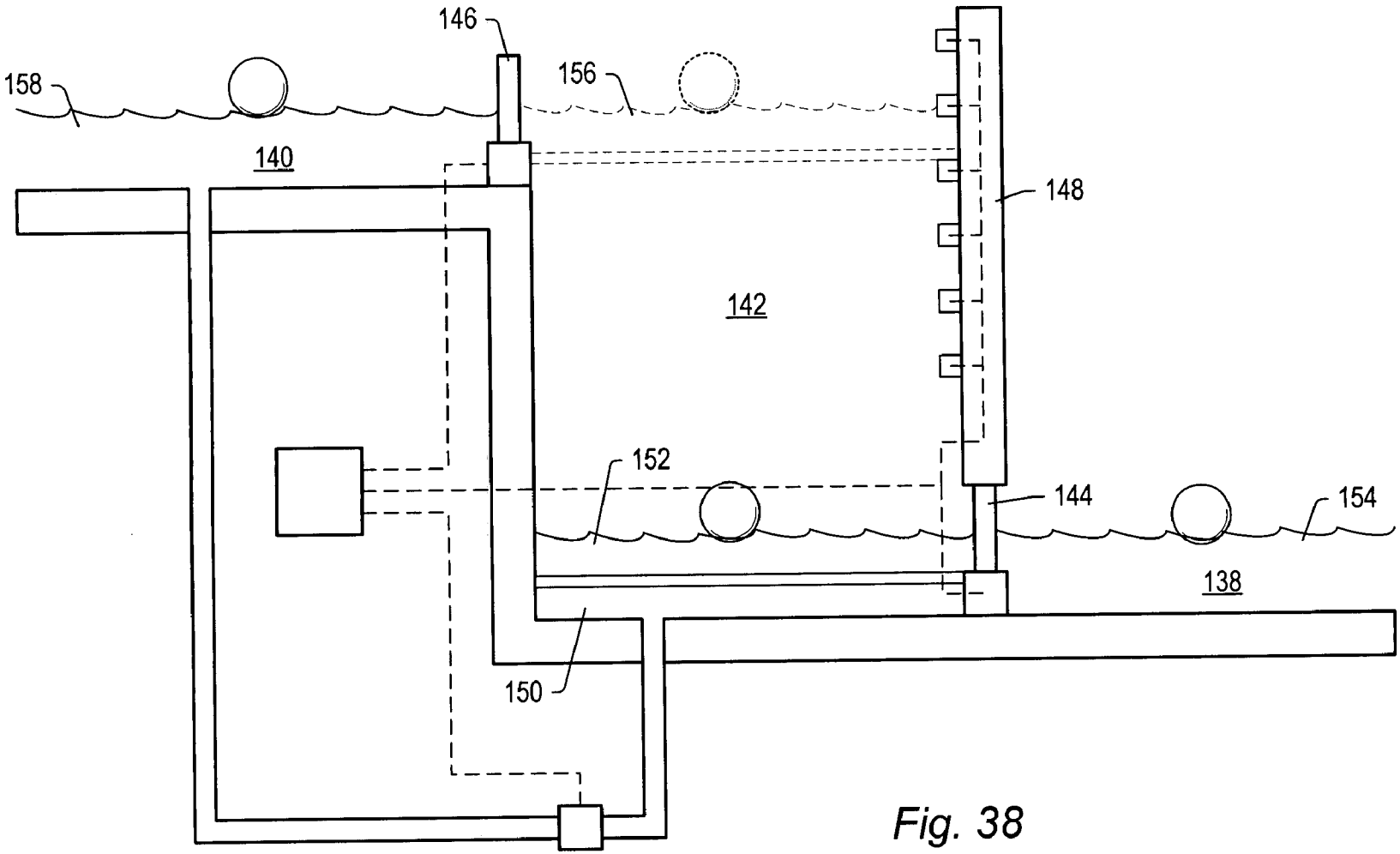
FIG. 38 depicts a cross-sectional side view of an embodiment of a water lock system with one chamber and a conduit coupling the upper body of water to the chamber.

FIG. 38 depicts a water lock system for conveying a person or a group of people (i.e., the participants) from a lower body of water 138 to an upper body of water 140. It should be understood that while a system and method of transferring the participants from the lower body of water to the upper body of water is herein described, the lock system may also be used to transfer participants from an upper body to a lower body, by reversing the operation of the lock system. The upper and lower bodies of water may be receiving pools (i.e., pools positioned at the end of a water ride), entry pools (i.e., pools positioned to at the entrance of a water ride), another chamber of a water lock system, or a natural body of water (e.g., a lake, river, reservoir, pond, etc.). The water lock system, in certain embodiments, includes at least one chamber 142 coupled to the upper and lower bodies of water. First movable member 144 and second movable member 146 may be formed in an outer wall 148 of the chamber. First movable member 144 may be coupled to lower body of water 138 such that the participants may enter chamber 142 from the lower body of water while the water 150 in the chamber is at level 152 substantially equal to upper surface 154 of the lower body of water. After the participants have entered chamber 142, the level of water within the chamber may be raised to a height 156 substantially equal to upper surface 158 of upper body of water 140. Second movable member 146 may be coupled to upper body of water 140 such that the participants may move from chamber 142 to the upper body of water after the level of water in the chamber is raised to the appropriate height.

Outer wall 148 of chamber 142 may be coupled to both lower body of water 138 and upper body of water 140. Outer wall 148 may extend from a point below upper surface 154 of lower body of water 138 to a point above upper surface 158 of upper body of water 140. Water lock systems may be more fully described in U.S. patent application Ser. No. 09/952,036 and U.S. Pat. No. 6,475,095 which are all incorporated by reference herein.

In some embodiments, elevation systems may be designed to be entertaining and an enjoyable part of the water ride as well as the water rides of the amusement ride which the elevation system is connecting. For example, when the elevation system includes an uphill water slide, the entertainment value may be no less for the elevation system of the continuous water ride than for the connected water rides.

In some embodiments, an exit point of a second water ride of an amusement ride may be coupled to an entry point of a first water ride. Coupling the exit point of the second water ride to the entry point of the first water ride may form a true continuous water ride loop. The continuous water ride may include a second elevation system coupling the exit point of the second water ride to the entry point of the first water ride. The second elevation system may include any of the elevation systems described for use in coupling an exit point of the first water ride to the entry point of the second water ride. The second elevation system may be a different elevation system than the first elevation system. For example, the first elevation system may be an uphill water slide and the second water elevation system may be a conveyor belt system.

In some embodiments, a continuous water ride may include one or more floating queue lines. Floating queue lines may be more fully described in U.S. Patent Publication No. 20020082097. Floating queue lines may assist in coupling different portions of a continuous water ride. Floating queue line systems may be used for positioning participants in an orderly fashion and delivering them to the start of a ride at a desired time. In certain embodiments, this system may include a channel (horizontal or otherwise) coupled to a ride on one end and an elevation system on the other end. It should be noted, however, that any of the previously described elevation systems may be coupled to the water ride by the floating queue line system. Alternatively, a floating queue line system may be used to control the flow of participants into the continuous water ride from a dry position within a station.

In use, participants desiring to participate on a water ride may leave the body of water and enter the floating queue line. The floating queue line may include pump inlets and outlets similar to those in a horizontal channel but configured to operate intermittently to propel participants along the queue line, or the inlet and outlet may be used solely to keep a desired amount of water in the queue line. In the latter case, the channel may be configured with high velocity low volume jets that operate intermittently to deliver participants to the end of the queue line at the desired time.

In certain embodiments, the water moves participants along the floating queue line down a hydraulic gradient or bottom slope gradient. The hydraulic gradient may be produced by out-flowing the water over a weir at one end of the queue after the participant enters the ride to which the queue line delivers them, or by out-flowing the water down a bottom slope that starts after the point that the participant enters the ride. In certain embodiments, the water moves through the queue channel by means of a sloping floor. The water from the outflow of the queue line in any method can reenter the main channel, another ride or water feature/s, or return to the system sump. Preferably the water level and width of the queue line are minimized for water depth safety, participant control and water velocity. These factors combined deliver the participants to the ride in an orderly and safe fashion, at the preferred speed, with minimal water volume usage. The preferred water depth, channel width and velocity would be set by adjustable parameters depending on the type of riding rollable carrier, participant comfort and safety, and water usage. Decreased water depth may also be influenced by local ordinances that determine level of operator or lifeguard assistance, the preferred being a need for minimal operator assistance consistent with safety.

In some embodiments, amusement rides may include exits or entry points at different portion of the amusement ride. Floating queue lines coupling different portions and/or rides forming an amusement ride may include exit and/or entry points onto the continuous water ride. Exit/entry points may be used for emergency purposes in case of, for example, an unscheduled shutdown of the amusement water ride. Exit/entry points may allow participants to enter/exit the amusement water ride at various designated points along the ride during normal use of the amusement water ride. Participants entering/exiting the continuous water ride during normal use of the ride may not disrupt the normal flow of the ride depending on where the entry/exit points are situated along the course of the ride.

Embodiments disclosed herein provide an interactive control system for an amusement ride and/or portions of the amusement ride. In certain embodiments, the control system may include a programmable logic controller. The control system may be coupled to one or more activation points, participant detectors, and/or flow control devices. In addition, one or more other sensors may be coupled to the control system. The control system may be utilized to provide a wide variety of interactive and/or automated water features. In some embodiments, participants may apply a participant signal to one or more activation points. The activation points may send activation signals to the control system in response to the participant signals. The control system may be configured to send control signals to a water system, a light system, and/or a sound system in response to a received activation signal from an activation point. A water system may include, for example, a water effect generator, a conduit for providing water to the water effect generator, and a flow control device. The control system may send different control signals depending on which activation point sent an activation signal. The participant signal may be applied to the activation point by the application of pressure, moving a movable activating device, a gesture (e.g., waving a hand), interrupting a light beam, a participant identifier and/or by voice activation. Examples of activation points include, but are not limited to, hand wheels, push buttons, optical touch buttons, pull ropes, paddle wheel spinners, motion detectors, sound detectors, and levers.

The control system may be coupled to sensors to detect the presence of a participant proximate to the activation point. The control system may be configured to produce one or more control systems to active a water system, sound system, and/or light system in response to a detection signal indicating that a participant is proximate to an activation point. The control system may also be coupled to flow control devices, such as, but not limited to: valves and pumps. Valves may includes air valves and water valves configured to control the flow air or water, respectively, through a water feature. The control system may also be coupled to one or more indicators located proximate to one or more activation points. The control system may be configured to generate and send indicator control signals to turn an indicator on or off. The indicators may signal a participant to apply a participant signal to an activation point associated with each indicator. An indicator may signal a participant via a visual, audible, and/or tactile signal. For example, an indicator may include an image projected onto a screen.

In some embodiments, the control system may be configured to generate and send one or more activation signals in the absence of an activation signal. For example, if no activation signal is received for a predetermined amount of time, the control system may produce one or more control signals to activate a water system, sound system, and/or light system.

Throughout the system electronic signs or monitors may be positioned to notify participants or operators of various aspect of the system including, but not limited to: operational status of any part of the system described herein above; estimated waiting time for a particular ride; and possible detours around non operational rides or areas of high participant density.

In some embodiments, a water amusement park may include a cover or a screen. Screens may be used to substantially envelope or cover a portion of a water amusement park. Portions of the screen may be positionable. Positionable screen portions may allow portions of the park to be covered or uncovered. The decision to cover or uncover a portion of the water amusement park may be based on the weather. Inclement weather may prompt operators to cover portions of the water park with the positionable screens. While clear warm weather may allow operators to move the positionable screen so portions of the water amusement park remain uncovered. In some embodiments, amusement rides using rollable carriers may employ moveable screens even when there are clear skies if there exists a threat of high winds.

In some embodiments, positionable screens may be formed from substantially translucent materials. Translucent materials may allow a portion of the visible light spectrum to pass through the positionable screens. Translucent materials may inhibit transmittance of certain potentially harmful portions of the light spectrum (e.g., ultraviolet light). Filtering out a potentially harmful portion of the light spectrum may provide added health benefits to the water amusement park relative to uncovered water amusement parks. A non-limiting example of possible screen material may include Foiltech. Foiltech has an R protective value of about 2.5. A non-limiting example of possible screen material may include polycarbonates. Polycarbonates may have an R protective value of about 2. In some embodiments, multiple layers of screen material (e.g., polycarbonate) may be used. Using multiple layers of screen material may increase a screen materials natural thermal insulating abilities among other things. Portions of the screening system described herein may be purchased commercially at Arqualand in the United Kingdom.

In some embodiments, portions of the positionable screen may assist in collecting solar radiation. Solar radiation collected by portions of the positionable screen may be used to increase the ambient temperature in the area enclosed by the screen. Increasing the ambient temperature in enclosed portions of the water amusement park using collected solar radiation may allow the water amusement park to remain open to the public even when the outside temperature is uncomfortably cold and unconducive to typical outside activities.

In some embodiments, positionable screens may be used to enclose portions of a water amusement park. Enclosed areas of the water amusement park may function as a heat sink. Heat emanating from bodies of water within the enclosed area of the water amusement park may be captured within the area between the body of water and the positionable screens. Heat captured under the positionable screens may be recirculated back into the water. Captured heat may be recirculated back into the water using heat pumps and/or other common methods known to one skilled in the art.

In some embodiments, screens may be mounted on wheels and/or rollers. Screen may be formed from relatively light but strong materials. For example, panels may be formed from polycarbonate for other reasons described herein, while structural frameworks supporting these panels may be formed from, for example, aluminum. Lightweight, well-balanced, support structures on wheels/rollers might allow screens to be moved manually by only a few operators. Operators might simply push screens into position. Mechanisms may installed to assist operators in manually positioning screens (e.g., tracks, pulley mechanisms).

Examples of systems which facilitate movement of screens over bodies of water and/or channels (e.g., track based systems) are illustrated in U.S. Pat. No. 4,683,686 to Ozdemir and U.S. Pat. No. 5,950,253 to Last, each of which is incorporated by reference as if fully set forth herein.

In some embodiments, some water amusement park areas may include immovable screens substantially enclosing the water amusement area (e.g., a dome structure). While other water amusement areas may remain uncovered year round. Channels may connect different water amusement areas. Channels may include portions of a natural river. Channels may include portions of man-made rivers or reservoirs. Channels may include portions of a natural or man-made body of water (e.g., a lake). The portions of the natural or man-made body of water may include artificial or natural barriers to form a portion of the channel in the body of water. Channels may include positionable screens as described herein. In some embodiments, an entire waterpark may include permanent and/or positionable screens covering the waterpark. In some embodiments, only portions of a waterpark may include permanent and/or positionable screens.

There are advantages to covering the channels and/or portions of the park connected by the channels as opposed to covering the entire park in, for example, one large dome. One advantage may be financial, wherein enclosing small portions and/or channels of a park is far easier from an engineering standpoint and subsequently much cheaper than building a large dome. Channels that extend for relatively long distances may be covered far more easily than a large dome structure extending over the same distance which covers the channel and much of the surrounding area. It is also far easier to retract portions of the screens described herein to selectively expose portions of a waterpark than it is to selectively retract portions of a dome.

Screen systems may be more fully described in U.S. patent application Ser. No. 10/693,654 to Henry et al. which is incorporated by reference as if fully set forth herein.

In some embodiments, water amusement parks may include participant identifiers. Participant identifiers may be used to locate and/or identify one or more participants at least inside the confines of the water amusement park. Participant identifiers may assist control systems in the water amusement park. Participant identifiers may be considered as one portion of a water amusement park control system in some embodiments. Participant identifiers may be used for a variety of functions in the water amusement park.

In some embodiments, a plurality of personal identifiers may be used in combination with a water amusement park. Personal identifiers may be provided to each individual participant of the water amusement park. Personal identifiers may be provided for each member of staff working at the water amusement park. Within the context of this application the term "participant" may include anyone located in the confines of the water amusement park including, but not limited to, staff and/or patrons. A plurality of sensors may be used in combination with the personal identifiers. Personal identifiers may function as personal transmitters. Sensors may function as receiver units. Sensors may be positioned throughout the water amusement park. Sensor may be positioned, for example, at particular junctions (i.e., coupling points) along, for example, a continuous water ride. Sensors may be placed along, for example, floating queue lines, channels, entry/exit points along water rides, and/or entry/exit points between portions of the water amusement park. Personal identifiers working in combination with sensors may be used to locate and/or identify participants.

In some embodiments, personal identifiers and/or sensors may be adapted for ultrasonic, or alternatively, for radio frequency transmission. Personal identifiers and/or sensors may operate on the same frequency. Identification of individual personal identifiers may be achieved by a pulse timing technique whereby discrete time slots are assigned for pulsing by individual units on a recurring basis. Pulses received from sensors may be transmitted to decoder logic which identifies the locations of the various transmitter units in accordance with the time interval in which pulses are received from various sensors throughout the water amusement park. A status board or other display device may display the location and/or identity of the participant in the water amusement park. Status of a participant may be displayed in a number of ways. Status of a participant may be displayed as some type of icon on a multi-dimensional map. Status of a participant may be displayed as part of a chart displaying throughput for a portion of the water amusement park.

In some embodiments, programming means may be provided for a participant identifier. Participant identifiers may be substantially identical in construction and electronic adjustment. Participant identifiers may be programmed to predetermined pulse timing slots by the programming means. Any participant may use any participant identifier. The particular pulse timing slot may be identified as corresponding with a particular participant using a programmer. Participant identifiers may be associated with a particular participant by positioning the participant identifier in a receptacle. The receptacle may be coupled to the programmer. Receptacles may function to recharge a power source powering the participant identifier. In some embodiments, a receptacle may not be necessary and the personal identifier may be associated in the water amusement park with a particular participant via wireless communication between the personal identifier and a programmer.

In some embodiments, participant identifiers may be removably coupled to a participant. The participant identifier may be band which may be coupled around an appendage of a participant. The band may be attached around, for example, an arm and/or leg of a participant. In some embodiments, identifiers may include any shape. Identifiers may be worn around the neck of a participant much like a medallion. In some embodiments, an identifier may be substantially attached directly to the skin of a participant using an appropriate adhesive. In some embodiments, an identifier may be coupled to an article of clothing worn by a participant. The identifier may be coupled to the article of clothing using, for example, a "safety pin", a plastic clip, a spring clip, and/or a magnetic based clip. In some embodiments, identifiers may be essentially "locked" after coupling the identifier to a participant. A lock may inhibit the identifier from being removed from the participant by anyone other than a staff member except under emergency circumstances. Locking the identifier to the participant may inhibit loss of identifiers during normal use of identifiers. In some embodiments, a participant identifier may be designed to detach from a participant under certain conditions. Conditions may include, for example, when abnormal forces are exerted on the participant identifier. Abnormal forces may result from the participant identifier becoming caught on a protrusion, which could potentially endanger the participant.

In some embodiments, circuitry and/or a power source may be positioned substantially in the personal identifiers. Positioning any delicate electronics in the personal identifier, such that material forming the personal identifier substantially envelopes the electronics, may protect sensitive portions of the personal identifier from water and/or corrosive chemicals typically associated with a water amusement park. Participant identifiers may be formed from any appropriate material. Appropriate materials may include materials that are resistant to water and corrosive chemicals typically associated with a water amusement park. Participant identifiers may be at least partially formed from materials which are not typically thought of as resistant to water and/or chemicals, however, in some embodiments materials such as these may be treated with anticorrosive coatings. In certain embodiments, participant identifiers may be formed at least partially from polymers.

In some embodiments, a personal identifier may be brightly colored. Bright colors may allow the identifier to be more readily identified and/or spotted. For example, if the identifier becomes decoupled from a participant the identifier may be more easily spotted if the identifier is several feet or more under water. In some embodiments, a personal identifier may include a fluorescent dye. The dye may be embedded in a portion of the personal identifier. The dye may further assist in spotting a lost personal identifier under water and/or under low light level conditions (e.g., in a covered water slide).

Personal identifiers which may be adapted to be used with the systems and methods described herein are more fully described in U.S. patent application Ser. No. 10/693,654 to Henry et al which is incorporated by reference herein.

Other components which may be incorporated into a participant identifier system are disclosed in the following U.S. Patents, herein incorporated by reference: a personal locator and display system as disclosed in U.S. Pat. No. 4,225,953; a personal locator system for determining the location of a locator unit as disclosed in U.S. Pat. No. 6,362,778; a low power child locator system as disclosed in U.S. Pat. No. 6,075,442; a radio frequency identification device as disclosed in U.S. Pat. No. 6,265,977; and a remote monitoring system as disclosed in U.S. Pat. No. 6,553,336.

In some embodiments, participant identifiers may be used as part of an automated safety control system. Participant identifiers may be used to assist in determining and/or assessing whether a participant has been separated from their rollable carrier. Sensors may be positioned along portions of a water amusement park. For example sensors may be placed at different intervals along a water amusement ride. Intervals at which sensors are placed may be regular or irregular. Placement of sensors may be based on possible risk of a portion of a water amusement ride. For example, sensors may be placed with more frequency along faster moving portions of a water amusement ride where the danger for a participant to be separated from their rollable carrier is more prevalent.

In some embodiments, rollable carrier identifiers may be used to identify a rollable carrier in a water amusement park. The rollable carrier identifier may be used to identify the location of the rollable carrier. The rollable carrier identifier may be used to identify the type of rollable carrier. For example, the rollable carrier identifier may be used to identify how many people may safely ride in the rollable carrier.

In some embodiments, sensors near an entry point of a portion of a water amusement ride may automatically assess a number of participant identifiers/participants associated with a particular rollable carrier. Data such as this may be used to assess whether a participant has been separated from their rollable carrier in another portion of the water amusement ride.

In some embodiments, an operator may manually input data into a control system. Data input may include associating particular participant identifier(s) and/or the number of participants with a rollable carrier.

In some embodiments, a combination of automated and manual operation of a safety control system may be used to initially assess a number of participants associated with a rollable carrier. For example, an operator may provide input to initiate a sensor or a series of sensors to assess the number of participants associated with the rollable carrier. The assessment may be conducted at an entry point of a water amusement ride.

In certain embodiments, personal identifiers may be used in combination with a recording device. The recording device may be positioned in a water amusement park. One or more recording devices may be used throughout the water amusement park. The participant identifier may be used to activate the recording device. The participant identifier may be used to remotely activate the recording device. The recording device may include a sensor as described herein. The identifier may automatically activate the recording device upon detection by the sensor coupled to the recording device. The participant may activate the recording device by activating the personal identifier using participant input (e.g., a mechanical button, a touch screen). The participant identifier may activate one or more recording devices at one or more different times and/or timing sequences. For example several recording devices may be positioned along a length of a downhill slide. A participant wearing a personal identifier may activate (automatically or upon activation with user input) a first recording device positioned adjacent an entry point of the slide. Activating the first recording device may then activate one or more additional recording devices located along the length of the downhill water slide. Recording devices may be activated in a particular sequence so as to record the participant progress through the water slide.

In some embodiments, a recording device may record images and/or sound. The recording device may record other data associated with recorded images and/or sound. Other data may include time, date, and/or information associated with a participant wearing a participant identifier. The recording device may record still images and/or moving (i.e., short movie clips). Examples of recording devices include, but are not limited to, cameras and video recorders.

In some embodiments, a recording device may be based on digital technology. The recording device may record digital images and/or sound. Digital recording may facilitate storage of recorded events, allowing recorded events to be stored on magnetic media (e.g., hard drives, floppy disks, etc. . . . ). Digital recordings may be easier to transfer as well. Digital recordings may be transferred electronically from the recording device to a control system and/or processing device. Digital recordings may be transferred to the control system via a hard-wired connection and/or a wireless connection.

Upon recording an event, the recording device may transfer the digital recording to the control system. The participant may purchase a copy of the recording as a souvenir. The participant may purchase a copy while still in a water amusement park, upon exiting the water amusement park, and/or at a later date. The control system may print a hard copy of the digital recording. The control system may transfer an electronic copy of the recorded event to some other type of media that may be purchased by the participant to take home with them. The control system may be connected to the Internet. Connecting the control system to the Internet may allow a participant to purchase a recorded event through the Internet at a later time. A participant may be able to download the recorded event at home upon arranging for payment.

In some embodiments, personal identifiers may be used in combination with sensors to locate a position of a participant in a water amusement park. Sensors may be positioned throughout the water park. The sensors may be connected to a control system. Locations of sensors throughout the water park may be programmed into the control system. The participant identifier may activate one of the sensors automatically when it comes within a certain proximity of the sensor. The sensor may transfer data concerning the participant (e.g., time, location, and/or identity) to the control system.

In some embodiments, participant identifiers may be used to assist a participant to locate a second participant. For example, identifiers may assist a parent or guardian to locate a lost child. The participant may consult an information kiosk or automated interactive information display. The interactive display may allow the participant to enter a code, name, and/or other predetermined designation for the second participant. The interactive display may then display the location of the second participant to the participant. The location of the second participant may be displayed, for example, as an icon on a map of the park. Security measures may be taken to ensure only authorized personnel are allowed access to the location of participants. For example, only authorized personnel (e.g., water park staff) may be allowed access to interactive displays and/or any system allowing access to identity and/or location data for a participant. Interactive displays may only allow participants from a predetermined group access to participant data from their own group.

In some embodiments, participant identifier may be used to assist in regulating throughput of participants through portions of a water amusement park. Participant identifiers may be used in combination with sensors to track a number of participants through a portion of the water amusement park. Keeping track of numbers of participants throughout the water park may allow adjustments to be made to portions of the water park. Adjustments made to portions of the water park may allow the portions to run more efficiently. Adjustments may be at least partially automated and carried out by a central control system. Increasing efficiency in portions of the water park may decrease waiting times for rides.

In some embodiments, sensors may be positioned along one or both sides of a floating queue line. Sensors in floating queue lines may be able to assist in detecting participants wearing participant identifiers. Data including about participants in the floating queue lines may be transferred to a control system. Data may include number of participants, identity of the participants, and/or speed of the participants through the floating queue lines. Based on data collected from the sensors, a control system may try to impede or accelerate the speed and/or throughput of participants through the floating queue line as described herein. Adjustment of the throughput of participants through the floating queue lines may be fully or partially automated. As numbers of participants in a particular ride increase throughput may decrease. In response to data from sensors the control system may increase the flow rate of participants to compensate. The control system may automatically notify water park staff if the control system is not able to compensate for increased flow rate of participants.

In certain embodiments (an example of which is depicted in FIG. 39), floating queue system 160 includes a queue channel 162 coupled to a water ride at a discharge end 164 and coupled to a transportation channel on the input end 166. The channel 162 contains enough water to allow participants to float in the channel 162. The channel 162 additionally comprises high velocity low volume jets 136 located along the length of the channel 162. The jets are coupled to a source of pressurized fluid (not shown). Participants enter the input end 166 of the queue channel 162 from the coupled transportation channel, and the jets 136 are operated intermittently to propel the participant along the channel at a desired rate to the discharge end 164. This rate may be chosen to match the minimum safe entry interval into the ride, or to prevent buildup of participants in the queue channel 162. The participants are then transferred from the queue channel 162 to the water ride, either by a sheet flow lift station (as described previously) or by a conveyor system (also described previously) without the need for the participants to leave the water and/or walk to the ride. Alternatively, propulsion of the participants along the channel 162 may be by the same method as with horizontal hydraulic head channels; that is, by introducing water into the input end 166 of the channel 162 and removing water from the discharge end 164 of the channel 162 to create a hydraulic gradient in the channel 162 that the participants float down. In this case, the introduction and removal of water from the channel 162 may also be intermittent, depending on the desired participant speed.

In some embodiments, a queue system may not include water or may not include water deep enough to substantially float otherwise buoyant rollable carriers. The queue system may include fluid jets located along the length of a path system forming the queue system. The fluid jets may include high velocity low volume fluid jets. The jets may use pressurized or high velocity fluids directed at participants/rollable carriers to propel them along a surface. The surface may include an incline, a decline, or be substantially level. Fluids may include liquids (e.g., water) and/or gases (e.g., air). Jets may be set at an appropriate angle to provide propulsive power for a rollable carrier. Jets may automatically orient themselves to a proper angle when connected to an automated control system. Jets may be positioned along floors, walls, and/or ceilings. Fluid jets using liquids to propel participant carriers along a portion of a water path system may be used in combination with dewatering systems. Dewatering systems may be especially useful when fluid jets using liquids are used to propel participant carriers up an incline. Dewatering systems may be used to remove liquid running down an inclined surface, such that the momentum of the liquid does not detract from the momentum of fluid expelled from fluid jets used to propel participants. Dewatering systems may be more fully described in U.S. Pat. No. 5,011,134 which is incorporated by reference herein.

Fluid jet systems used for rollable carrier propulsion in amusement rides may be more fully described in U.S. Pat. No. 5,213,547 to Lochtefeld and U.S. Pat. No. 5,503,597 to Lochtefeld et al. which are incorporated by reference as if fully set forth herein.

In some embodiments, participant identifiers may be used with interactive games. Interactive games may include interactive water games. Interactive games may be positioned anywhere in a water amusement park. Interactive games may be positioned along a floating queue line, an elevation system, and/or a water ride. Interactive games positioned along portions of the water amusement park where delays are expected may make waiting more tolerable or even pleasurable for participants.

An interactive water game including a control system as described above may include a water effect generator; and a water target coupled to the control system. In some embodiments, the water effect generator may include a water cannon, a nozzle, and/or a tipping bucket feature. The water effect generator may be coupled to a play structure. During use a participant may direct the water effect generator toward the water target to strike the water target with water. A participant may direct the water effect using a participant identifier to activate the water effect generator. Upon being hit with water, the water target may send an activation signal to the control system. Upon receiving an activation signal from the water target, the control system may send one or more control signals to initiate or cease predetermined processes.

The water target may include a water retention area, and an associated liquid sensor. In some embodiments, the liquid sensor may be a capacitive liquid sensor. The water target may further include a target area and one or more drains. The water target may be coupled to a play structure.

In some embodiments, the interactive water game may include one or more additional water effect generators coupled to the control system. Upon receiving an activation signal from the water target, the control system may send one or more control signals to the additional water effect generator. The additional water effect generator may be configured to create one or more water effects upon receiving the one or more control signals from the control system. For example, the one or more water effects created by the additional water effect generator may be directed toward a participant. The additional water effect generator may include, but is not limited to: a tipping bucket feature, a water cannon, and/or a nozzle. The additional water effect generator may be coupled to a play structure.

A method of operating an interactive water game may include applying a participant signal to an activation point associated with a water system. The participant signal may be fully automated and originate from a participant identifier. The participant signal may be activated when a participant wearing the participant identifier positions themselves in predetermined proximity of the activation point. Participant input may activate the participant signal using the participant identifier. An activation signal may be produced in response to the applied participant signal. The activation signal may be sent to a control system. A water system control signal may be produced in the control system in response to the received activation signal. The water system control signal may be sent from the control system to the water system. The water system may include a water effect generator. The water effect generator may produce a water effect in response to the water system control signal. The water effect generator may be directed toward a water target to strike the water target with water. An activation signal may be produced in the water target, if the water target is hit with water. The water target may send the activation signal to the control system. A control signal may be produced in the control system in response to the received water target activation signal. In some embodiments, the interactive water game may include an additional water effect generator. The control system may direct a control signal to the additional water effect generator if the water target is struck by water. The additional water effect generator may include, but is not limited to: a water cannon, a nozzle, or a tipping bucket feature. The additional water effect generator may produce a water effect in response to a received control signal. The water effect may be directed toward a participant.

In some embodiments, amusement rides, rollable carriers, and/or interactive water games may be combined into one amusement format. An example of this type of combination may include life sized water pinball rides. Rollable carriers may function as pinballs in a relatively sized water based pinball machine. Water based effects may be used in the pinball game. Effects of the amusement ride may be controlled by participants, programmable control systems, observers, and/or participants.

Another object of the invention is to give such observers control over certain elements of the water ride.

A pinball amusement ride may allow two-dimensional movement across the area and not simply movement from an upper area to a lower area.

To enable these objects, a water ride constructed includes a field area having a plurality of water effects and control systems for controlling those devices located outside of the field area for selective activation by observers watching participants within the field area. The field area may be laid out like a giant pinball machine in which participants are placed in groups or individually within rollable carriers representing the balls of the pinball machine. Movement of the rollable carriers along the field area plane may be influenced by movement inducing devices (e.g., flippers, spinners, stationary bumpers, and guides). The field area may include water devices (e.g., geysers, shower sprayers) that may either be on continuously or be selectively activated (e.g., by participants, observers, and/or programmable control systems) to drench participants within the field area with water.

Once positioned within rollable carriers, participants are launched from an upper end of the field area and proceed generally downward toward a receptacle (e.g., splash pool) at a lower end of the field area. Some of the movement inducing devices may be selectively actuated by observers located outside of the field area to propel the rollable carriers of the participants in a direction desired by the observer. Thus, for example, a observer can choose to selectively activate a flipper at the proper moment to thus propel a rollable carrier toward, for instance, a water shower whereupon another observer can activate the water shower at the proper moment to drench the participant(s) and/or rollable carrier.

There are multiple advantages to such a system. First, observers are entertained as well as the participants by allowing observers to affect the outcome of the water ride for the participants within. Second, such a ride may be simpler to operate since the observers themselves could activate the effects at the proper time rather than requiring extra staff or precisely timed automation. It is understood that such effects may be operated under a programmable control system if the effect has not been activated by an observer after a certain preset time period. Third, a pinball-type layout, including movement inducing devices and water devices, would allow movement in two dimensions or more thus increasing the novelty of the water ride even after multiple uses.

Figure 40:
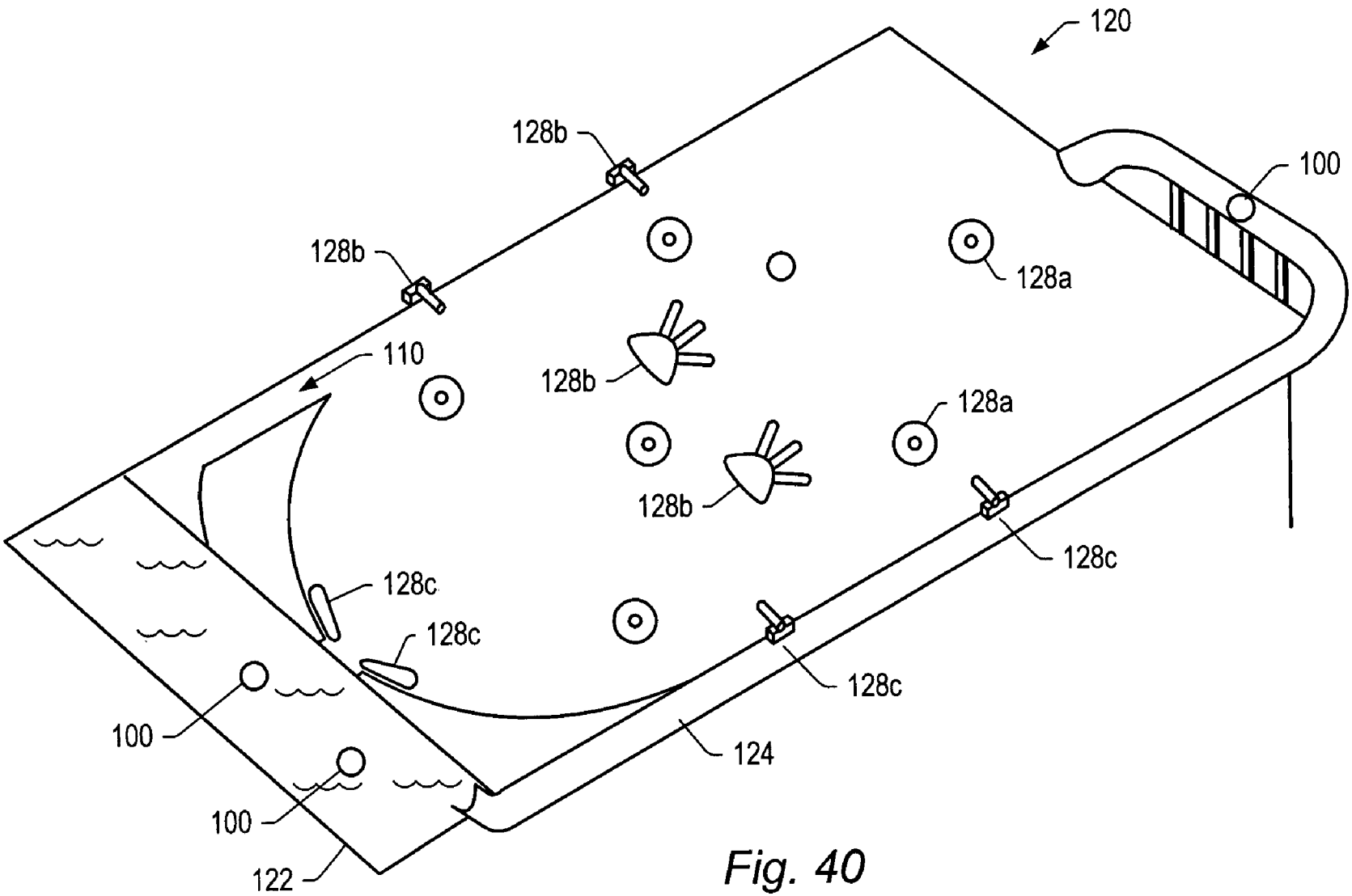
FIG. 40 depicts an embodiment of an amusement ride including interactive elements for participants and observers.
Figure 41:
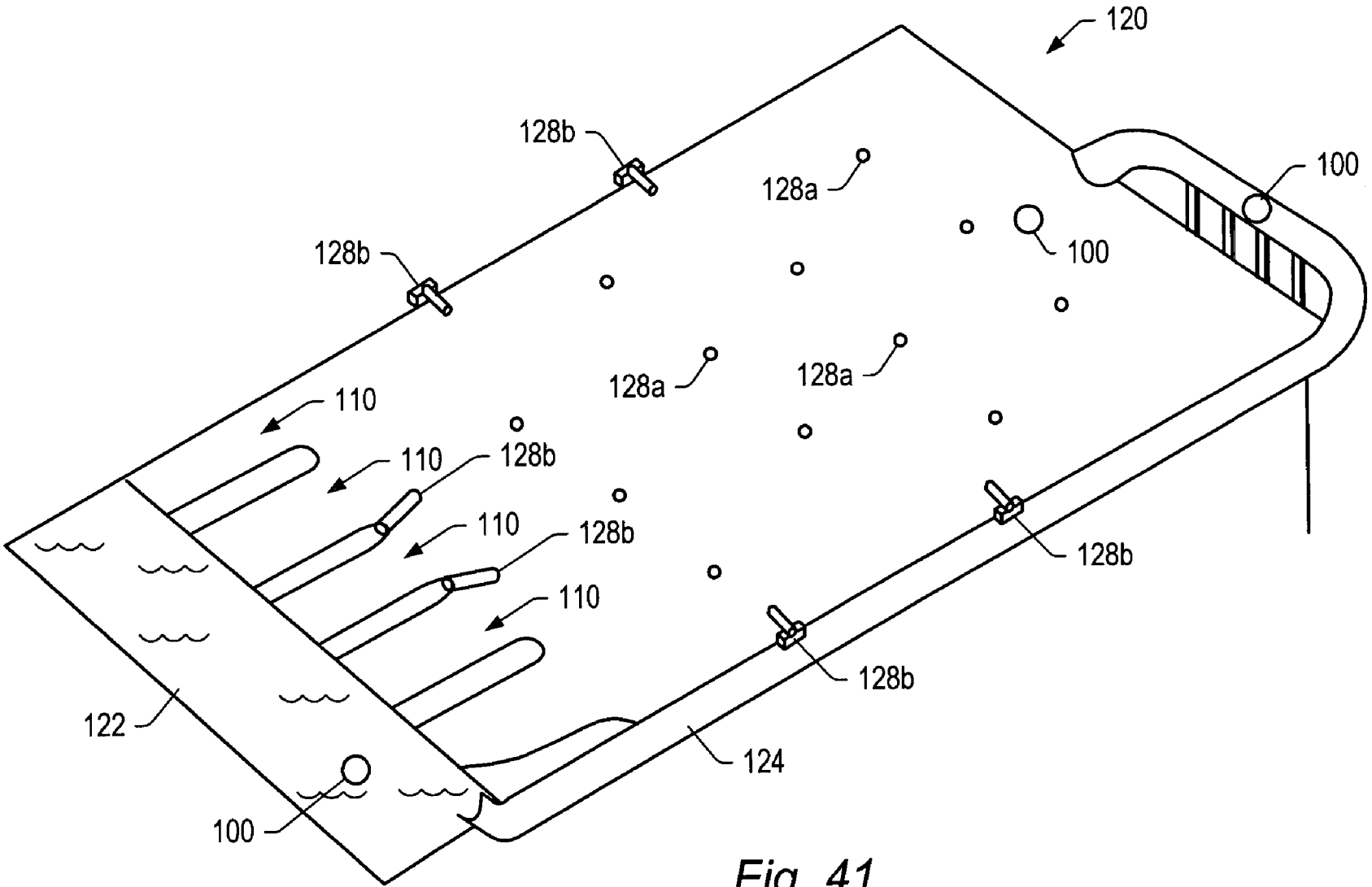
FIG. 41 depicts an embodiment of an amusement ride including interactive elements for participants and observers.

FIG. 40 and FIG. 41 depicts an embodiment of amusement ride 120 including interactive elements 128 for participants and observers. Amusement ride 120 may include a sloped field, which slopes at a downward angle towards body of water 122. The sloping field of amusement ride 120 may facilitate (e.g., gravity) rollable carriers 100 movement toward body of water 122. Rollable carriers 100 may their way down the sloping field of amusement ride 120 toward one or more openings 110. Along the way towards openings 110, rollable carriers 100 may interact with amusement elements 128. Amusement elements 128 may include amusement elements which are reactive, static, and/or interactive.

For example, amusement elements 128 may include amusement elements 128*a*, which may be commonly referred to as bumpers. Bumpers 128*a* may be static. Static bumpers 128*a* may simply act as obstacles to rollable carriers 100 natural progress toward openings 110. Bumpers 128*a* may be reactive. Reactive bumpers 128*a* may react to contact from a force of impact with rollable carriers 100. Rollable carriers 100 which impact reactive bumpers 128*a* may initiate a mechanism in the reactive bumper causing a portion of the bumper to spring outward in reaction to the impact of the rollable carrier, imparting momentum to the rollable carrier.

For example, amusement elements 128 may include amusement elements 128*b*, which may be commonly referred to as water cannons. Water cannons 128*b* may be static. Static water cannons 128*b* may simply run continuously as long as the amusement ride is active and turned on, the water cannons acting as obstacles to rollable carriers 100 natural progress toward openings 110. Water cannons 128*b* may be reactive. Reactive water cannons 128*b* may react to the presence of rollable carriers 100 within a predetermined range or vicinity of the water cannons. A programmable control system including sensors capable of detecting the rollable carriers may trigger the reactive water cannons. Water cannons 128*b* may be interactive. Interactive water cannons 128*b* may be controlled by observers not located in rollable carriers. Observers may control interactive water cannons 128*b* in order to work with or against participants by pushing them away or towards openings 110.

For example, amusement elements 128 may include amusement elements 128*c*, which may be commonly referred to as flippers. Flippers 128*c* may be reactive. Flippers 128*c* may act as obstacles to rollable carriers 100 natural progress toward openings 110. Flippers 128*c* may react to the presence of rollable carriers 100 within a predetermined range or vicinity of the flippers. A programmable control system including sensors capable of detecting the rollable carriers may trigger the flippers. Flippers 128*c* may be interactive. Interactive flippers 128*c* may be controlled by observers not located in rollable carriers. Observers may control interactive flippers 128*c* in order to work with or against participants by pushing them away or towards openings 110.

Amusement elements such as water cannons 128*b* and flippers 128*c* may alternate between reactive and interactive. Amusement elements may include sensors which detect the presence of an observer at the controls of the amusement element, the amusement element automatically relinquishing control over to the observer. When an observer is not present at the controls the amusement element may automatically switch to a reactive mode. In some embodiments, amusement elements may include a control which switches the amusement element from reactive to interactive for a predetermined period of time.

Amusement ride 120 may include elevation system 124. In the embodiments depicted in FIG. 40 and FIG. 41, elevation system 124 may include a conveyor belt system. Elevation system 124 may include any system described herein or known to one skilled in the art for elevating participants, carriers, and/or rollable carriers from a first lower elevation to a second higher elevation.

FIG. 41 may include an embodiment of amusement ride 120, where the amusement ride include multiple openings 110 to body of water 122. The different openings may be worth different points for a participant able to maneuver their rollable carrier through a particular opening.

The fact that participants enclosed in rollable carriers 100 may alter their trajectory and/or momentum add to the enjoyment factor of the participants as well as the observers. In this way it is possible for participants and observers to work with and/or against one another adding another dimension to the ride.

Examples of amusement rides based on pinball games which may be adapted for the herein described purposes are illustrated in U.S. Pat. No. 6,045,449 to Aragona et al. which is incorporated by reference as if fully set forth herein.

Amusement rides including water channels (e.g., artificial rivers) may include adjustable mechanisms or devices capable of changing the course of a river. Adjustable mechanisms such as these may be described as adjustable weirs. Weirs are generally defined as a dam placed across a river or canal to raise or divert the water, or to regulate or measure the flow of water.

A mechanism is described that controls the flow of water for an artificial river, in the context of water park, and in the setting of participants and participant carriers within the controlled river. Adjustable weirs may be optimally producible, easily installed, and/or readily maintained. Safety to both participants and personnel may be a requirement. Adjustable weirs may function to alter flow characteristics of water in a channel, produce downstream rapids of varying degree, and/or undulations to such in dynamic fashion. Adjustable weirs may function to fully dam up the upstream body of water (with only moderate leakage), whether in off-duty mode and/or in the event of power failure, such that, for example, upper water volumes may not overflow lower regions of the same river system.

Adjustable weirs may include safety fail-safes. For example an adjustable weir may include a loss of power mode, where the weir reverts to/maintains an upward (water-retaining) position. Adjustable weir fail-safes may include keeping gaps between static and moving features to a safe minimum, and/or inherently precluding access. Adjustable weir fail-safes may include ensuring no serviceable equipment (except for fundamental overhaul, coinciding with river drainage) may be located behind or beneath the primary mechanism. Advantages of ensuring no serviceable equipment is located behind or beneath the primary mechanism may ensure accessibility to serviceable equipment (e.g., when in the failsafe position, a huge body of water may be under retention). Serviceable equipment and/or motive components may be located outboard of the main channel, whether below grade (e.g., in pits), and/or above (e.g., in enclosures).

Adjustable weirs may include serviceable equipment and components which may be removed/exchanged with comparative rapidity and minimal disruption/removal of other components. Adjustable weirs may require minimal maintenance. Adjustable weirs may include drive mechanisms which are chemically benign (e.g., electrical or pneumatic). Chemically benign drive mechanisms are advantageous when river systems (natural or artificial) are used so as to inhibit introduction of chemicals (e.g., hydraulic fluid) into the environment. Non-engineered parts may be used whenever possible for the construction of adjustable weirs, chosen at least for durability and ready availability. Adjustable weirs may include lock-out features, such that the weir table may be redundantly secured into either of its extreme positions, regardless of hydraulic conditions in the river. Positioning of an adjustable weir may be capable of dynamic operation, taking into account the changing hydraulic forces of the moving volume of water.

Figure 42:
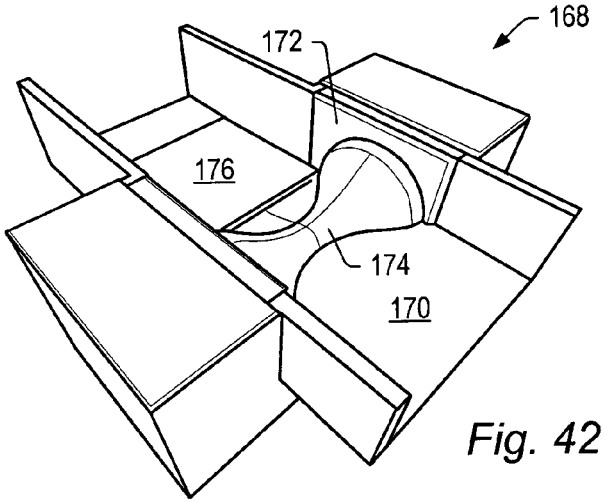
FIG. 42 depicts a perspective view of an embodiment of an adjustable weir in a powered down state in a portion of a water channel of an amusement ride.

FIG. 42 depicts a perspective view of an embodiment of adjustable weir 168 in a powered down state in a portion of a water channel of an amusement ride. In general, a "relaxed" state of a channel (e.g., river) may be in fact the fully powered-down state of weir 168. In this position, water is flowed over the minimal profile, causing downstream turbulence. Participants, float at some distance above, having minimal or no contact with the surfaces portrayed in FIG. 42.

Closing the gaps are fixed upstream plate 170 (secured to the concrete riverbed), and side shrouds 172. Both elements may continuously fit to rotatable contour 174, regardless of its position. The rotatable contour depicted in the associated figures is in the shape of an "hourglass," however it should be noted this is just one example of many possible shapes the rotatable contour may assume.

Figure 43:
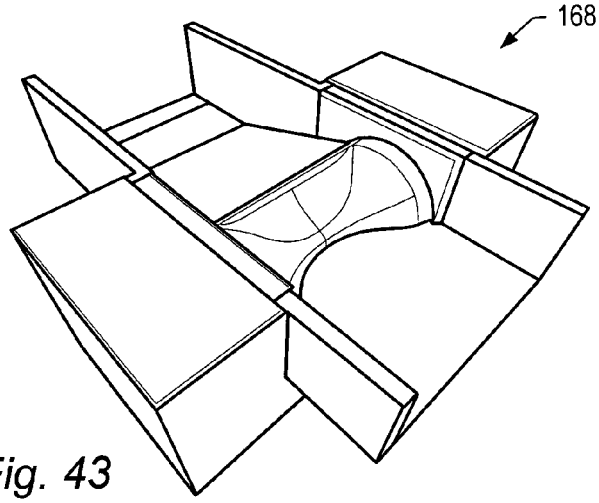
FIG. 43 depicts a perspective view of an embodiment of an adjustable weir in a 50% retracted state in a portion of a water channel of an amusement ride.

FIG. 43 depicts a perspective view of an embodiment of adjustable weir 168 in a 50% retracted state in a portion of a water channel of an amusement ride. With an adjustable weir 50% retracted, serious downstream turbulence may be introduced. Participants may be shot over a raised stream, from a body of water made more pacific by the weir, into a high-velocity condition.

To prevent water and/or participants from being sucked down behind adjustable weir 168, trailing plates 176 may be attached to the pivoting weir table. An upstream leaf is hinged directly thereto; a horizontal plate may be dragged behind. Together, a benign (though moving) riverbed is presented, with close proximity to the concrete walls (and minimal gaps).

Figure 44:
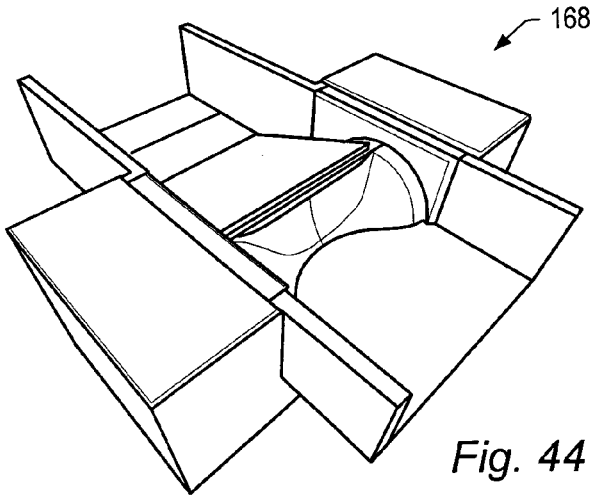
FIG. 44 depicts a perspective view of an embodiment of an adjustable weir in a fully retracted state in a portion of a water channel of an amusement ride.

FIG. 44 depicts a perspective view of an embodiment of adjustable weir 168 in a fully retracted state in a portion of a water channel of an amusement ride. When the weir is fully retracted, for off-hours, maintenance duty, or power failure, its de-energized position is fully vertical. Water flow is prevented, with the weir effectively being a dam.

Figure 45:
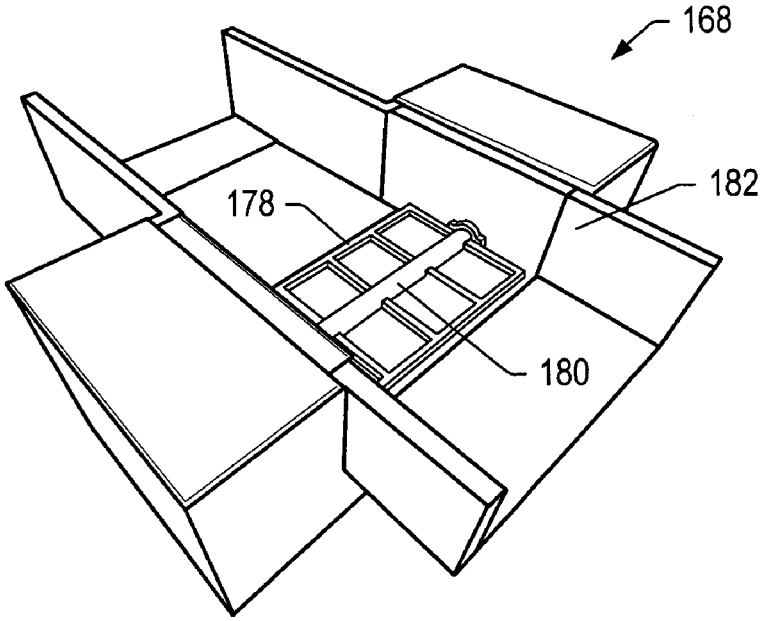
FIG. 45 depicts a perspective view of an embodiment of a portion of an adjustable weir in a portion of a water channel of an amusement ride.
Figure 46:
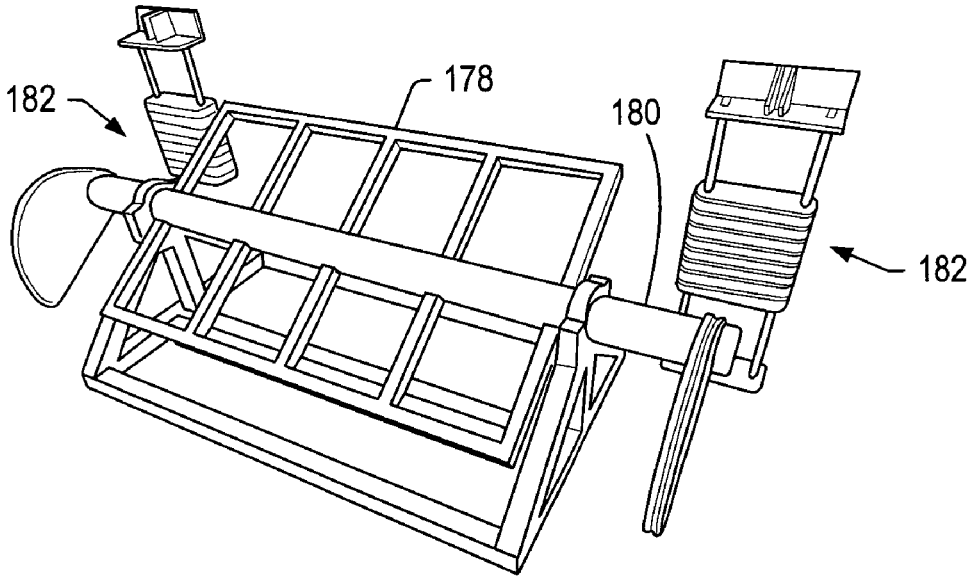
FIG. 46 depicts a perspective view of an embodiment of a portion of an adjustable weir.

FIG. 45 depicts a perspective view of an embodiment of a portion of adjustable weir 168 in a portion of a water channel of an amusement ride. FIG. 46 depicts a perspective view of an embodiment of a portion of adjustable weir 168. Note, in adjustable weir embodiments including counterweight mechanisms, that the outboard (adjustable) counterweights are, in the fully retracted position, fully dropped.

Note also outboard pits may be covered—though size, shape, theming, etc., of such will be determined on an application basis.

FIG. 45 and FIG. 46 depict an embodiment of adjustable weir 168 including a counterweight mechanism system. With FRP/trim pieces removed, the mechanism includes a main structural frame 178, tilting weir table-shaft 180, and counterweight system 182.

As a variety of drive means may be applied, none are presented in the FIGS. FIG. 45 and FIG. 46. Drive means may be installed in the outboard pit areas. Any drive means known to one skilled in the art may be used.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A system for conveying a participant from a first source of water to a second source of water comprising:

a belt; wherein the belt is coupled to the first source of water and to the second source of water;

a belt movement system, configured to move the belt in a loop during use; and one or more fluid jets configured to produce a fluid stream having a predetermined velocity which is selectively greater, less than, or the same as a velocity of a participant at each of the fluid jet locations, wherein at least some of the fluid jets are positioned along a portion of the first source of water and/or a portion of the second source of water substantially adjacent to a portion of the belt, wherein the fluid jets are oriented with respect to the surface of the source of water so as to contact a participant and/or participant vehicle as a participant and/or participant vehicle passes by each of the locations, and wherein at least the portion of the first source of water and/or the portion of the second source of water substantially adjacent to the portion of the belt comprises water at a depth allowing a participant and/or a participant vehicle to float;

wherein at least a portion of the first source of water and/or a portion of the second source of water substantially adjacent a portion of the belt comprises water at a depth allowing a participant to enter a participant vehicle from the water.

2. The system of claim 1, wherein the fluid comprises water.

3. The system of claim 1, wherein the fluid comprises air.

4. The system of claim 1, wherein at least one of the fluid jets is configured to impart momentum to a participant and/or participant vehicle.

5. The system of claim 1, wherein at least one of the fluid jets is configured to assist a participant and/or participant vehicle from the first source of water and/or the second source on and/or off the belt.

6. The system of claim 1, wherein at least one of the fluid jets is configured to move a participant and/or participant vehicle toward the belt.

7. The system of claim 1, wherein at least one of the fluid jets is configured to move a participant and/or participant vehicle away from the belt.

8. The system of claim 1, wherein at least a portion of the first source of water and/or a portion of the second source of water substantially adjacent a portion of the belt comprises water at a depth of less than about 2 feet.

9. The system of claim 1, wherein at least a portion of the first source of water and/or a portion of the second source of water substantially adjacent a portion of the belt comprises water at a depth in the range of 1 to 3 feet.

10. The system of claim 1, further comprising a water flow sensor coupled to the first source of water, wherein the water flow sensor is configured to monitor the water flow rate of the first source of water proximate the belt.

11. The system of claim 1, further comprising:

a water flow sensor coupled to the first source of water, wherein the water flow sensor is configured to monitor the water flow rate of the first source of water proximate the belt; and a controller, wherein the controller is coupled to the belt movement system and the water flow sensor.

12. The system of claim 1, further comprising:

a water flow sensor coupled to the first source of water, wherein the water flow sensor is configured to monitor the water flow rate of the first source of water proximate the belt; and a controller, wherein the controller is coupled to the belt movement system and the water flow sensor, and wherein the controller is configured to produce a control signal for the belt movement system, and wherein the belt movement system is configured to move the belt in response to the control signal.

13. The system of claim 1, wherein a portion of the belt extends below the surface of the water.

14. The system of claim 1, wherein the first source of water is at a different elevation than the second source of water.

15. The system of claim 1, wherein the belt comprises a material and design to inhibit the participant from moving in a direction opposite that of the direction the belt is moving.

16. The system of claim 1, wherein a protective device is positioned to cover the outer edges of the belt, wherein the participants are inhibited from accessing the belt movement system by the protective device.

17. The system of claim 1, further comprising a detection device positioned above the belt movement system, wherein the detection device is configured to detect when a participant is in a position above a predetermined height above the belt.

18. The system of claim 1, further comprising a detection device positioned above the belt movement system, wherein the detection device is configured to produce a detection signal when a participant is in a position above a predetermined height above the belt, and wherein the detection device is electronically coupled to the belt movement system such that the belt movement system is deactivated in response to a received detection signal.

19. The system of claim 1, further comprising a deflector plate positioned below the surface of the water wherein the deflector plate is positioned to inhibit the participant from moving to a position below the belt.

20. The system of claim 1, further comprising a deflector plate positioned below the water wherein the deflector plate is positioned to inhibit the participant from moving to a position below the belt, and wherein the deflector plate is substantially angled to guide participants onto and/or off the belt.

21. The system of claim 1, further comprising a deflector plate positioned below the water, wherein the deflector plate is positioned to inhibit the participant from moving to a position below the belt, and wherein the deflector plate is substantially angled to guide participants onto and/or off the belt, and wherein the deflector plate is permeable to water so as not to inhibit a current in the water directing a participant onto the belt.

22. The system of claim 1, wherein the belt comprises a width such that only a single participant enters the system at the same time during use.

23. The system of claim 1, wherein the belt comprises a width such that at least two participants enter the system at the same time during use.

24. The system of claim 1, further comprising at least one floating queue line positioned within the first source of water upstream from the belt, wherein the floating queue line is configured to position the participants in a predetermined configuration prior to moving onto the belt during use.

25. The system of claim 1, further comprising a barrier positioned on each side of the belt, wherein the barrier is configured to inhibit participants from leaving the belt as the participants are conveyed along the belt.

26. The system of claim 1, further comprising a plurality of barriers positioned along the belt, wherein the barriers are configured to define channels along the belt, and wherein participants move along the belt within the defined channels during use.

27. The system of claim 1, wherein the participant is riding on a floatation device.

28. The system of claim 1, wherein the belt movement system comprises:

at least two rollers, wherein the belt is coupled to the rollers such that rotation of the rollers causes the belt to move around the rollers during use; and a power supply coupled to at least one of the rollers, wherein the power supply is configured to supply a rotational force to at least one of the rollers during use.

29. A method for conveying a participant from a first source of water to a second source of water comprising:

moving a belt in a loop using a belt movement system, wherein the belt is coupled to a first source of water and to a second source of water, wherein the belt and belt movement system form at least part of a conveyor belt system, and wherein each source of water is configured to contain a sufficient amount of water to allow the participant to float within the sources of water;

producing a fluid stream using one or more fluid jets having a predetermined velocity which is selectively greater, less than, or the same as a velocity of a participant at each of the fluid jet locations, wherein at least some of the fluid jets are positioned along a portion of the first source of water and/or a portion of the second source of water substantially adjacent to a portion of the belt, wherein the fluid jets are oriented with respect to the surface of the source of water so as to contact a participant and/or participant vehicle as a participant and/or participant vehicle passes by each of the locations, and wherein at least the portion of the first source of water and/or the portion of the second source of water substantially adjacent to the portion of the belt comprises water at a depth allowing a participant and/or a participant vehicle to float;

wherein at least a portion of the first source of water and/or a portion of the second source of water substantially adjacent a portion of the belt comprises water at a depth allowing a participant to enter a participant vehicle from the water.

30. A system for conveying a participant from a first source of water to a second source of water comprising:

a belt; wherein the belt is coupled to the first source of water and to the second source of water;

a belt movement system, configured to move the belt in a loop, wherein at least the portion of the first source of water and/or the portion of the second source of water substantially adjacent to the portion of the belt comprises water at a depth allowing a participant and/or a participant vehicle to float; and a deflector plate positioned below the water, wherein the deflector plate is positioned to inhibit the participant from moving to a position below the belt, and wherein the deflector plate is substantially angled to guide participants onto and/or off the belt, and wherein the deflector plate is permeable to water so as not to inhibit a current in the water directing a participant onto the belt;

wherein at least a portion of the first source of water and/or a portion of the second source of water substantially adjacent a portion of the belt comprises water at a depth allowing a participant to enter a participant vehicle from the water.

31. The system of claim 30, further comprising:

a water flow sensor coupled to the first source of water, wherein the water flow sensor is configured to monitor the water flow rate of the first source of water proximate the belt; and a controller, wherein the controller is coupled to the belt movement system and the water flow sensor, and wherein the controller is configured to produce a control signal for the belt movement system, and wherein the belt movement system is configured to move the belt in response to the control signal.

32. The system of claim 30, wherein a portion of the belt extends below the surface of the water.

33. The system of claim 30, wherein the first source of water is at a different elevation than the second source of water.

34. The system of claim 30, further comprising a detection device positioned above the belt movement system, wherein the detection device is configured to detect when a participant is in a position above a predetermined height above the belt.

* * * * *